US012553681B2

(12) United States Patent
Lessard et al.

(10) Patent No.: US 12,553,681 B2
(45) Date of Patent: Feb. 17, 2026

(54) DYNAMICALLY BALANCED TRIGGER SYSTEM

(71) Applicant: Q, LLC, Dover, NH (US)

(72) Inventors: Ethan Lessard, East Kingston, NH (US); Nicholas Schafer, Northwood, NH (US)

(73) Assignee: Q, LLC, Dover, NH (US)

( * ) Notice: Subject to any disclaimer, the term of this patent is extended or adjusted under 35 U.S.C. 154(b) by 7 days.

(21) Appl. No.: 18/806,124

(22) Filed: Aug. 15, 2024

(65) Prior Publication Data

US 2024/0401896 A1 Dec. 5, 2024

Related U.S. Application Data

(63) Continuation-in-part of application No. 18/179,764, filed on Mar. 7, 2023.

(60) Provisional application No. 63/317,288, filed on Mar. 7, 2022.

(51) Int. Cl.

| | |
|---|---|
| ***F41A 19/33*** | (2006.01) |
| ***F41A 19/12*** | (2006.01) |
| ***F41A 19/14*** | (2006.01) |
| ***F41A 19/16*** | (2006.01) |
| ***F41A 19/31*** | (2006.01) |

(52) U.S. Cl.

CPC ..... *F41A 19/33* (2013.01); *F41A 19/12* (2013.01); *F41A 19/14* (2013.01); *F41A 19/16* (2013.01); *F41A 19/31* (2013.01)

(58) Field of Classification Search

CPC ..... F41A 19/33; F41A 19/12; F41A 19/46; F41A 19/15

USPC ..... 89/139–140

See application file for complete search history.

(56) References Cited

U.S. PATENT DOCUMENTS

| | | | | |
|---|---|---|---|---|
| 2,136,511 | A * | 11/1938 | Jones | F41A 19/24 42/69.01 |
| 9,671,187 | B2 * | 6/2017 | Colman | F41A 19/15 |
| 9,952,012 | B2 * | 4/2018 | Fellows | F41A 19/14 |
| 11,724,003 | B2 * | 8/2023 | Strbac | A61L 24/0031 42/69.01 |
| 2005/0235544 | A1 | 10/2005 | Bischoff | |
| 2015/0153125 | A1 | 6/2015 | Lutton et al. | |
| 2017/0160033 | A1 | 6/2017 | Schmid et al. | |
| 2018/0135929 | A1 | 5/2018 | Geissele | |
| 2018/0149441 | A1 | 5/2018 | Reynolds | |

OTHER PUBLICATIONS

WO 2015/103651 A1 and English Translation (Year: 2015).*

(Continued)

*Primary Examiner* — Reginald S Tillman, Jr.

(74) *Attorney, Agent, or Firm* — Eversheds Sutherland (US) LLP

(57) ABSTRACT

A dynamically balanced trigger system for a firearm. The dynamically balanced trigger has a specific design, orientation, weights, and cutouts such as to provide a balanced trigger, where the chances of accidental discharge due to drops, shocks, and impacts are dramatically reduced. Unlike other triggers, the dynamically balanced trigger system has a trigger with a center of gravity near the center point of the trigger, which weights the trigger components against itself to prevent movement, such as may be caused by dropping the firearm, thereby helping prevent an unintentional discharge of the firearm.

20 Claims, 47 Drawing Sheets

(56) References Cited

OTHER PUBLICATIONS

International Search Report mailed Jun. 14, 2023 issued in International Application No. PCT/US2023/014731.
Written Opinion of the International Search Authority mailed Jun. 14, 2023 issued in International Application No. PCT/US/2023/014731.

* cited by examiner

DYNAMICALLY BALANCED TRIGGER SYSTEM

CROSS-REFERENCE TO RELATED APPLICATIONS

This application is a continuation-in-part of U.S. patent application Ser. No. 18/179,764, filed Mar. 7, 2023, which is related to, and claims the benefit of, U.S. Provisional Patent Application No. 63/317,288, filed Mar. 7, 2022, the entire contents of which are incorporated herein by reference.

TECHNICAL FIELD

The present application relates generally to a trigger system.

BACKGROUND

Trigger systems for rifles typically comprise a trigger, disconnector, sear, and hammer, in addition to springs and other components that facilitate the operation of the trigger system. To simplify the installation and removal of trigger systems, it is known to assemble these parts in a housing, and then retain the housing within the receiver of a rifle using a hammer pin and trigger pin For many triggers, the design of the trigger and other components are such that during a drop test and the like, the force of hitting the ground may cause movement of the trigger or disconnector, resulting in a negligent discharge of the firearm. Thus, it is desirable in the art to have a rifle trigger that decreases or eliminates negligent discharge in response to a blunt force (e.g., drop test), and mitigates trigger slap. Further, the geometry of the various components and how they interact with one another, tend to cause trigger slap, or the abrupt forcing of the trigger back into a forward (muzzle direction) movement of the trigger when the hammer is re-cocking.

BRIEF DESCRIPTION OF THE DRAWINGS

The detailed description is set forth with reference to the accompanying drawings. The drawings are provided for purposes of illustration only and merely depict example embodiments of the disclosure. The drawings are provided to facilitate understanding of the disclosure and shall not be deemed to limit the breadth, scope, or applicability of the disclosure. In the drawings, the left-most digit(s) of a reference numeral may identify the drawing in which the reference numeral first appears. The use of the same reference numerals indicates similar, but not necessarily the same or identical components. However, different reference numerals may be used to identify similar components as well. Various embodiments may utilize elements or components other than those illustrated in the drawings, and some elements and/or components may not be present in various embodiments. The use of singular terminology to describe a component or element may, depending on the context, encompass a plural number of such components or elements and vice versa.

DETAILED DESCRIPTION

Figure 1:
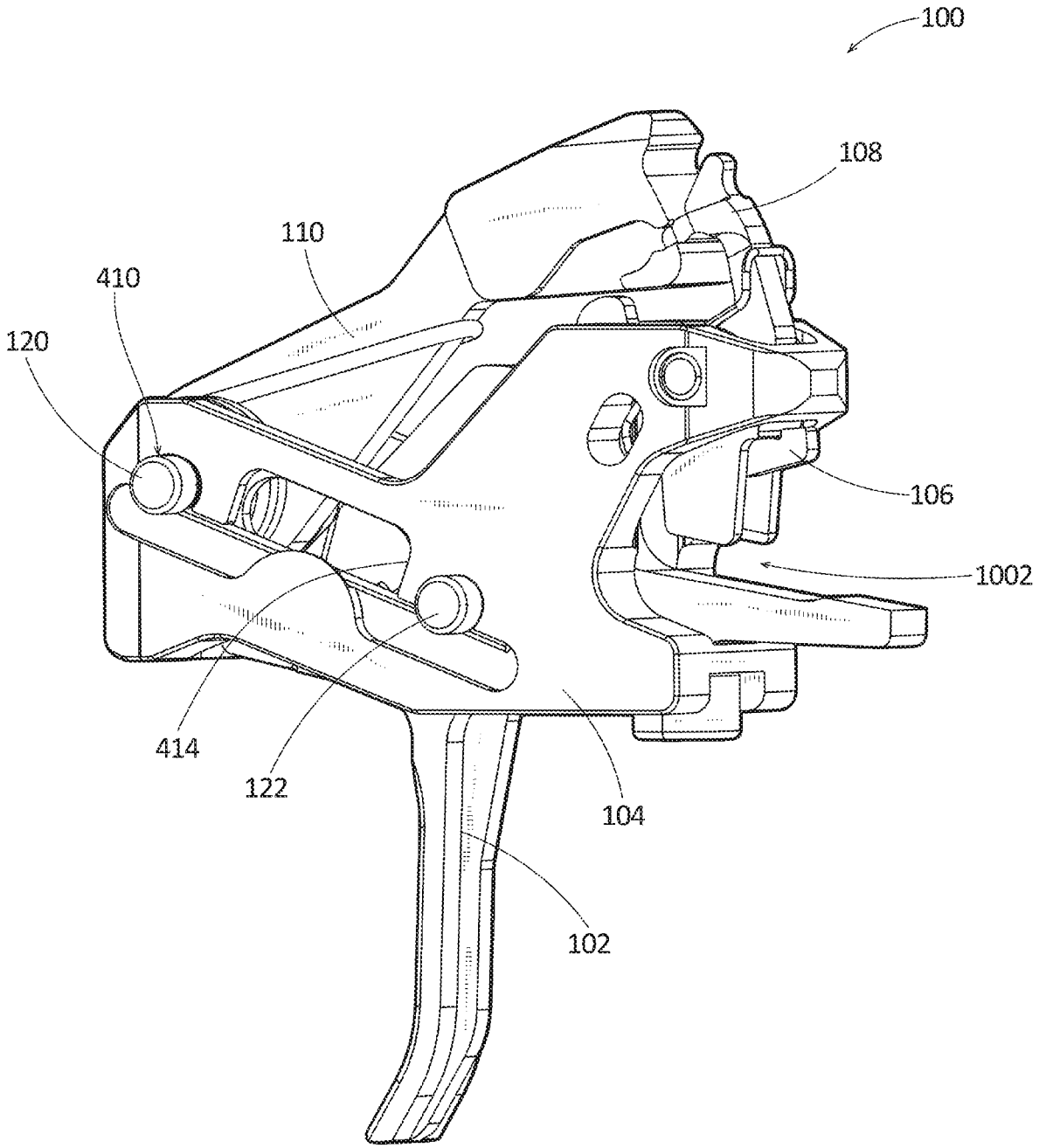
FIG. 1 is a perspective view of a dynamically balanced trigger system according to one or more examples of the disclosure.
Figure 2:
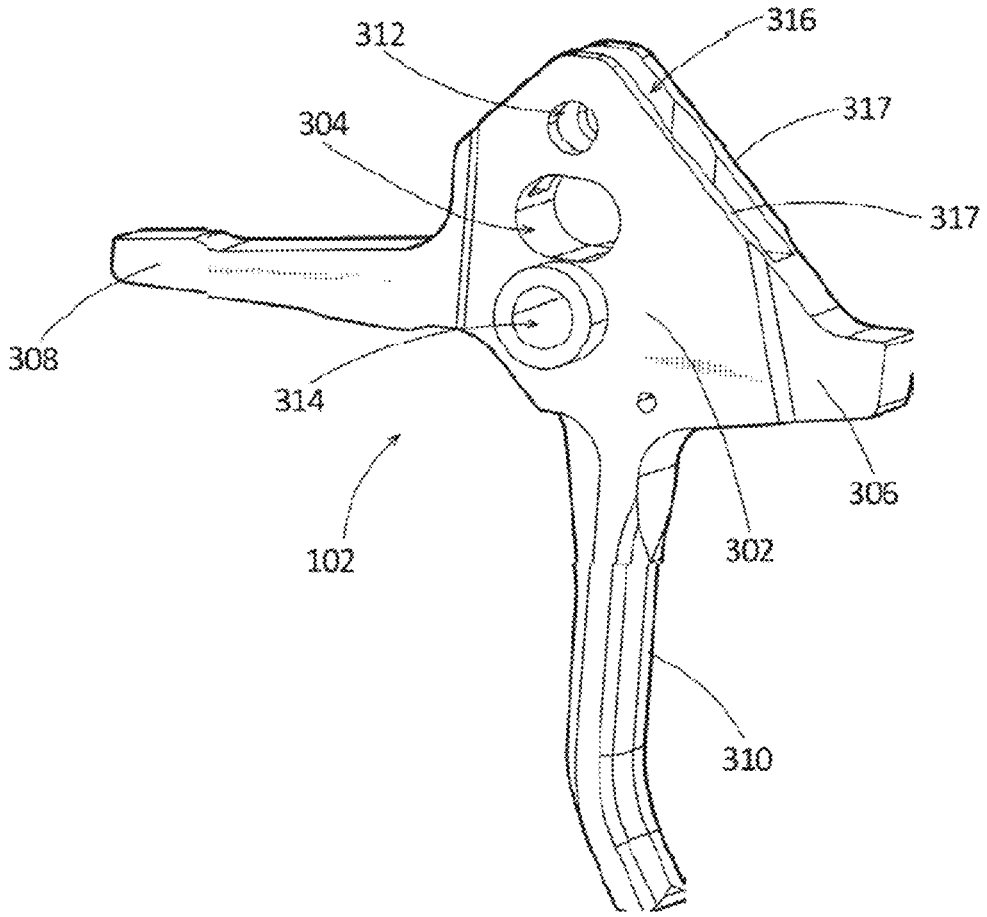
FIGS. 2 and 3A-3B are views of a trigger according to one or more examples of the disclosure.

The present disclosure provides for a dynamically balanced trigger system 100 for a firearm. The dynamically balanced trigger has a specific design, orientation, weights, and cutouts such as to provide a balanced trigger, where the chances of accidental discharge due to drops, shocks, and impacts is dramatically reduced. Unlike other triggers, the dynamically balanced trigger system 100 has a trigger 102 with a center of gravity near the center point of the trigger 102, that is, the axis of rotation, which weights the trigger components against itself to prevent movement, such as may be caused by dropping the firearm, thereby helping prevent an unintentional discharge of the firearm. The dynamically balanced trigger system 100 may be a two-stage trigger, and includes a trigger 102 connected to a disconnector 106 by a disconnector pin 124. The disconnector 106 is configured to be actuated when the trigger 102 is actuated. The disconnector 106 is configured to engage with the sear 108 when actuated, and to actuate the sear 108. The sear 108 is configured to engage with a hammer 110 and release the hammer 110 when the sear 108 is pulled back, away from the hammer 110 so as to disengage from the hammer 110, by the movement of the disconnector 106. The trigger 102, sear 108, and hammer 110 are connected to the housing 104 by various pins 120, 122, and 126.

In some embodiments, the trigger 102 comprises a main body 302, a bore 304 there through the main body 302, a nose 306 configured to be received by the notch 606 of the hammer 110 during one stage of movement, a tail 308 extending parallel to the nose 306 from the opposite end of the trigger for engaging the fire selector of the firearm, and a shoe 310 extending substantially perpendicular to the nose 306 and tail 308. The trigger 102 and its components and cutouts are configured to help properly balance the trigger 102 about a pivot point at bore 314, about which the trigger 102 rotates in operation. For purposes of the present disclosure, a bore may interchangeably be described as a bore, aperture, or void. The bore 314 in the trigger 102 is configured for receiving a trigger pin 122 that secures the trigger 102 to the housing 104 at bore 414, which trigger pin 122 also engages the walls of the firearm receiver into which the trigger system 100 is installed. The trigger 102 may have one connection point for connecting to the housing 104 and firearm (for example, bore 314) and another different connection point for connecting to the disconnector 106 (for example, the bore 312).

The trigger 102 may be balanced around the bore 314, such that the center of gravity of the trigger 102 is at the bore 314, dynamically balancing the trigger 102 in operation. This is achieved, at least in part, by the size and shape of the nose 306 and tail 308, as well as the size and shape of the trigger shoe 310 and bore 304.

Figure 3A:
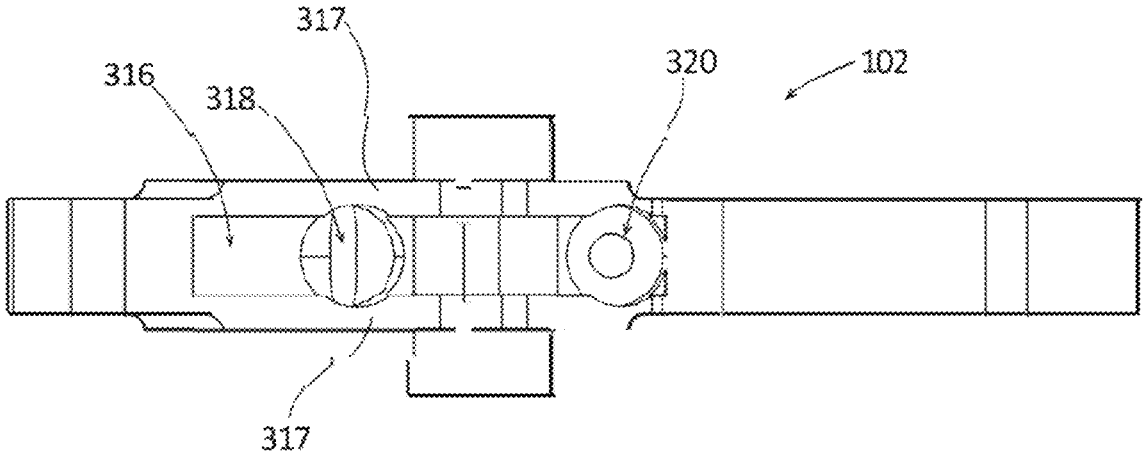
Figure 4A:
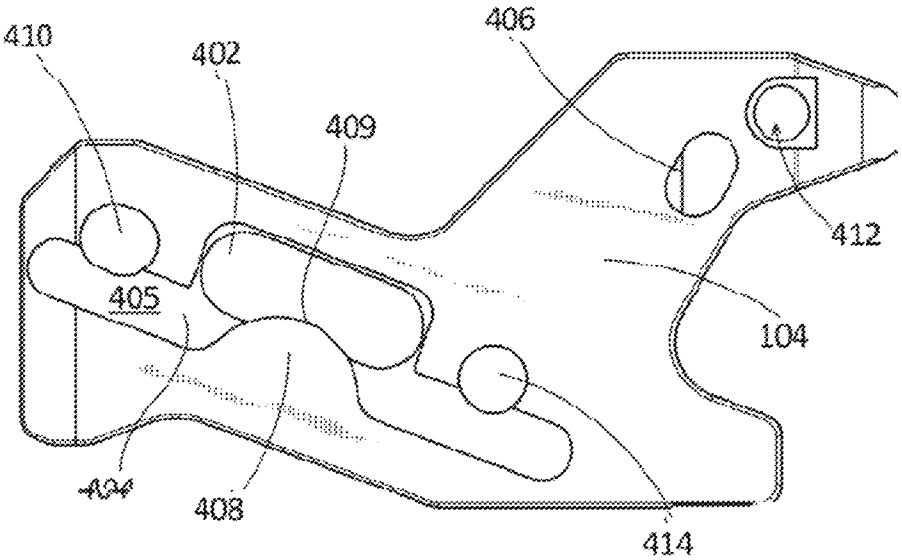
FIGS. 4A-4B and 14-16 are views of a housing according to one or more examples of the disclosure.
Figure 3B:
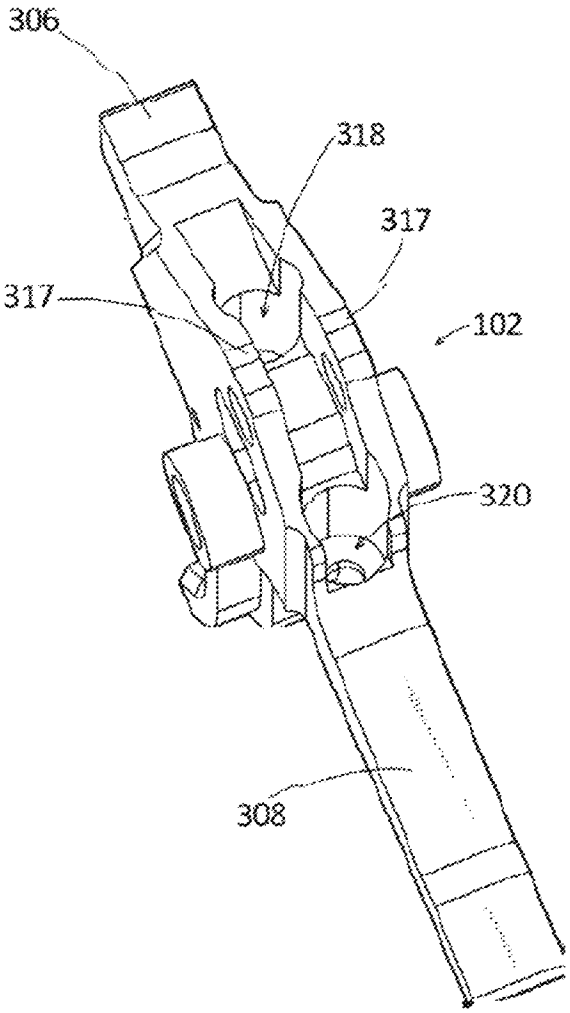
Figure 4B:
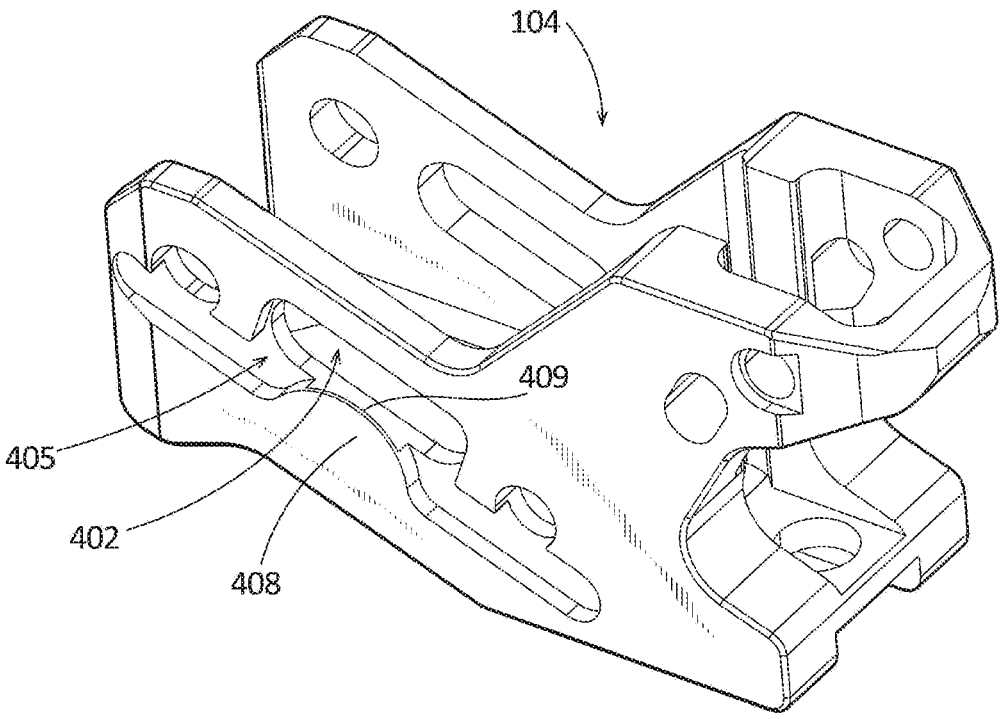
Figure 5:
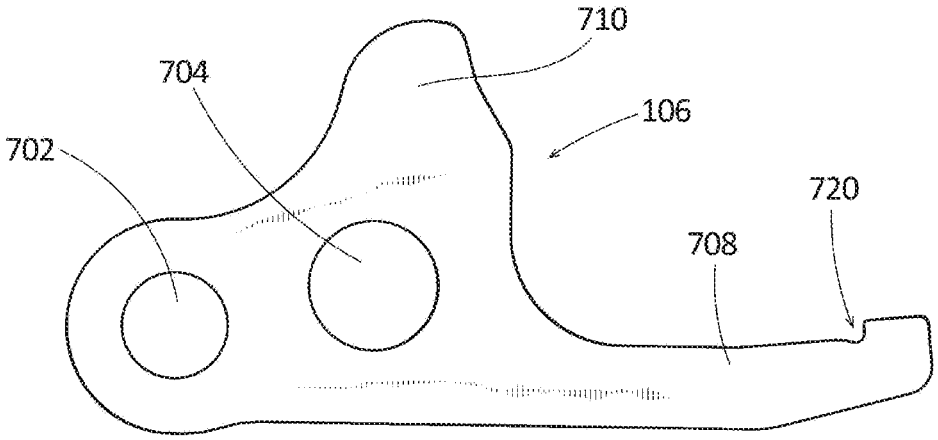
FIG. 5 is a view of a disconnector according to one or more examples of the disclosure.

The slot 304 may be sized, shaped, and disposed relative to the nose 306, tail 308, and shoe 310 to help properly distribute the weight of the trigger 102 about pivot point at bore 314. The top of the main body 302 of the trigger 102 may further comprise a channel 316 defined by parallel walls 317 extending from the main body 302, the channel 316 configured to receive the disconnector 106, which may be secured to the trigger 102 by a disconnector pin 124 through a bore 312 in each of the walls 317. The channel 316 may further comprise a first cavity 320 and a second cavity 318 (see FIGS. 3A and 3B). The first cavity 320 (and certain embodiments the second cavity 318, such as for full-auto fire) has a spring 322 and plunger 324 received therein which biases the disconnector 106 away from the trigger 102. The spring 322 and plunger 324 may be a spring-loaded plunger. In some embodiments, the second cavity 318 may receive a second spring and plunger received therein for biasing a second disconnector away from the trigger 102, wherein the two disconnections are side by side within the channel 316.

In some embodiments, the housing 104 is connected to the trigger 102 by trigger pin 122 inserted through aperture 414, which aligns with bore 314 on the trigger 102. The housing 104 may be connected to a hammer 110 by insertion of a hammer pin 120 through aperture 410, which aligns with bore 610 on the hammer 110. The aperture 410 may not be circular, reducing wear on the aperture 410 and hammer pin 120 by allowing flexibility with respect to the positioning of the hammer pin 120 to the holes in the corresponding receiver of the firearm into which the trigger system 100 is installed. The hammer pin 120 thus may be in a fixed position relative to the housing 104, where the ultimate pin location within aperture 410 is determined based on the lower receiver, not the housing 104. Thus, the slot shape of aperture 410 may provide more flexibility with respect to the position of the hammer pin 120 by providing clearance between the hammer pin 120 and aperture 410. The aperture 410 may be oversized relative to the size of the hammer pin 120, oblong, oval or any other suitable shape. Thus, the aperture 410 is slot shaped to accommodate movement of the hammer pin 120 relative to the housing 104, such as in the direction toward or away from the trigger pin 122.

The housing 104 may further comprise a first slot 402, a recess 404 in the side wall of housing 104, and a second slot 406. The first slot 402 and recess 404 may abut each other on the face of the housing 104. The first slot 402 may extend through one or both sides of the housing 104. The recess 404 may be disposed below the first slot 402 and only extend partway into the wall of the housing 104. A protrusion 408 may extend into the recess 404 to provide a lip 409 to secure a pin spring 204 between the lip 409 and the recessed surface 405 of the recess 404. The protrusion 408 retains the pin spring 204 by arcing the pin spring 204 against the pins 120, 122 on each end within the recess 404 to keep the hammer pin 120 inserted into aperture 410, and trigger pin 122 inserted into aperture 414 in place. The lip 409 retains the pin spring 204 in place. The hammer pin 120 may have a recess 1201 and trigger pin 122 may have a recess 1221 into which the pin spring 204 rests to secure the respective pins 120, 122. The recesses 1201 and 1221 may be provided on both ends of the respective pins 120 and 122 so that the pins may be inserted in either direction. The second slot 406 may be disposed toward the top front side of the housing 104 and extend through one or both sides of the housing 104. The housing 104 may have an aperture 412 disposed toward the rear of the housing 104 configured to receive a pin 126 for securing the sear 108 to the housing 104 via bore 508 in the sear 108. The slots 402 and 406 and recess 404 may reduce the weight of the housing 104 to improve performance of the trigger 102.

Figure 17:
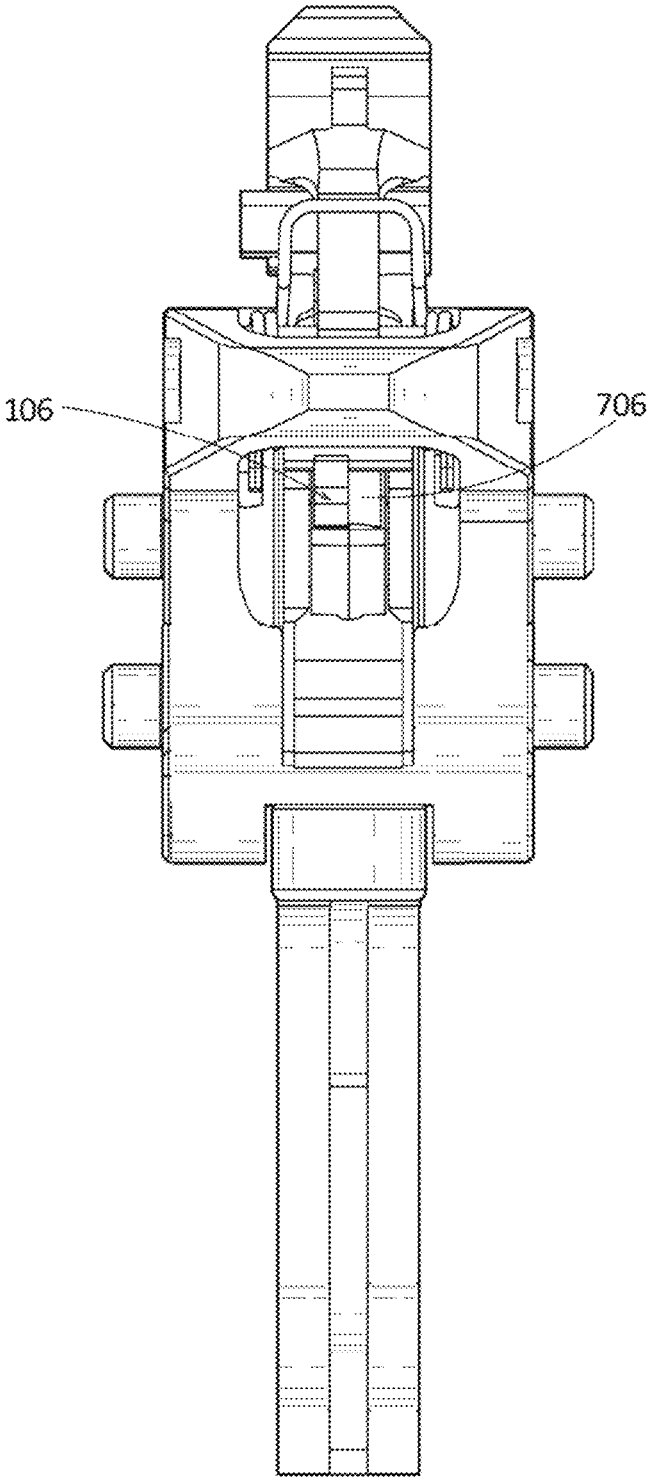
FIG. 17 is a rear view of the dynamically balanced trigger system of FIG. 1 according to one or more examples of the disclosure.

In some embodiments, the disconnector 106 may be connected to the trigger 102 by a disconnector pin 124 inserted through the bores 312 of trigger 102 and through a bore 702 disposed through the disconnector 106. The disconnector 106 may have a further bore 704 disposed there through of a desired shape, size and location to distribute the weight of the disconnector 106 relative to the trigger system 100. The disconnector 106 may be disposed within the channel 316 of the trigger 102, and offset to one side from the center of the channel 316 by spacer 706, as shown in FIG. 17. The disconnector 106 may be offset from the center of the channel 316 by a spacer 706 that is inserted on the disconnector pin 124 next to the disconnector 106 within the channel 316. The spacer 706 may be replaced by a second disconnector (not shown) in a fully automatic embodiment of the firearm trigger system 100. The disconnector 106 may rest on the top of the plunger 324 and spring 322 such that when the trigger 102 is actuated, the spring 322 received in cavity 320 of the trigger 102 is compressed as the disconnector 106 is actuated, that is, moves into engagement with the sear 108. The spring 322 and plunger 324 bias the disconnector 106 against the sear 108, creating an engagement of the disconnector 106 and sear 108 at the notch 720 of the disconnector 106 and ridge 509 of the sear 108. The disconnector 106 has two planes of motion, that is, it both rotates about the disconnector pin 124 and moves forward to back due to the motion of the trigger 102 moving pin 124 within bore 312 of trigger 102 (see, e.g., FIGS. 19 and 20). The disconnector 106 may further have a protrusion 710 and arm 708, where the notch 720 is disposed approximate the distal end of the arm 708. The protrusion 710 of the disconnector 106 may be impacted by the hammer 110 when the firearm is cycling after firing, as the result of the bolt or bolt carrier group moving, and thereby to disconnect the disconnector 106 from the sear 108.

Figure 6B:
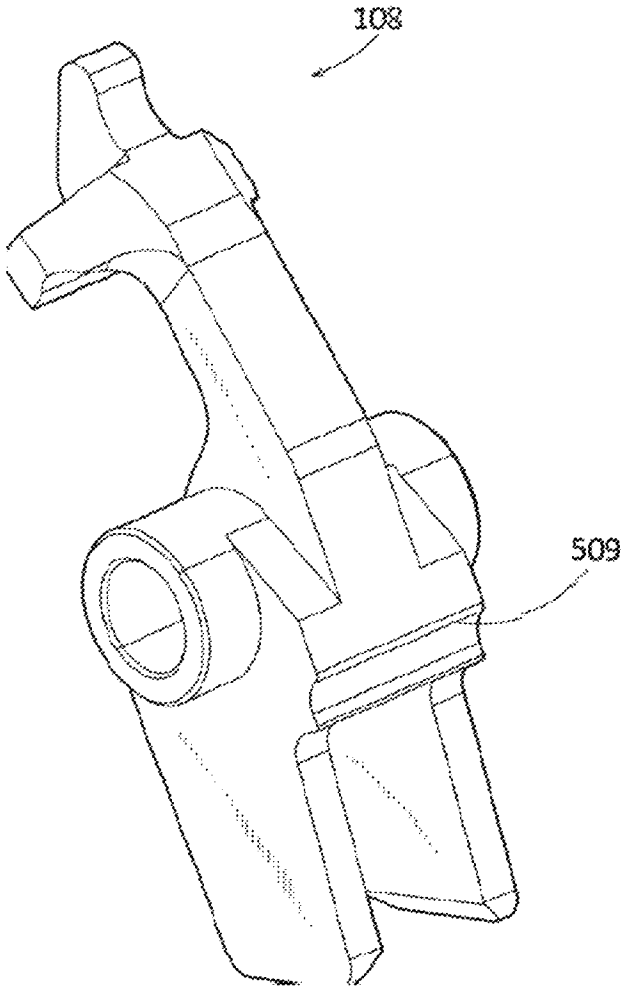
FIGS. 6A-6B are views of a sear according to one or more examples of the disclosure.
Figure 6A:
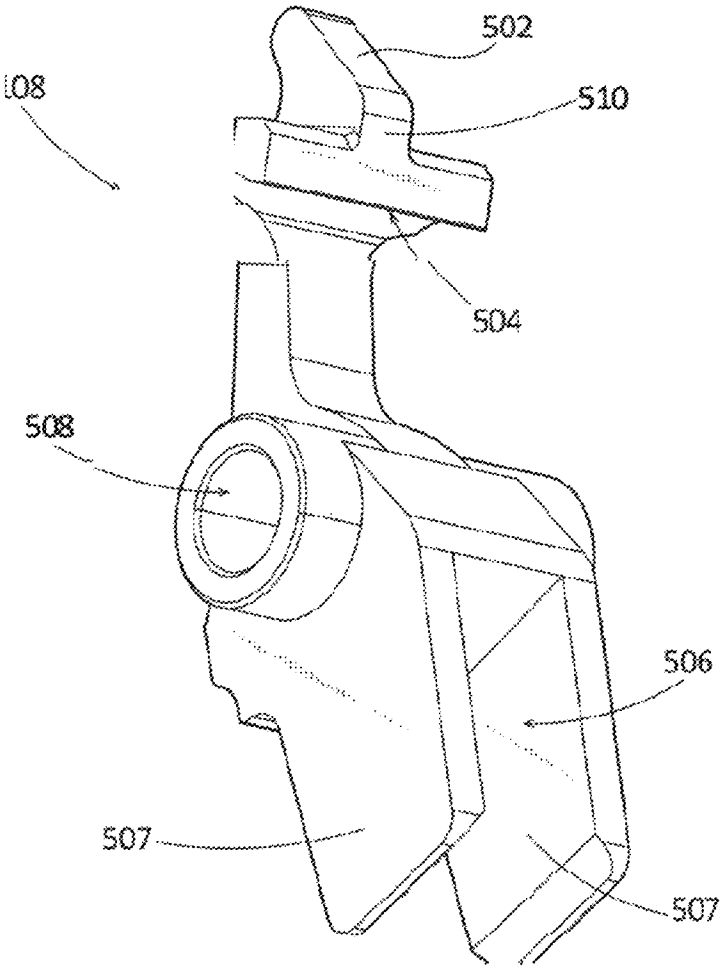
Figure 7:
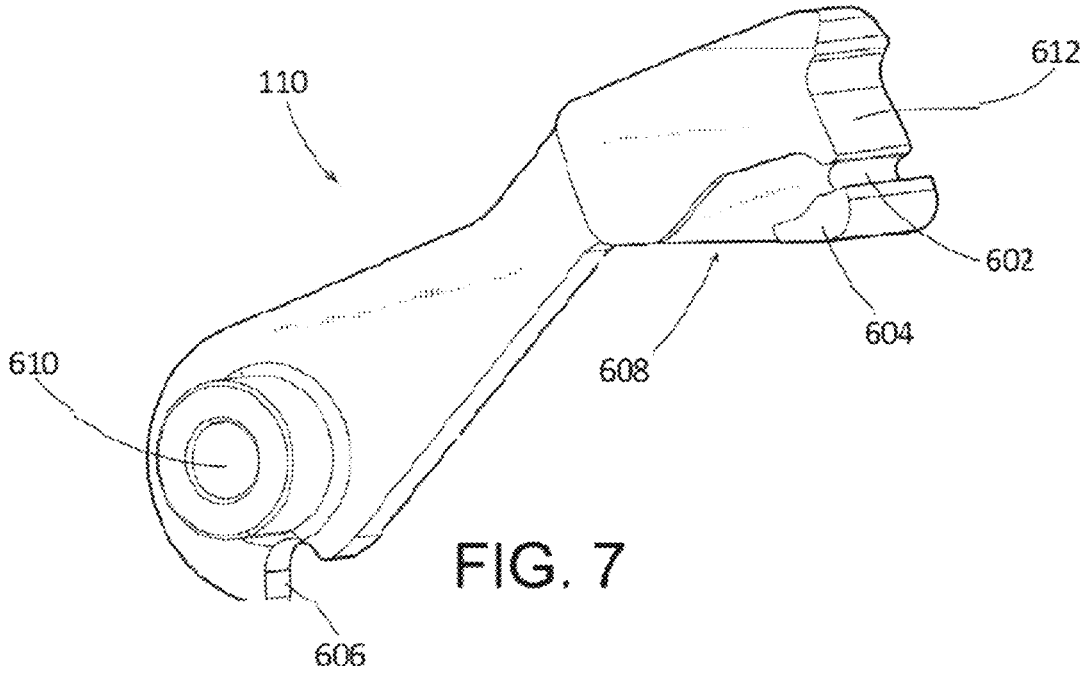
FIGS. 7-8 are views of a hammer according to one or more examples of the disclosure.
Figure 8:
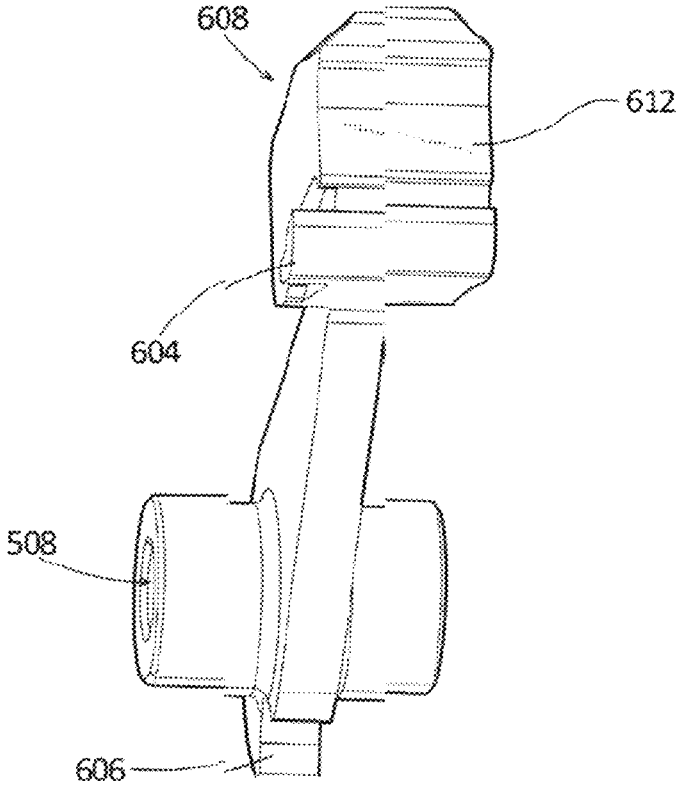
Figure 9:
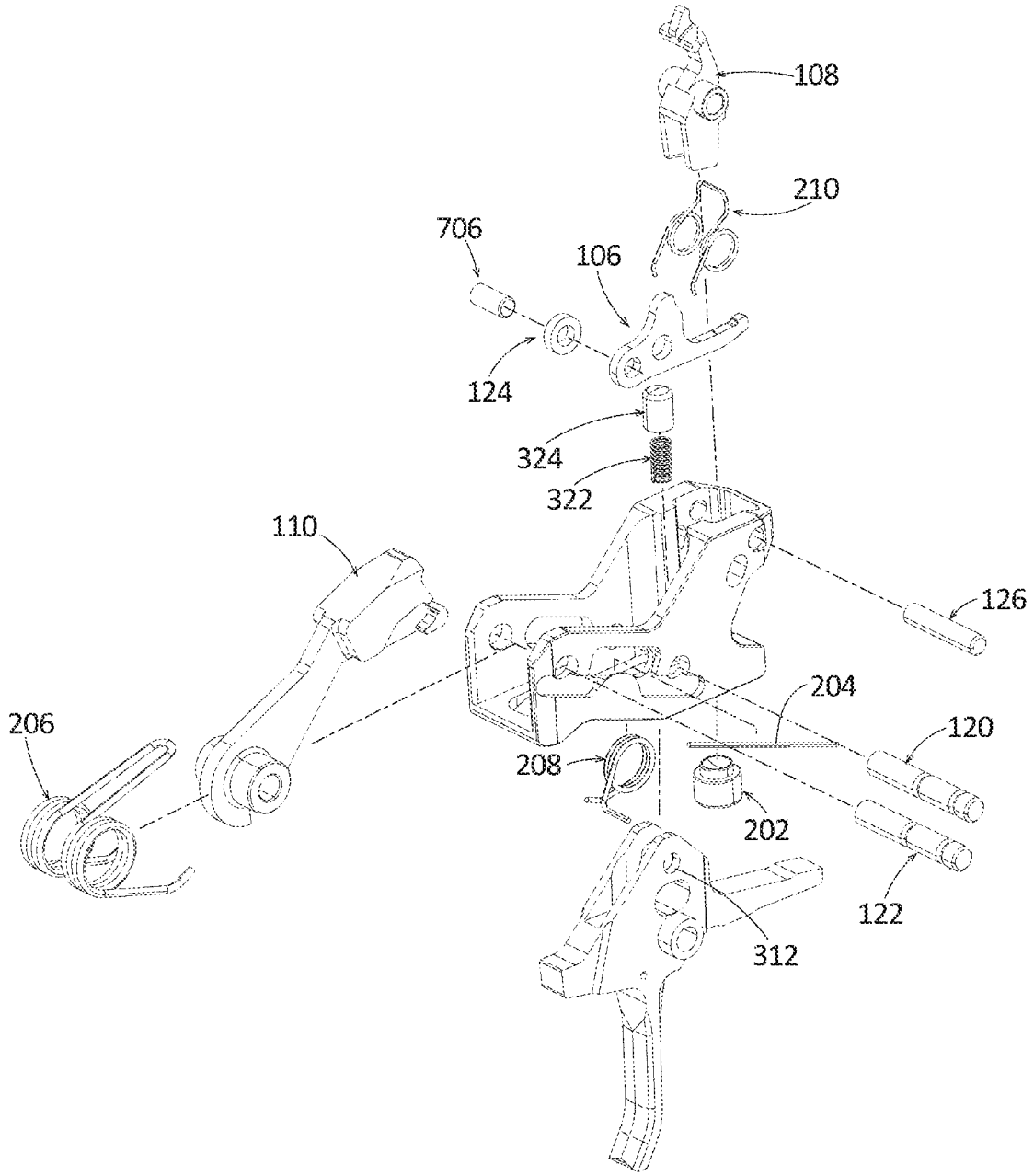
FIG. 9 is an exploded view of the dynamically balanced trigger system of FIG. 1 according to one or more examples of the disclosure.
Figure 11:
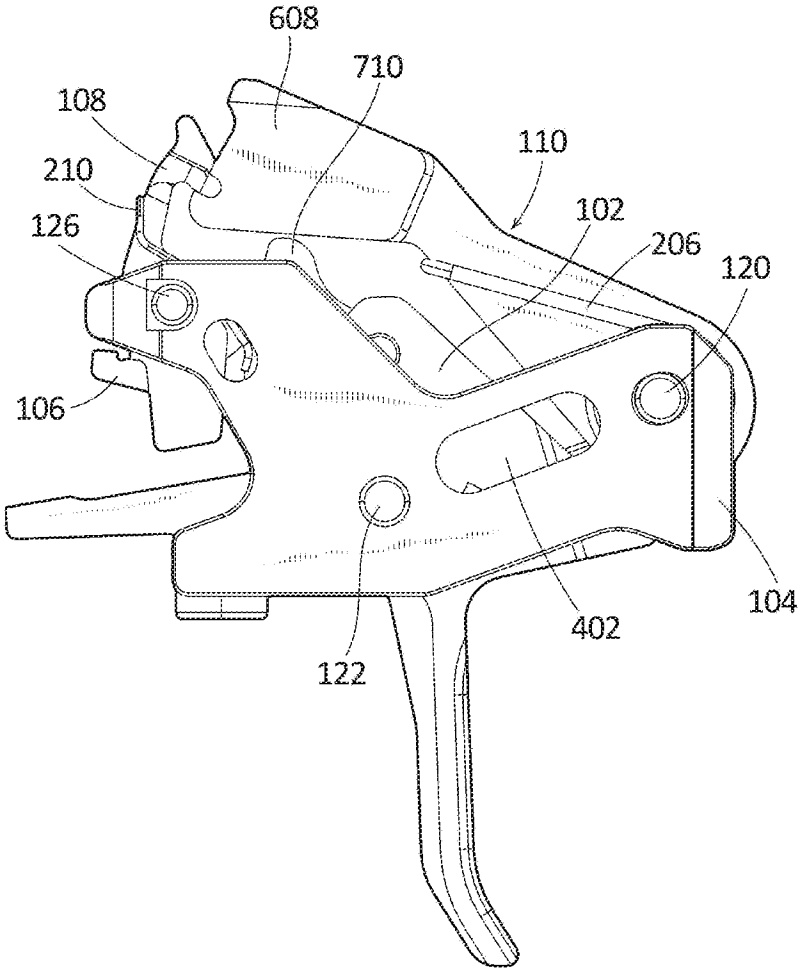
FIGS. 10-11 are side views of the dynamically balanced trigger system of FIG. 1 according to one or more examples of the disclosure.
Figure 10:
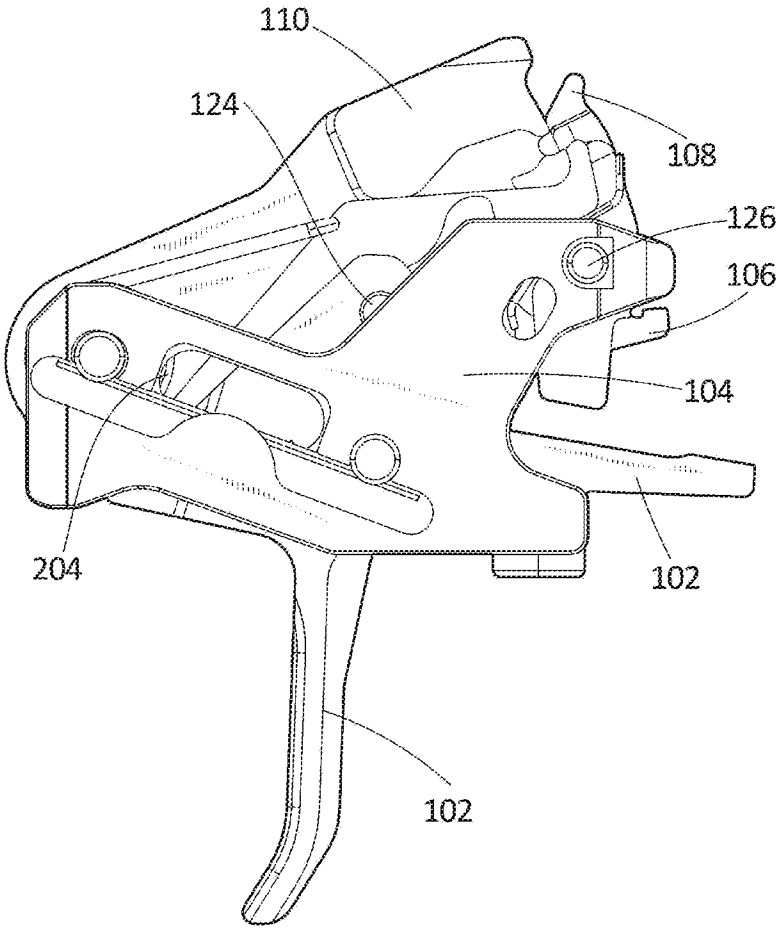

In some embodiments, the sear 108 is connected to the housing at aperture 412 by a sear pin 126 inserted through a bore 508 therein. The sear 108 may have a guide 502 that adjusts or guides the hammer 110 back into position when being cocked after firing. The sear 108 further comprises an engagement ridge 504 that is configured to engage a ledge 604 on the hammer 110. The sear 108 may further comprise a channel 506 between two legs 507. The legs 507 may be of any size, shape, or orientation, such as to balance the sear 108 in combination with the guide 502 and engagement ridge 504. The sear 108 further comprises a sear face 510 which includes the engagement ridge 504 and a portion of the sear 108 extending toward guide 502, parallel to the hammer face 612. The sear face 510 is configured such that a portion of the sear face 510 is parallel with the hammer face 612 when the sear 108 is engaging the hammer 110. Sear face 510 may slide against hammer face 612 when the hammer 110 experiences downward rotation whether by return of the hammer 110 after firing, or due to drops, shocks, or bumps. The parallel faces allow for the sear 108 to slide relative to the hammer 110 instead of becoming disconnected when the hammer 110 experiences downward rotation. The sear face 510 may include the engagement ridge 504 extending laterally from either side of the guide 502 to provide a wide contact surface for engaging the hammer 110. The sear 108 may be of any size or shape to ensure the weight of the sear 108 is properly centered about the sear pin bore 508. The sear 108 may further comprise a ridge 509 (see FIG. 6B) that is configured to engage the notch 720 of the disconnector 106 when the trigger 102 is in the cocked position (see FIG. 20), causing the sear 108 to rotate about sear pin 126 through bore 508 of the sear 108 and aperture 412 of the housing 104. The sear 108, when caused to rotate in response to movement of the disconnector 106, as the notch 720 engages the ridge 509 of the sear 108, may cause the engagement ridge 504 of the sear 108 to disengage from the ledge 604 of the hammer 110, releasing the hammer 110.

In some embodiments, the hammer 110 is connected to the housing 104 by a hammer pin 120 inserted through bore 610 of the hammer 110 into aperture 410 of the housing 104. The hammer 110 may have a notch 606 configured to prevent firing motion of the hammer 110 when the trigger 102 is not actuated. The notch 606 would impact against the trigger nose 306 if there were any rotation of the hammer 110 about hammer pin 120 without actuating the trigger 102. The ledge 604 may have a platform 602 that mates with the engagement ridge 504 of the sear 108 when the trigger system 100 is cocked. The sear 108 may engage the hammer 110 from above. The hammer 110 is engaged from its top side by the sear 108, that is, at the end opposite the rotation about bore 610 of the hammer 110.

In some embodiments, a slave pin 121 may be disposed in place of the hammer pin 120 prior to installation in a firearm to maintain the trigger system 100 assembly. In addition, a slave pin 123 may be disposed in place of the trigger pin 122 prior to installation in a firearm to maintain the trigger system 100 assembly. The slave pins 121, 123 may be ejected as the pins 120 and 122 are inserted during the installation of the dynamic trigger system 100 within a firearm receiver. The hammer pin 120 and trigger pin 122 are configured to be held in place by pin spring 204 engaging recesses 1201 and 1221, respectively, in each of pins 120 and 122.

Thus, the pin spring 204 is held in place by the lip 409 and recess surface 405, and is biased against the hammer pin 120 and trigger pin 122 by protrusion 408. Thus, the pins 120 and 122 are held in place independent of any functional springs 206, 208 or 210, but by a pin spring 204 integrated into the housing 104.

In some embodiments, the dynamic trigger system 100 further comprises a bumper 202 attached to a hole 220 in the housing 104. The bumper 202 may comprise a rubber or pliable material, and when the trigger system 100 is installed in a receiver of a firearm, is compressed between the housing 104 and floor of the firearm receiver, thereby eliminating movement of the housing 104, and may prevent over rotation of the trigger 102 by a portion of the bumper 202 extending through the hole 220 contacting tail 308 of the trigger 102. In other words, the bumper 202 preloads the housing 104 to the bottom of the receiver and prevents movement of the housing 104 as the trigger system 100 is operating.

In some embodiments, a spring 206 may bias the hammer 110 away from the housing 104 and trigger 102. The spring 206 may be disposed around the hammer pin 120. The spring 206 may be configured to bias the hammer 110 to rotate in a direction away from the sear 108 and the disconnector 106. The spring 206 may force the hammer 110 into the striking position when the sear 108 is disengaged from the hammer 110.

In some embodiments, a spring 208 may offer resistance to the actuation of the trigger 102 relative to the housing 104. The spring 208 may be disposed around the trigger pin 122. The spring 208 may be configured to resist the actuation motion, that is, the pulling on or squeezing of the trigger shoe 310 of the trigger 102.

In some embodiments, a spring 210 may connect the sear 108 and the housing 104 and bias the sear face 510 of the sear 108 toward the hammer 110. The spring 210 may be disposed around pin 126.

Figure 12:
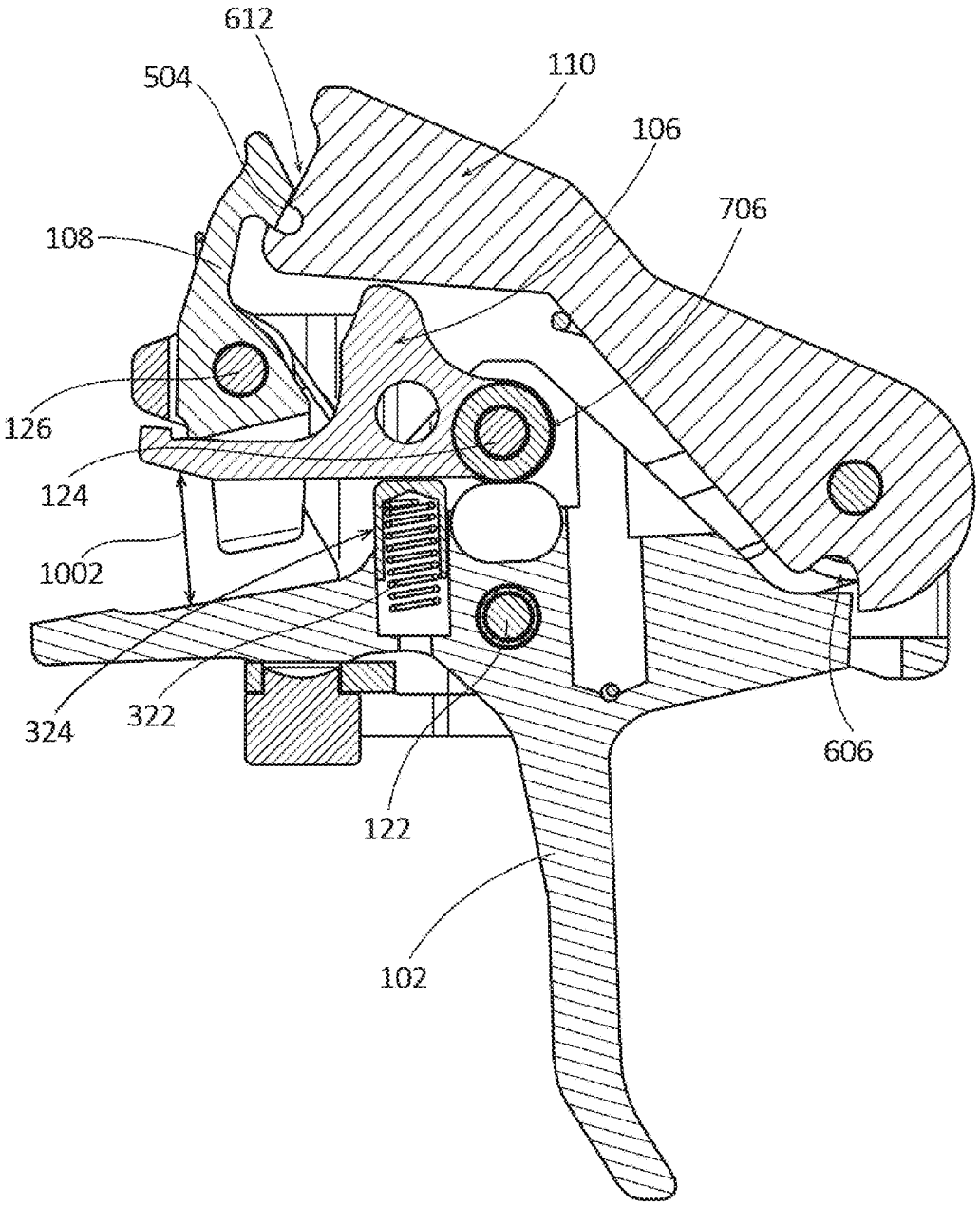
FIG. 12 is a cutaway side view of the dynamically balanced trigger system of FIG. 1 according to one or more examples of the disclosure.
Figure 13:
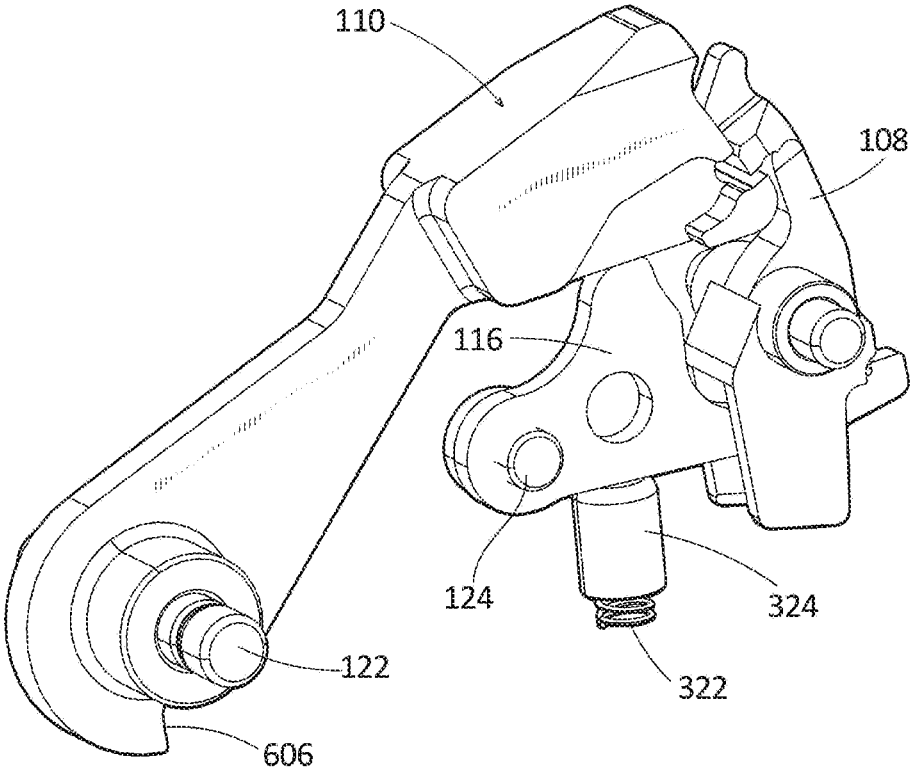
FIG. 13 is a perspective view of various interior components, within the housing, of the dynamically balanced trigger system of FIG. 1 according to one or more examples of the disclosure.
Figure 14:
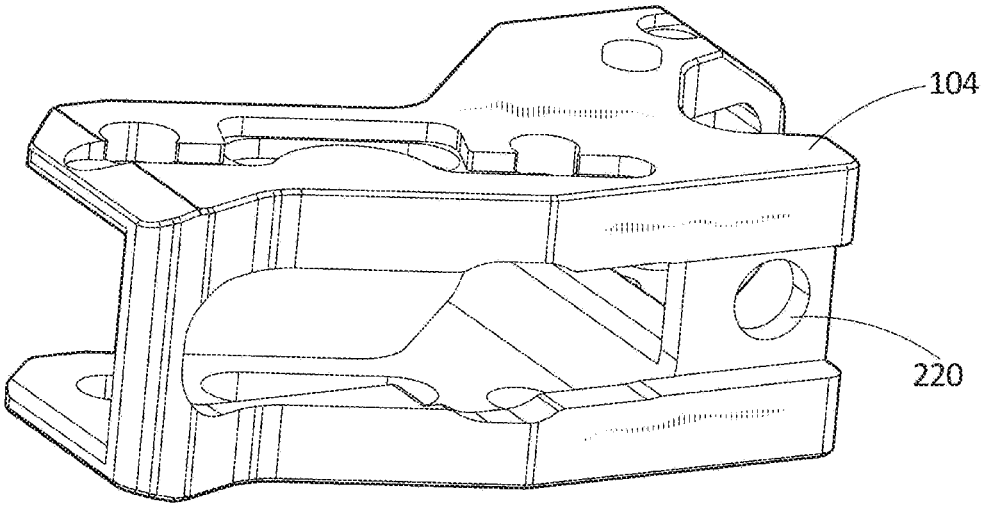
Figure 15:
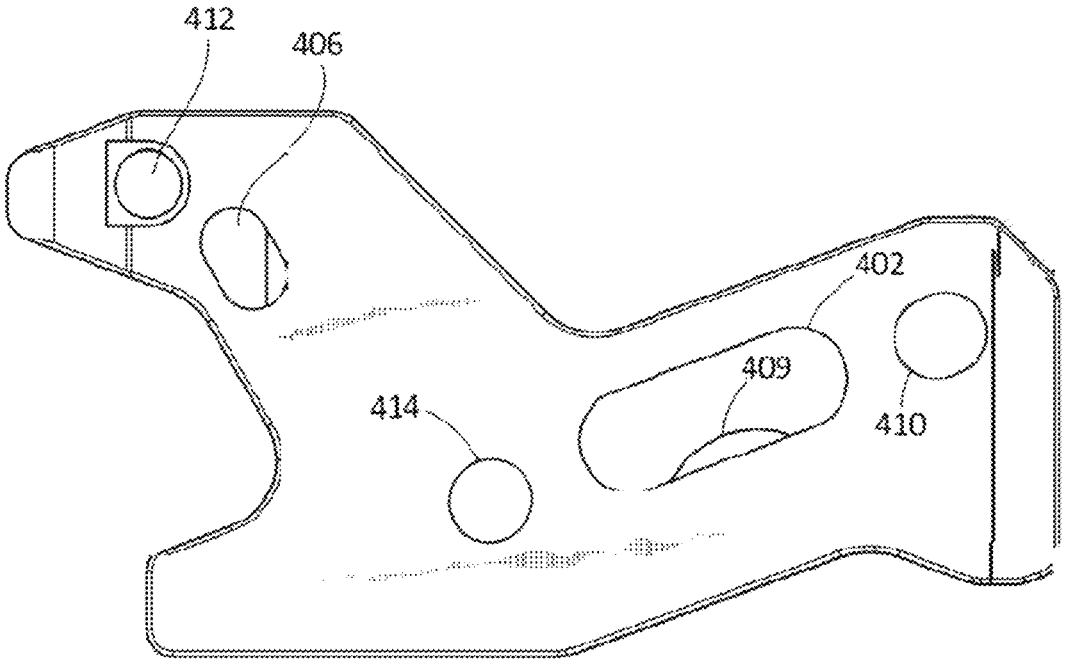

The trigger 102 and disconnector 106 have gap 1002 in between the disconnector arm 708 and trigger tail 308 (see FIG. 12). The gap 1002 is configured to provide distance between the trigger 102 and disconnector 106 to prevent trigger slap when the hammer 110 returns to its cocked position.

Figure 16:
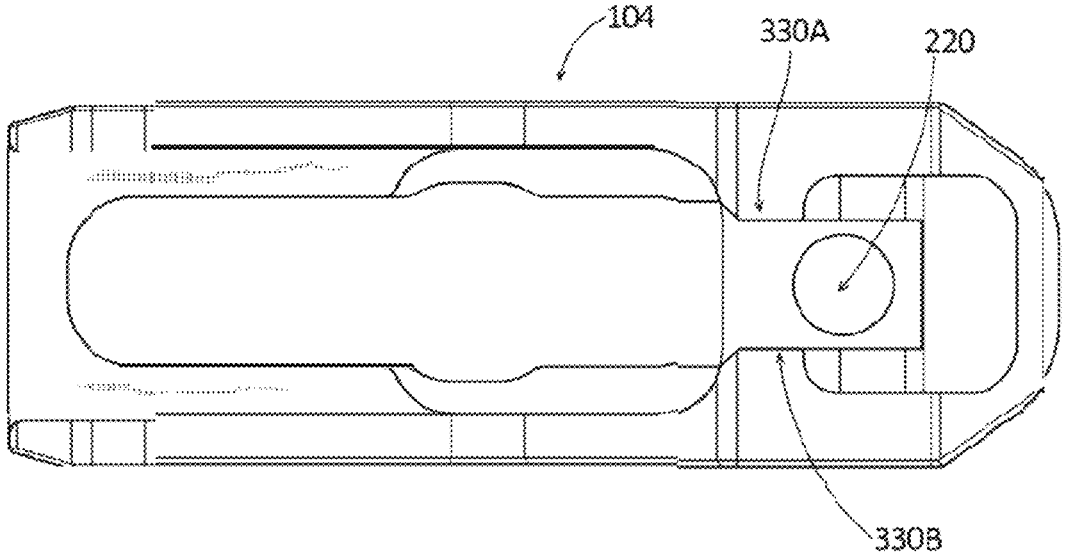

With reference to FIG. 16, the housing 104 has a first wing 330A and a second wing 330B which extend partially across the housing 104. Thus, when the hammer 110 rotates from a firing position to a cocked position, the head 608 of the hammer 110 may impact one or both of the wings 330A, 330B to limit rotation of the hammer 110, thereby limiting the impact force of the hammer 110 on the disconnector 106, and in particular, the protrusion 710 of the disconnector 106, further preventing trigger slap, as the hammer 110 disengages the disconnector 106 from the sear 108.

Figure 19:
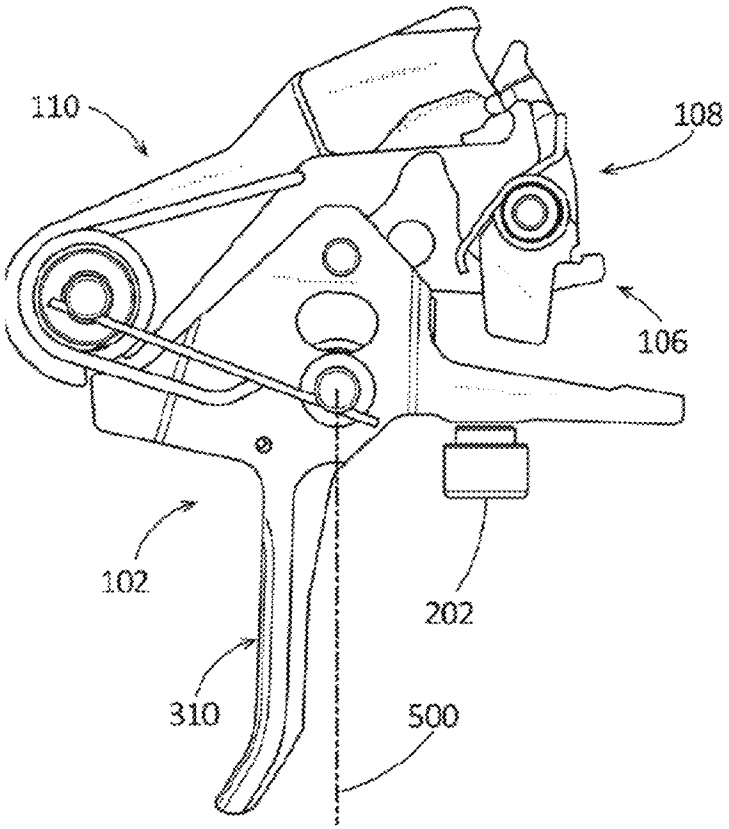
FIGS. 18-22 are side views of the dynamically balanced trigger system of FIG. 1, without the housing, in states of actuation according to one or more examples of the disclosure.
Figure 18:
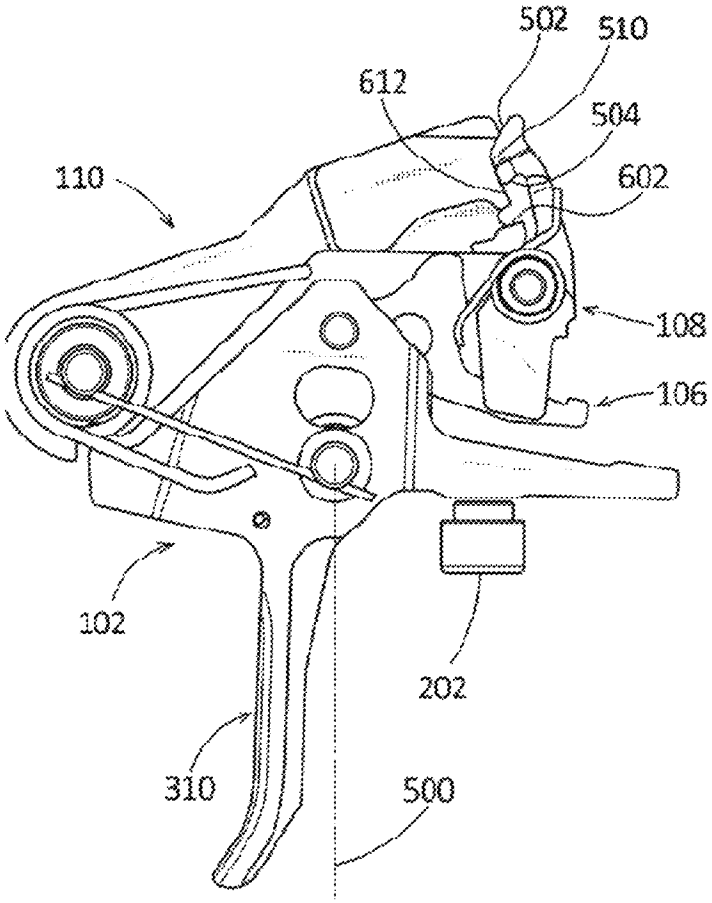
Figure 21:
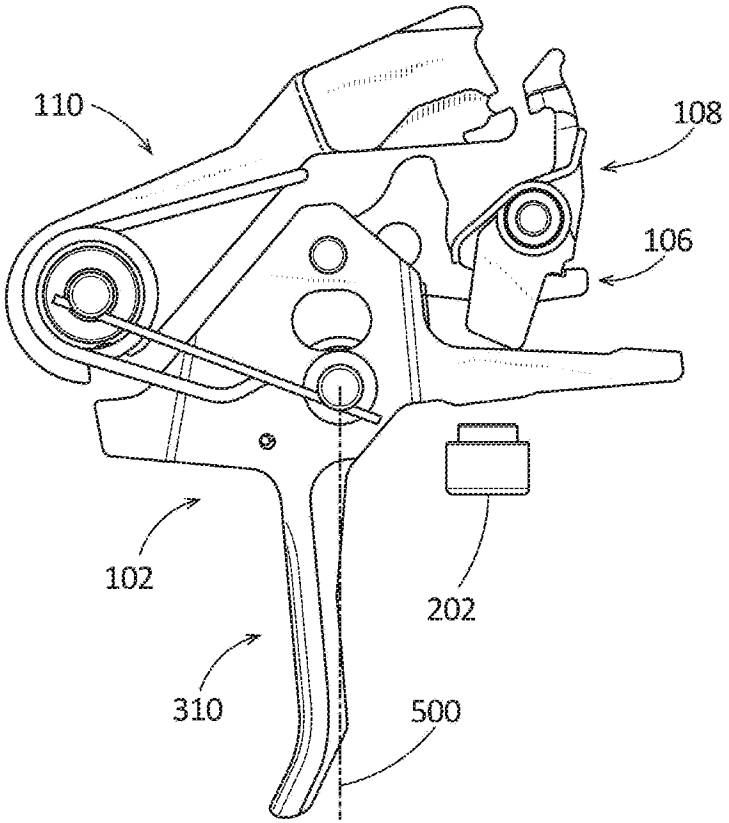
Figure 20:
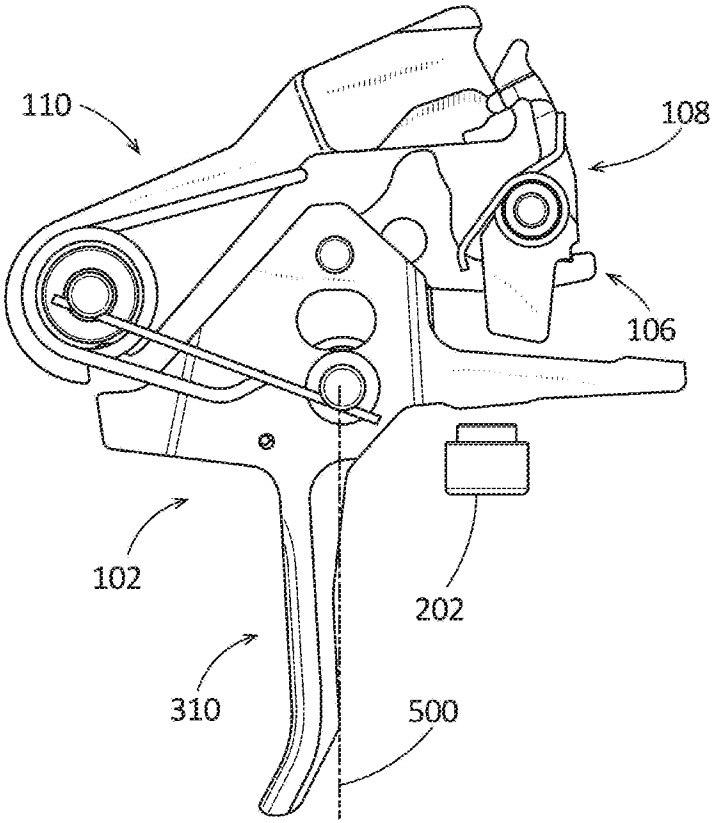
Figure 22:
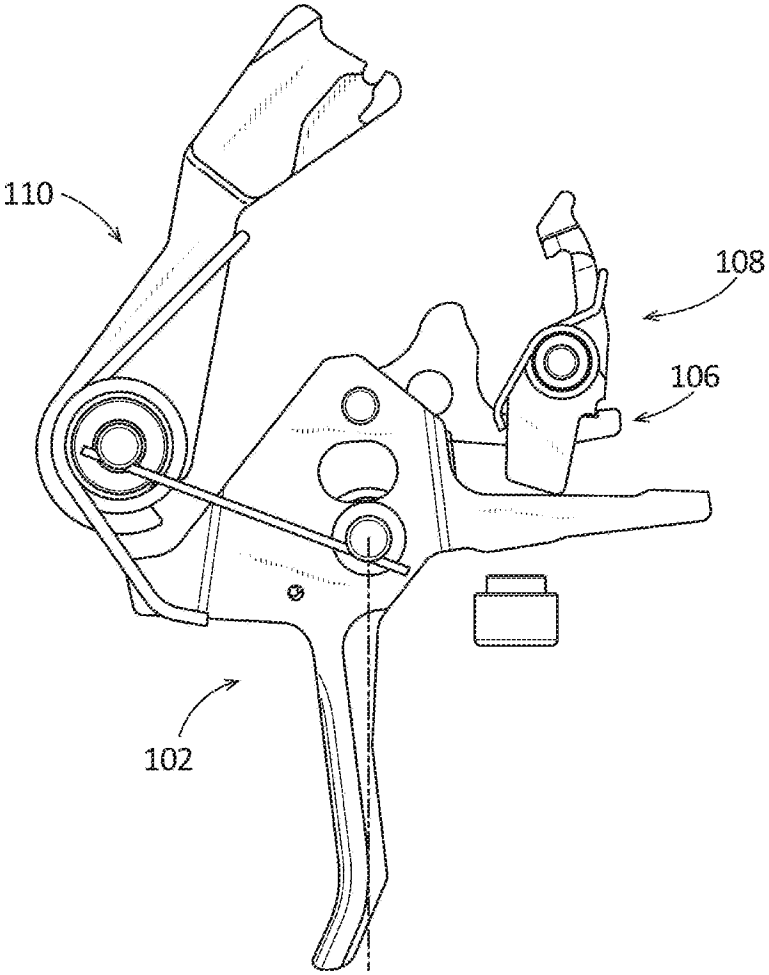
Figure 23A:
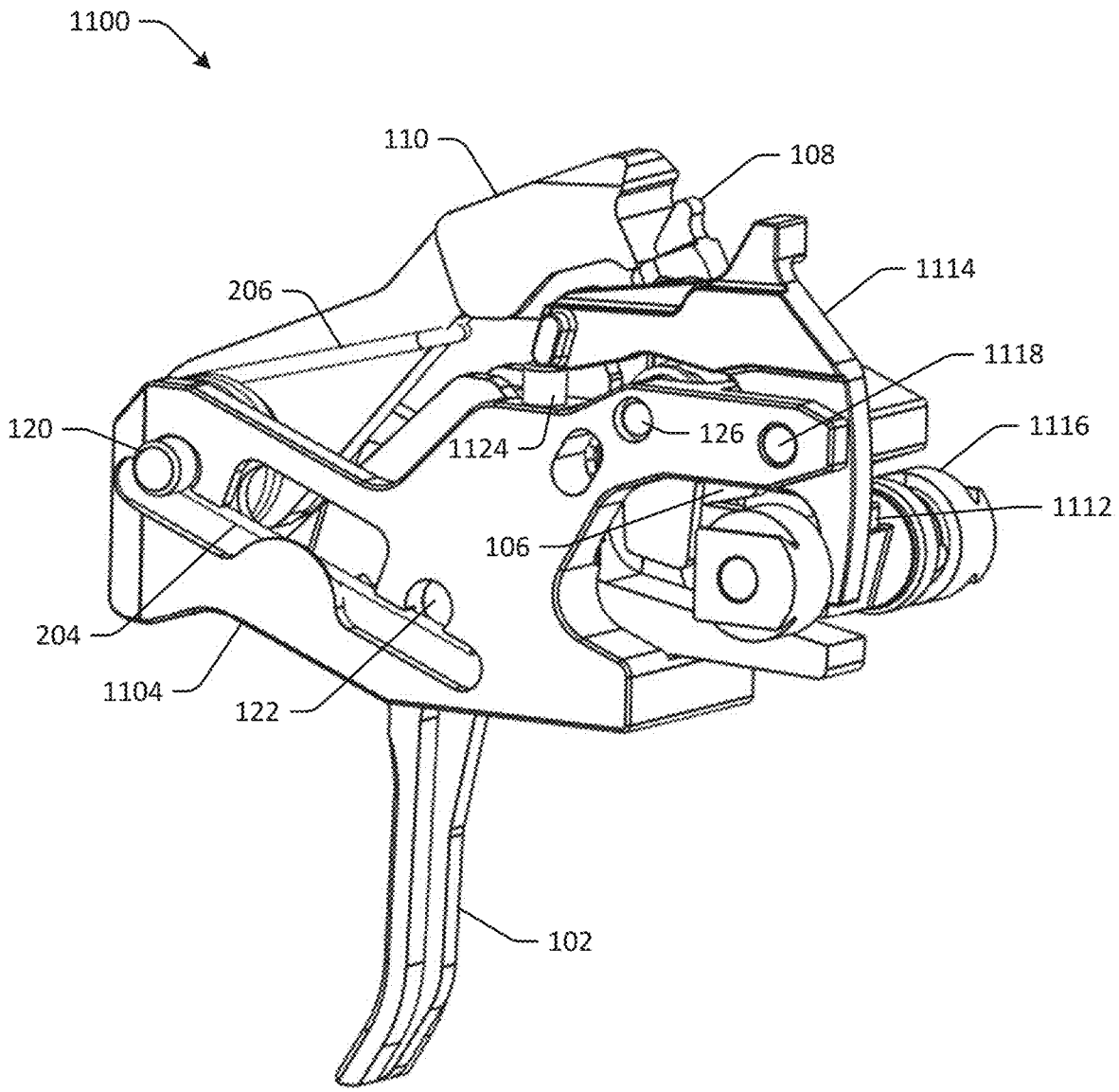
FIG. 23A is a perspective view of a dynamically balanced trigger system according to one or more examples of the disclosure.
Figure 23B:
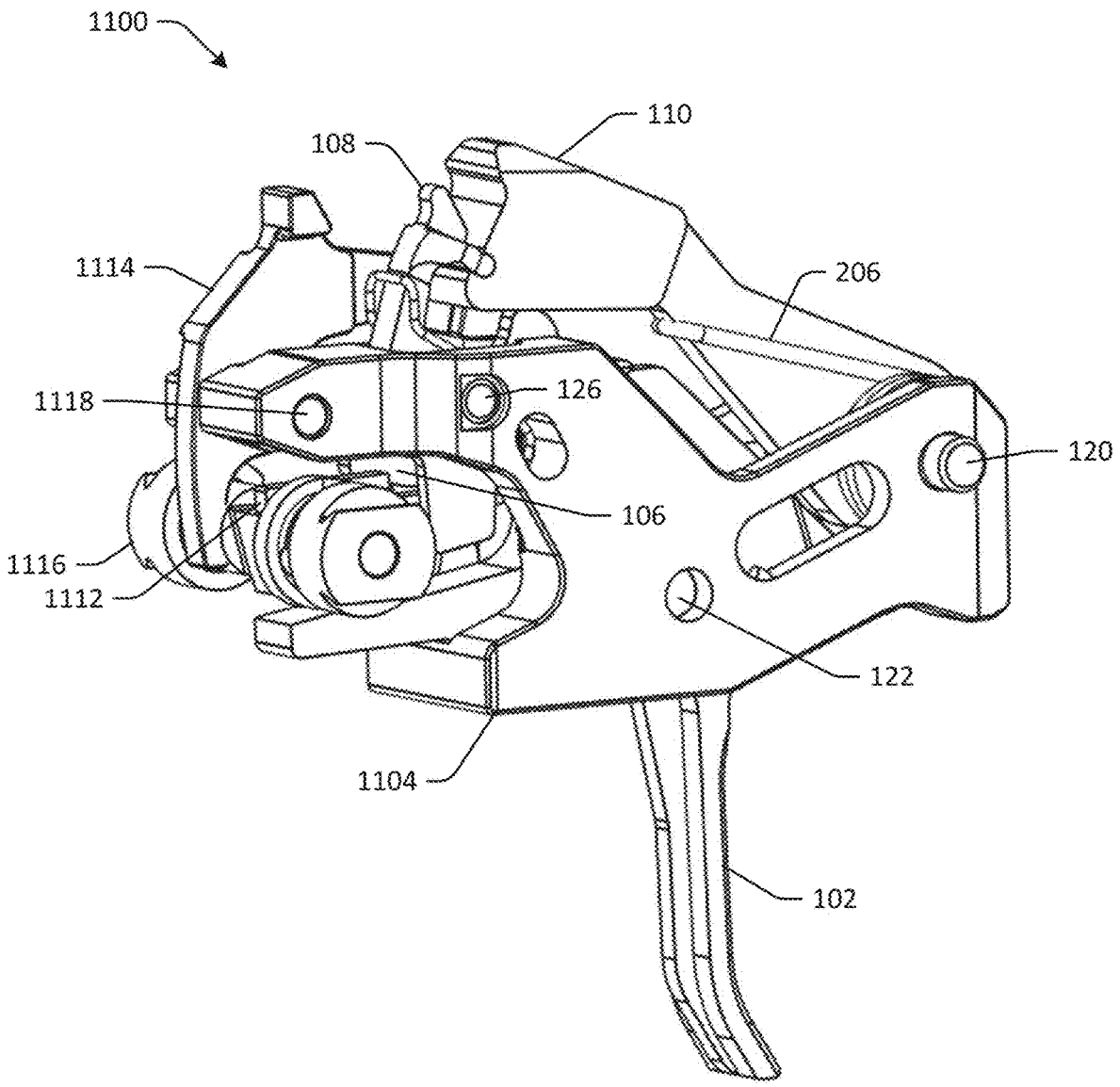
FIG. 23B is another perspective view of the dynamically balanced trigger system of FIG. 23A according to one or more examples of the disclosure.
Figure 23C:
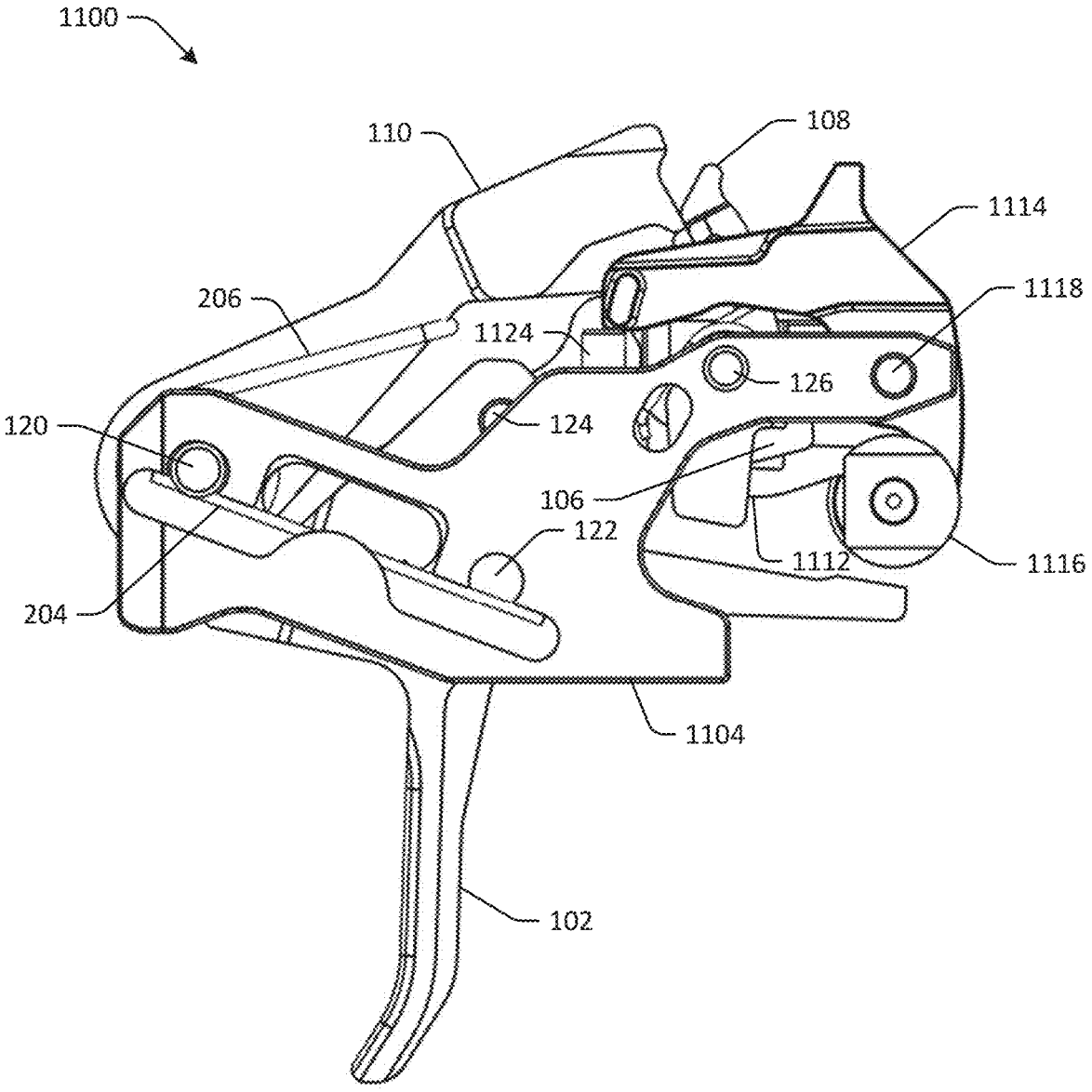
FIG. 23C is a side view of the dynamically balanced trigger system of FIG. 23A according to one or more examples of the disclosure.
Figure 23D:
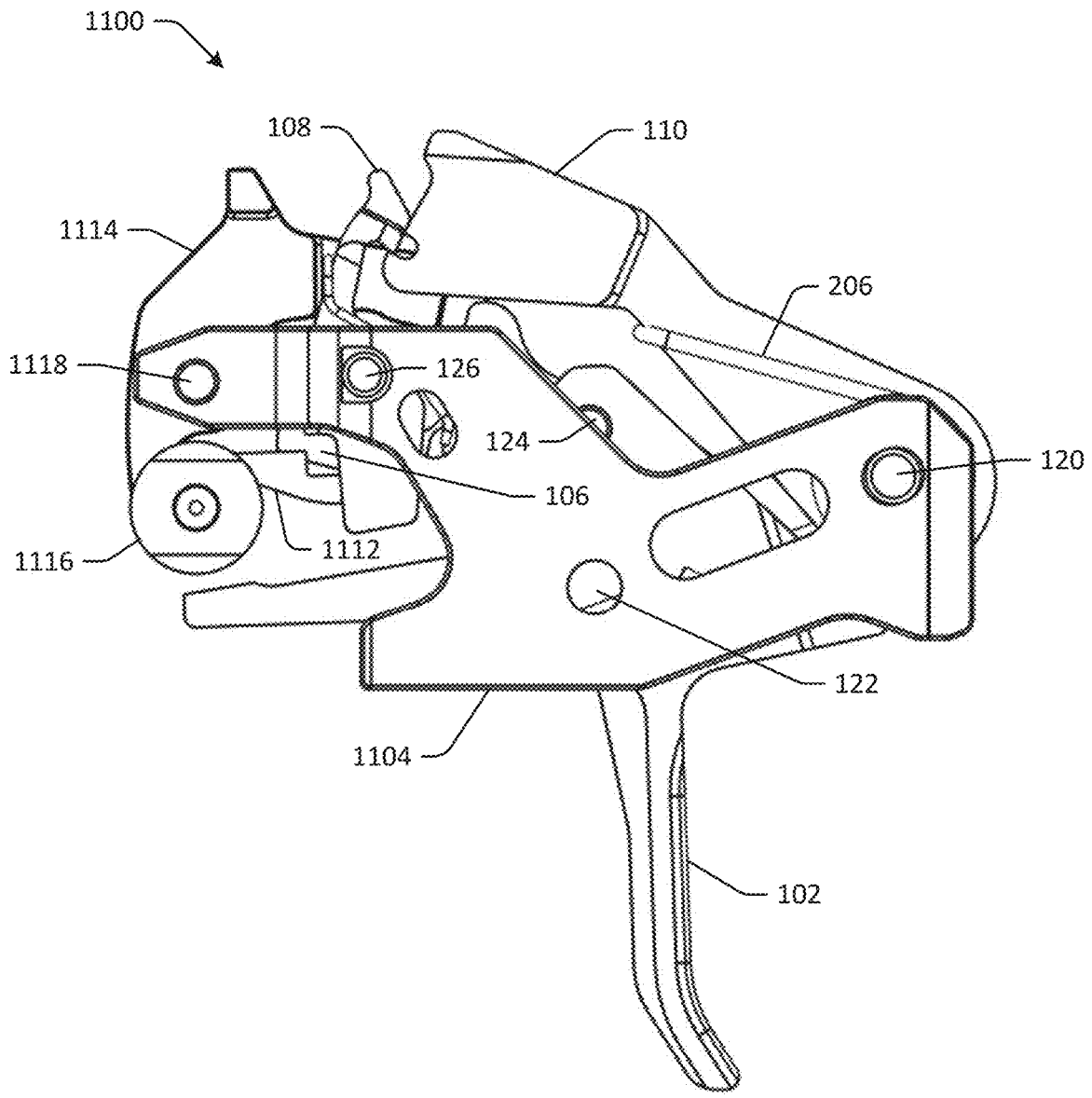
FIG. 23D is another side view of the dynamically balanced trigger system of FIG. 23A according to one or more examples of the disclosure.
Figure 23E:
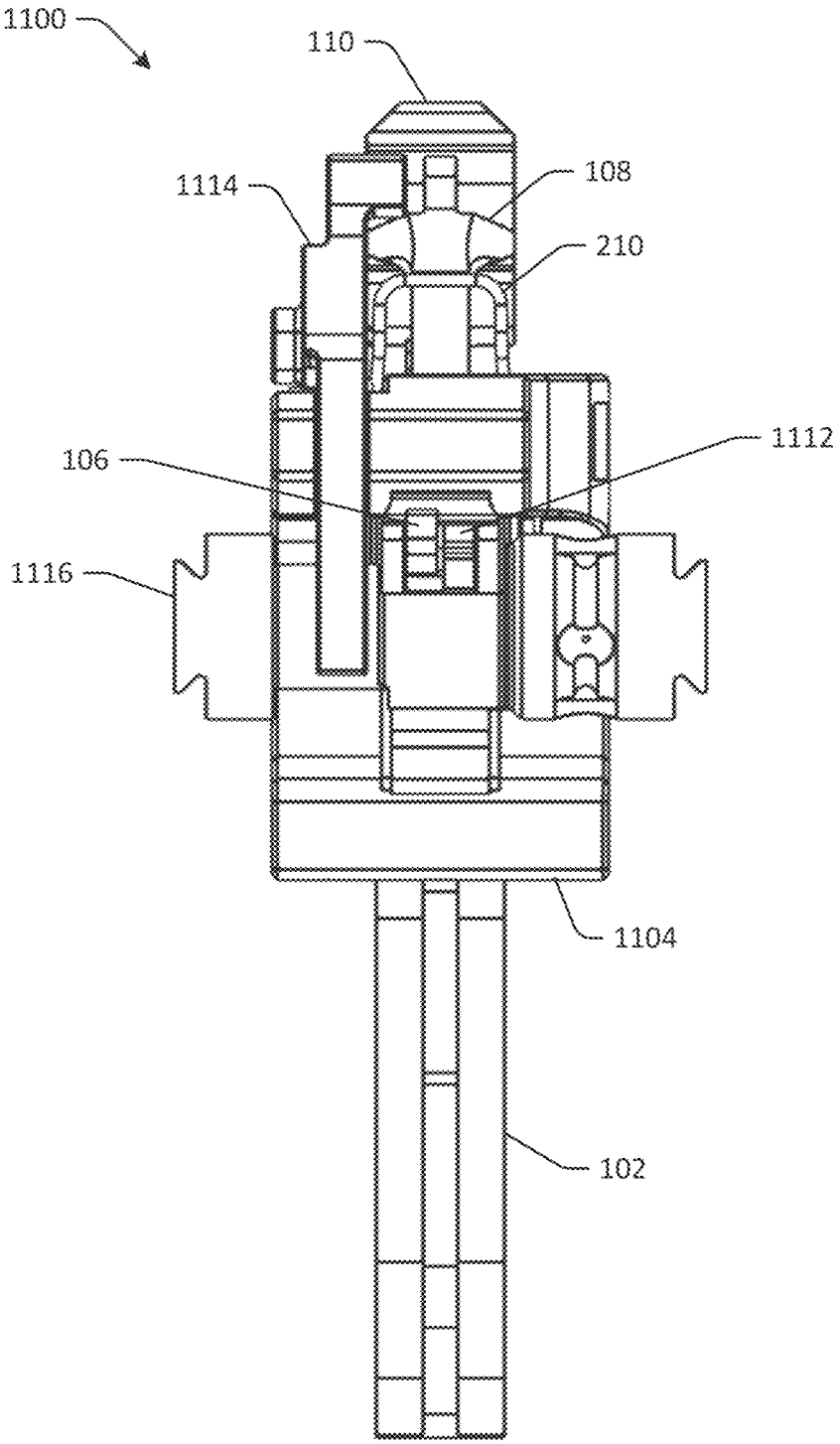
FIG. 23E is a rear view of the dynamically balanced trigger system of FIG. 23A according to one or more examples of the disclosure.
Figure 23F:
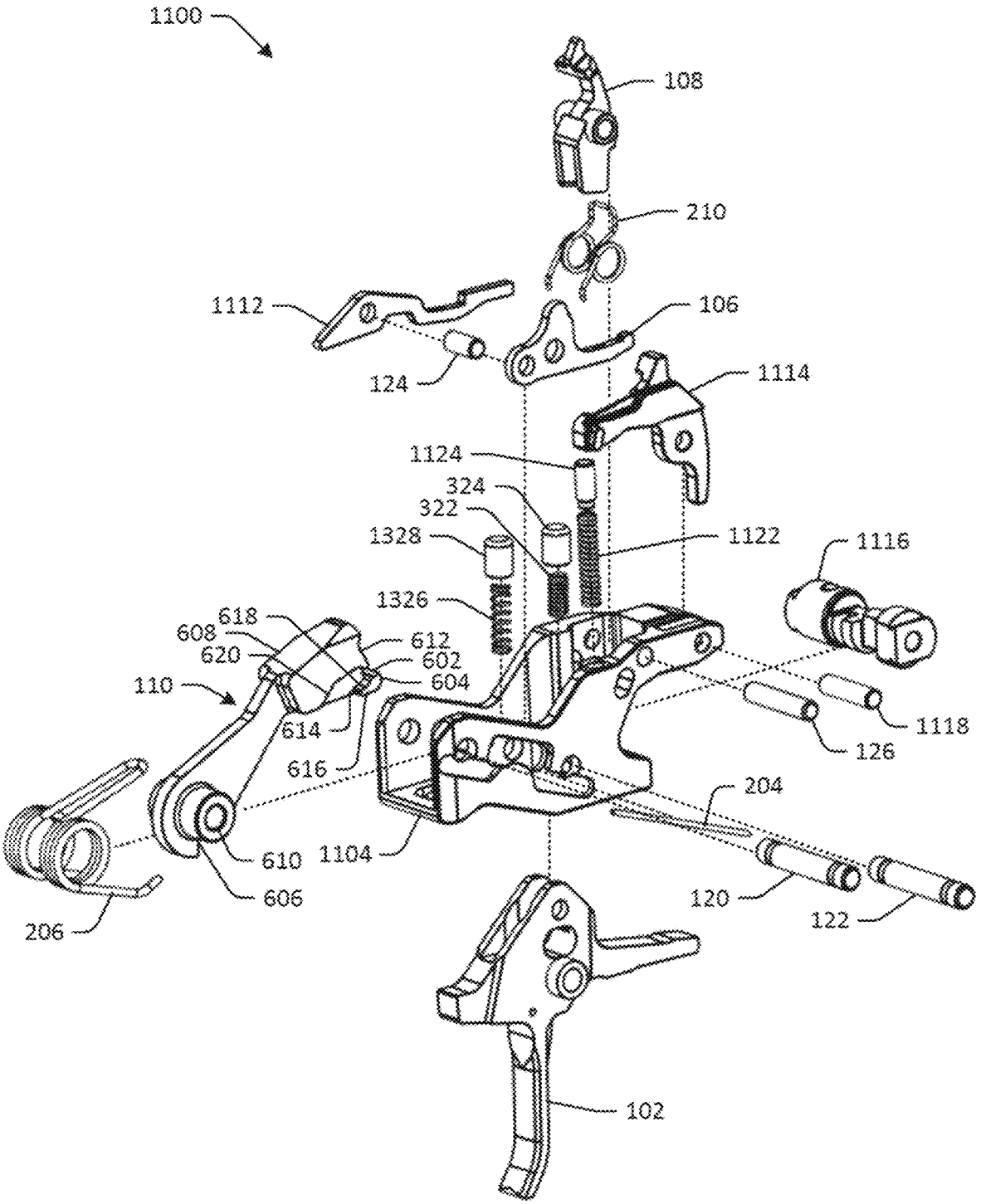
FIG. 23F is an exploded view of the dynamically balanced trigger system of FIG. 23A according to one or more examples of the disclosure.
Figure 24A:
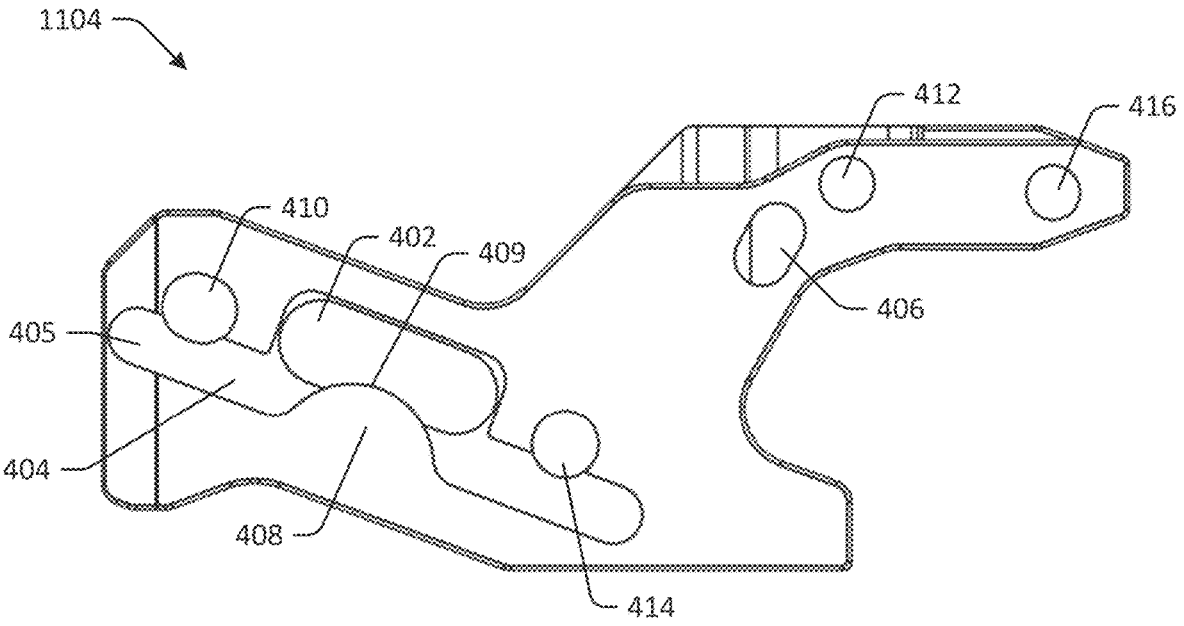
FIG. 24A is a side view of a housing according to one or more examples of the disclosure.
Figure 24B:
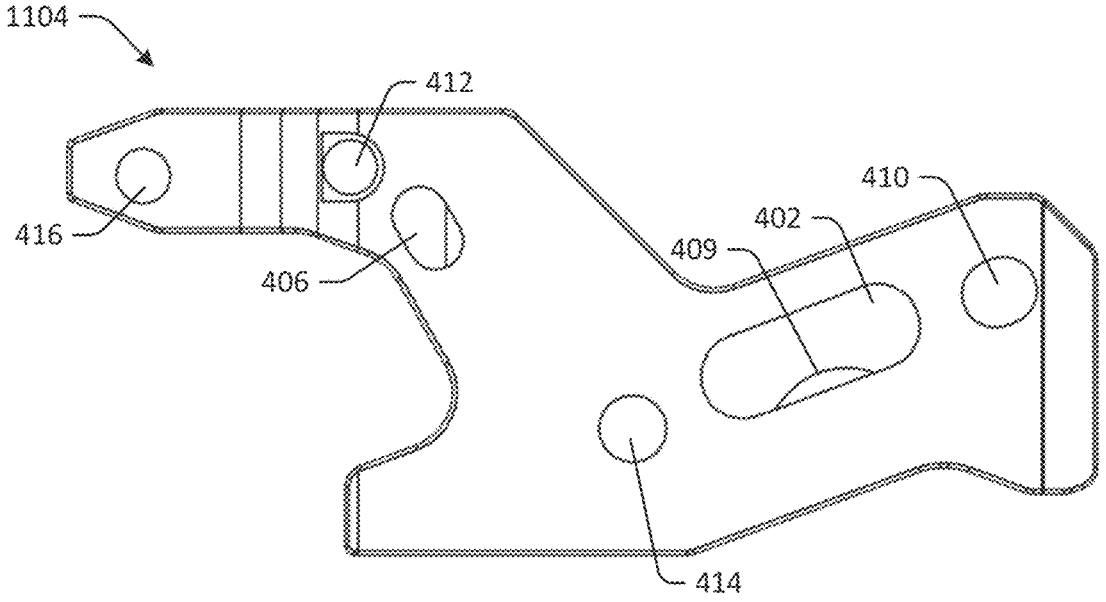
FIG. 24B is another side view of the housing according to one or more examples of the disclosure.
Figure 24C:
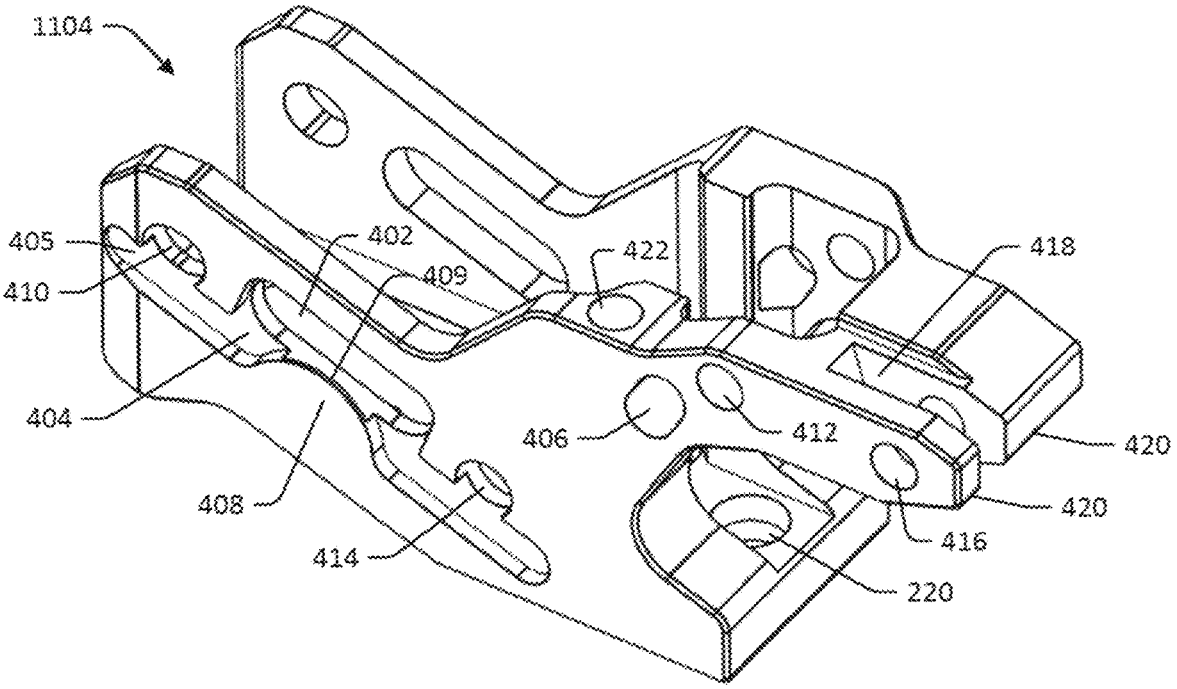
FIG. 24C is a perspective view of the housing according to one or more examples of the disclosure.
Figure 24D:
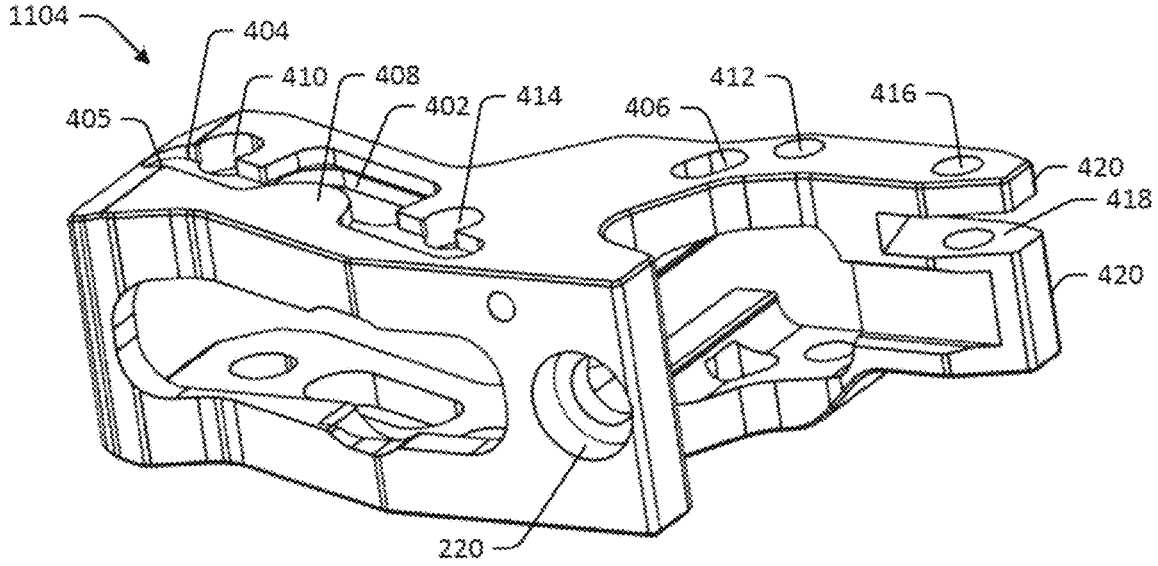
FIG. 24D is another perspective view of the housing according to one or more examples of the disclosure.
Figure 24E:
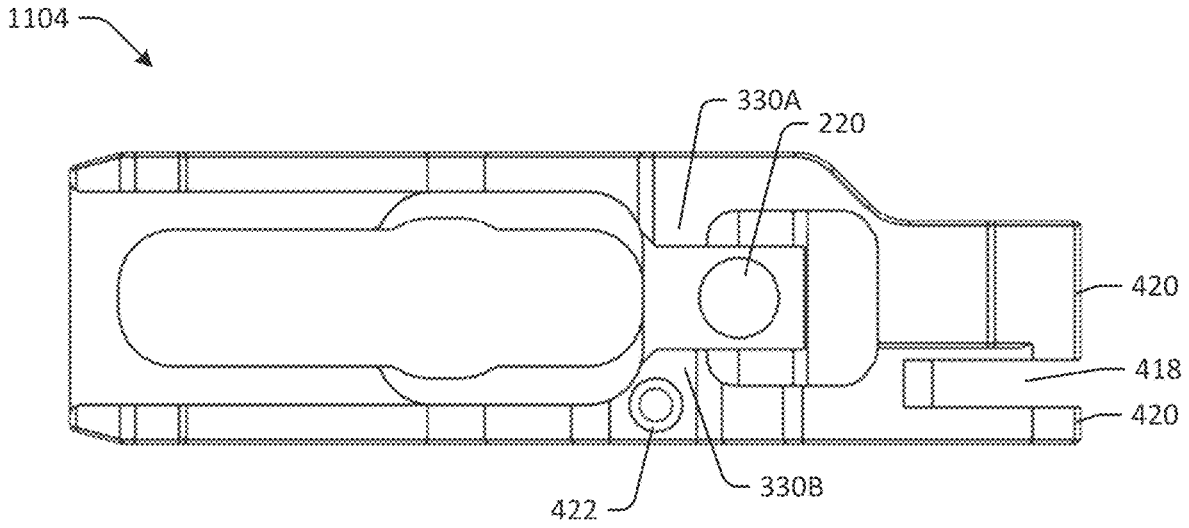
FIG. 24E is a top view of the housing according to one or more examples of the disclosure.
Figure 25:
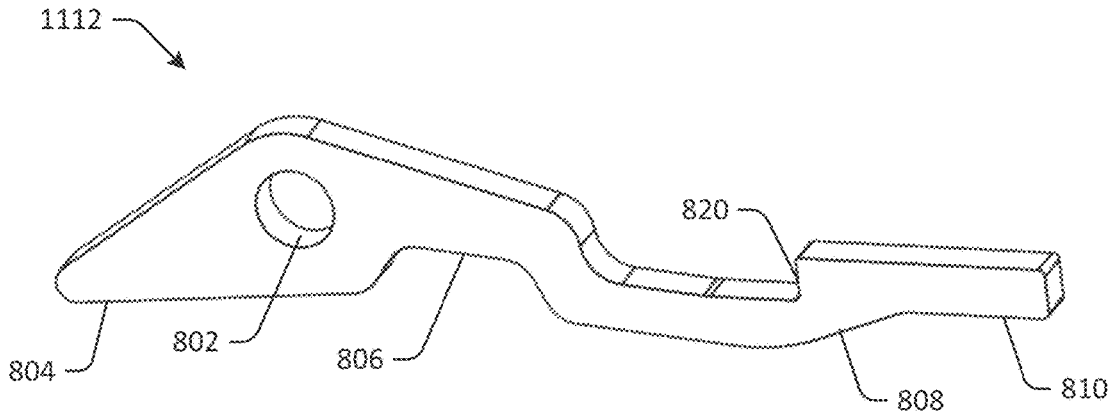
FIG. 25 is a perspective view of a connector according to one or more examples of the disclosure.
Figure 26A:
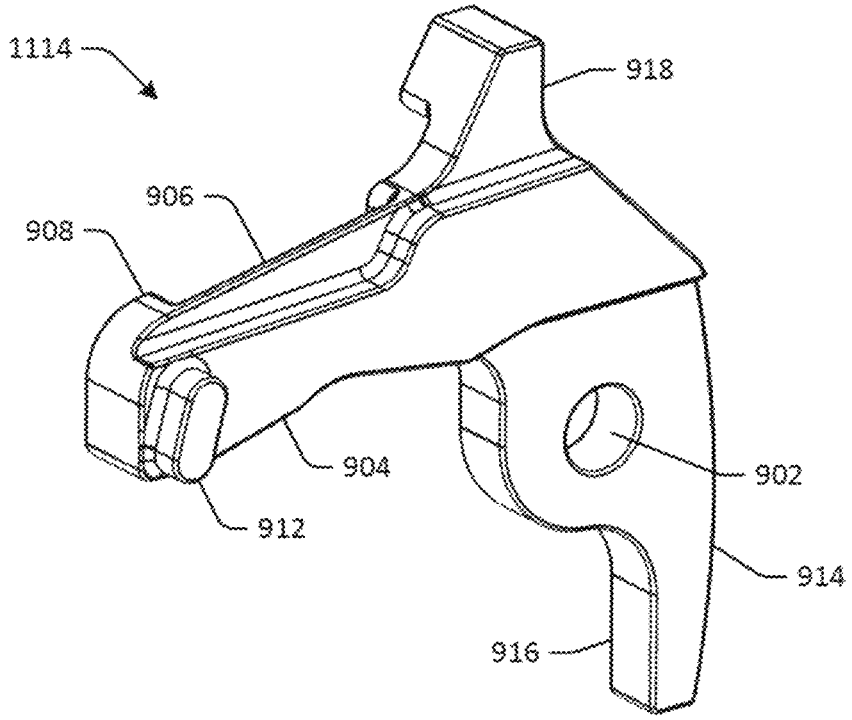
FIG. 26A is a perspective view of a second sear according to one or more examples of the disclosure.
Figure 26B:
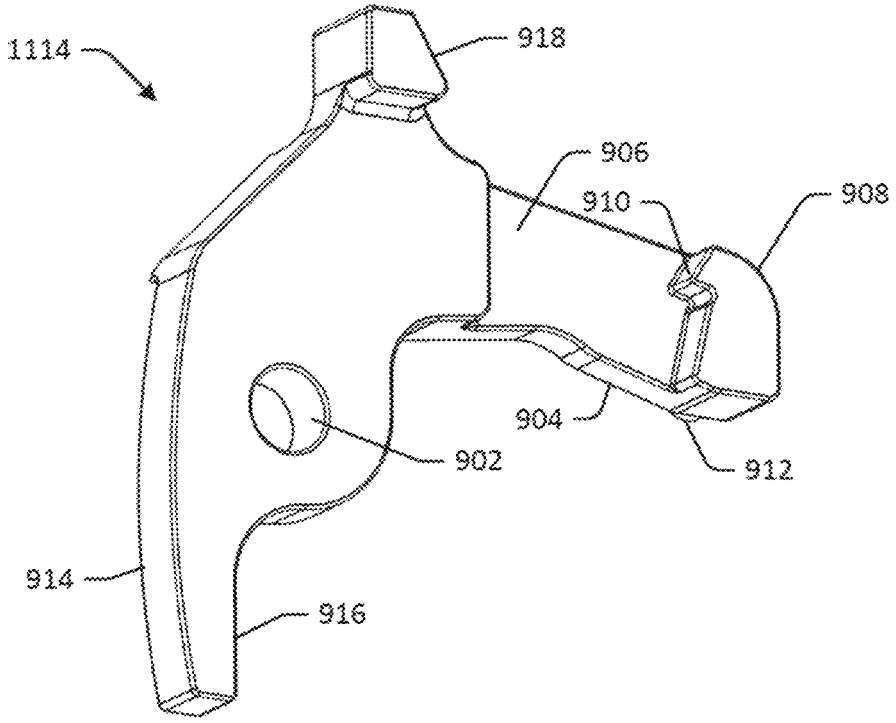
FIG. 26B is another perspective view of the second sear according to one or more examples of the disclosure.
Figure 27A:
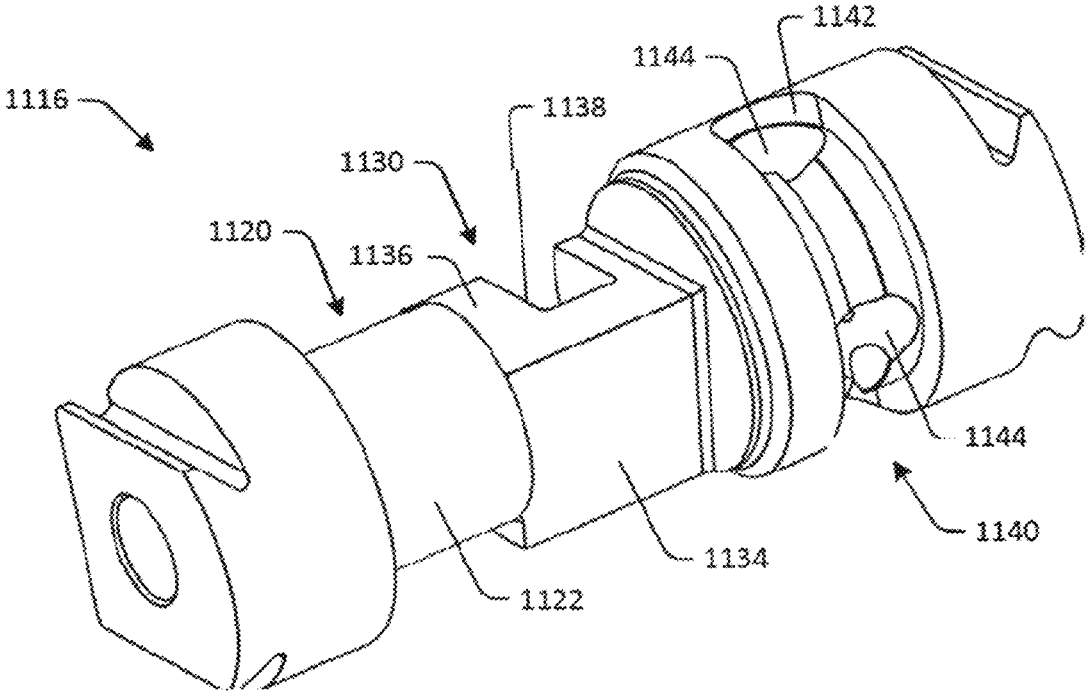
FIG. 27A is a perspective view of a selector according to one or more examples of the disclosure.
Figure 27B:
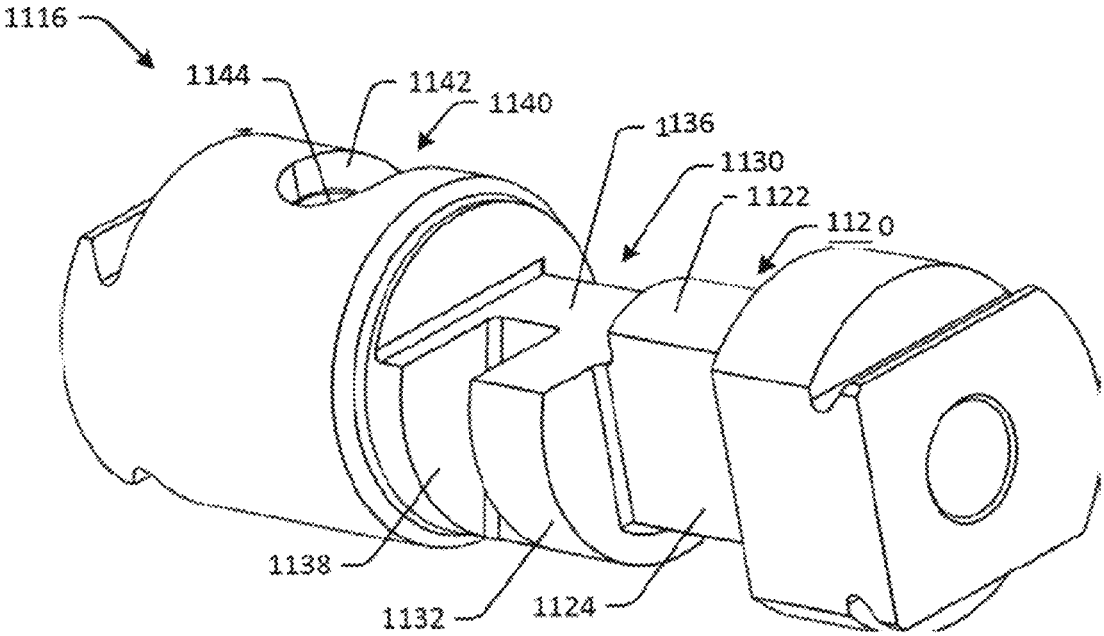
FIG. 27B is another perspective view of the selector according to one or more examples of the disclosure.

In FIGS. 18-22, the operation of the trigger system 100 is illustrated. In FIG. 18, upon firing a semi-automatic firearm utilizing the trigger system 100, the hammer 110 may be driven in an initial motion back into contact with the disconnector 106, which motion may be limited by the hammer 110 contacting one or more of wings 330A and/or 330B. In FIG. 19, the hammer 110, under the bias of spring 206, moves into engagement with the sear 108 at the engagement ridge 504 of the sear 108 and platform 602 of the hammer 110. In this position, the disconnector 106 moves upward under the bias of the plunger 324 and spring 322, putting the disconnector 106 in contact with the sear 108 and the hammer 110. In FIG. 20, as the trigger 102 is actuated, as shown relative to the reference line 500, the notch 720 of the disconnector 106 engages the ridge 509 of the sear 108. At this point, often referred to as "the wall," the movement of the trigger 102 in an actuation direction comes under noticeably higher resistance as actuation of the trigger 102 now has to overcome the bias of the spring 210 that resists movement of the sear 108 (in the clockwise direction, away from the hammer 110, based on the view shown in FIG. 20). By increasing the pressure on the trigger shoe 310, a slight movement of the trigger 102, as illustrated relative to the reference line 500 between FIGS. 20 and 21, the sear 108 is rotated away from the hammer 110, disengaging the engagement ridge 504 of the sear 108 from the platform 602 of the hammer 110, releasing the hammer 110, under the bias of spring 206. The hammer 110, as shown in FIG. 22, may then strike the bolt under the force of spring 206, causing a discharge of the firearm. The return of the hammer 110 to the position shown in FIG. 18 may be facilitated by the bolt carrier group of the firearm during the recoil motion of the firearm. It is noted, with reference back to FIG. 18, the downward force of the hammer 110 striking the disconnector 106 disengages the disconnector 106 from the sear 108, as shown.

In some embodiments, the trigger system 100 may be formed by the parts of the trigger 102, disconnector 106, disconnector pin 124, spring 322, and plunger 324. The trigger assembly may be formed of parts of the trigger system 100 that are connected to the trigger 102 and not mounted into the firearm receiver themselves. The trigger assembly may be balanced such that its center of gravity is at the bore 314 of the trigger 102, which may also be at the trigger pin 122 about which the trigger 102 rotates in operation. The trigger assembly may be balanced about the bore 314 so that when the trigger 102 is cocked and in a ready-to-fire state, there will be no or little moment in the trigger assembly that would create momentum that may result in movement or rotation of the trigger 102 about the trigger pin 122, that may result in an accidental discharge. When the trigger assembly is balanced in this manner, when undergoing a muzzledown drop safety test there is little to no moment or rotation about the trigger pin 122 that would cause undesired discharge. The trigger assembly may be balanced by the weight distribution of its various parts. On the trigger 102, for instance, the trigger shoe 310 may be contoured to reduce weight, particularly at the distal end further away from the bore 314, the second cavity 318 may be added not only for full auto functionality but for weight savings and balance, the nose 306 and tail 308 may be contoured to reduce weight, particularly at the distal ends thereof that are further away from the bore 314, and the slot 304 may be added for balance. In addition, with respect to the disconnector 106, the disconnector bore 704, protrusion 710, and arm 708, which are disposed at a distance from the bore 314, may be sized and shaped to minimize the weight of the disconnector 106 and specifically position said weight of the disconnector 106 as a part of the balance of the trigger assembly as well. In one embodiment, the balance is achieved by removing weight at the locations furthest from the center of gravity, such as by adding the bore 704 and shaping the protrusion 710 and arm 708 to minimize weight of those parts while maintaining the durability of those features.

In some embodiments, the sear 108 may be balanced about the bore 508, which is at the point the sear 108 rotates about the sear pin 126. The guide 502, engagement ridge 504, and neck extending from the bore 508 to the guide 502 and ridge 504, may be configured to minimize their weight while retaining the requisite durability, and the legs 507 may be shaped and sized to balance the weight of the neck, guide 502 ridge 504 and other features on the opposite side of the bore 508 to have the center of gravity of the sear 108 at the bore 508/sear pin 126. The balance of the sear 108 may be in a cocked and ready-to-fire state, thus preventing or substantially eliminating any unwanted moment about the bore 508 that would create momentum in the sear 108 that might cause it to become disconnected from the hammer 110 so that it might result in an accidental discharge, such as during a drop safety test or a similar event. The sear 108 being balanced helps prevent the flexure of various parts when the sear is pulled.

With reference to FIGS. 23A-30C, the present disclosure further provides a dynamically balanced trigger system 1100 for a firearm, with the trigger system 1100 being configured for operating in a fully-automatic mode as well as a semi-automatic mode. Certain similarities and differences between the trigger system 1100 and the trigger system 100 described above will be appreciated by one skilled in the art based on comparison of the corresponding figures and the present description. In some embodiments, as shown, the trigger system 1100 may include certain components that are the same as, or similar to, corresponding components of the trigger system 100 and thus may provide the same or similar advantages as those described above. As shown, the trigger system 1100 may include a trigger 102, a disconnector 106, a sear (which may be referred to as a "first sear") 108, a hammer 110, a hammer pin 120, a trigger pin 122, a disconnector pin 124, a sear pin (which may be referred to as a "first sear pin") 126, a bumper 202, a pin spring 204, a hammer spring 206, a trigger spring 208, and a sear spring (which may be referred to as a "first sear spring") 210, each of which may be configured in the same manner described above. The trigger system 1100 also may include a housing 1104, certain features of which may be the same as, or similar to, corresponding features of the housing 104 of the trigger system 100, while other features of the housing 1104, as described herein, may be different from the housing 104. Further, the trigger system 1100 may include a connector 1112, a second sear 1114, a selector 1116, a second sear pin 1118, a second sear spring 1122, and a second sear plunger 1124, as shown.

As described above, the trigger system 100 may be configured for semi-automatic operation, with the trigger 102, the disconnector 106, the sear 108, the hammer 110, the hammer spring 206, the trigger spring 208, and the sear spring 210 thereof being configured to provide a desirable tactile feel during actuation of the trigger 102, thereby enhancing precision when the corresponding firearm is operated in semi-automatic mode. For the trigger system 1100, these same components—the trigger 102, the disconnector 106, the first sear 108, the hammer 110, the hammer spring 206, the trigger spring 208, and the first sear spring 210—may be used for semi-automatic operation, similarly providing a desirable tactile feel during actuation of the trigger 102. As described herein, during semi-automatic operation of the trigger system 1100, the connector 1112 and the second sear 1114 may be inactive so as not to affect movement of the other components. In contrast, during fully-automatic operation of the trigger system 1100, the connector 1112 and the second sear 1114 may be active, with the connector 1112 selectively engaging the first sear 108 and with the second sear 1114 selectively engaging the hammer 110, while the disconnector 106 and the first sear 108 may be inactive. In view of the disclosed configuration utilizing a disconnector, a connector, and two sears, the trigger system 1100 may be capable of fully-automatic operation while still providing a desirable tactile feel during actuation of the trigger 102 when the trigger system 1100 is operated in semi-automatic mode.

In some embodiments, as shown, the trigger 102 may be configured in the manner described above, with the trigger 102 comprising a main body 302, a bore 304, a nose 306, a tail 308, a shoe 310, a bore 312, a bore 314, a channel 316, a pair of walls 317, a first cavity 320, and a second cavity 318. As described above, the first cavity 320 may have a first spring 322 and a first plunger 324, together forming a first spring-loaded plunger, received therein, which biases an arm 708 of the disconnector 106 away from the trigger 102 and toward the first sear 108. As shown, for the trigger system 1100, the second cavity 318 may have a second spring 1326 and a second plunger 1328, together forming a second spring-loaded plunger, received therein, which biases an arm 808 of the connector 1112 away from the first sear 108 and toward the selector 1116. In some examples, the second plunger 1328 may be eliminated, such that the second spring 1326 directly engages and biases the connector 1112. Although the second spring 1326 is illustrated as a coiled compression spring, other types of springs may be used for the second spring 1326. In some examples, the second spring 1326 and the second plunger 1328 both may be eliminated, and an alternative mechanism, such as a cam mechanism, may be used for causing the connector 1112 to move relative to the selector 1116 to different positions for the different operating modes of the trigger system 1100.

In some embodiments, as shown, certain features of the housing 1104 may be configured in a manner similar to corresponding features of the housing 104. For example, the housing 1104 may comprise a first slot 402, a recess 404, a recessed surface 405, a second slot 406, a protrusion 408, a lip 409, an aperture 410 for receiving the hammer pin 120, an aperture 412 for receiving the first sear pin 126, an aperture 414 for receiving the trigger pin 122, a hole 220 for receiving the bumper 202, and first and second wings 330A, 330B for selectively engaging the hammer 110. As shown, the housing 1104 also may comprise an aperture 416 for receiving the second sear pin 1118 rotationally coupling the second sear 1114 to the housing 1104. The housing 1104 may define a channel 418 between parallel walls 420 thereof, with a portion of the second sear 1114 being disposed within the channel 418. As shown, the housing 1104 also may comprise a bore 422 that receives the second sear spring 1122 and the second sear plunger 1124 therein. The second sear spring 1122 and the second sear plunger 1124, together forming a spring-loaded plunger, may bias an arm 904 of the second sear 1114 away from the housing 1104.

In some embodiments, as shown, the disconnector 106 may be configured in the manner described above, with the disconnector 106 comprising a bore 702 for receiving the disconnector pin 124, a bore 704 for weight distribution, an arm 708 for selectively engaging the first sear 108, a protrusion 710 for selectively engaging the hammer 110, and a notch 720 for selectively engaging the ridge 509 of the first sear 108.

In some embodiments, as shown, the first sear 108 may be configured in the manner described above, with the first sear 108 comprising a guide 502 for guiding the hammer 110, an engagement ridge 504 for selectively engaging the ledge 604 of the hammer 110, a channel 506 defined between a pair of legs 507, a bore 508 for receiving the first sear pin 126, a ridge 509 for selectively engaging the notch 720 of the first disconnector 106, and a sear face 510 for selectively engaging the hammer face 612 of the hammer 110.

In some embodiments, as shown, the hammer 110 may be configured in the manner described above, with the hammer 110 comprising a platform 602, a ledge 604 for selectively engaging the engagement ridge 504 of the first sear 108, a notch 606 for selectively engaging the nose 306 of the trigger 102, a head 608, a bore 610 for receiving the hammer pin 120, and a hammer face 612 for selectively engaging the sear face 510 of the first sear 108. A recess 614 may be defined along a lateral side of the head 608, with a protrusion 616 disposed adjacent the recess 614 and extending from the ledge 604. As shown, the protrusion 616 may be configured for selectively engaging a searing protrusion 908 of the second sear 1114. In this manner, as described further below, the ledge 604 may include a first searing surface that is utilized when the first sear 108 is active, and the protrusion 616 may include a second searing surface 618 that is utilized when the second sear 1114 is active. As shown, the hammer 110 also may comprise an engagement surface 620 disposed adjacent the recess 614 and configured for selectively engaging the searing protrusion 908 of the second sear 1114, from above, when the hammer 110 rotates towards its cocked position.

In some embodiments, as shown, the connector 1112 may comprise a bore 802, a tail 804, a cutout 806, an arm 808 having a distal portion 810, and a notch 820. The connector 1112 may be connected to the trigger 102 by the disconnector pin 124 inserted through the bores 312 of the trigger 102 and through the bore 802 of the connector 1112. The connector 1112 may be disposed within the channel 316 of the trigger 102 and adjacent the disconnector 106. The tail 804 may rest on top of the second plunger 1328 and the second spring 1326 which bias the connector 1112 to rotate about the disconnector pin 124 such that the distal portion 810 of the arm 808 engages the selector 1116. The cutout 806 may be positioned such that the connector 1112 does not contact the first spring 322 or the first plunger 324. The connector 1112 has two planes of motion, that is, it both rotates about the disconnector pin 124 and moves forward to back due to the motion of the trigger 102 moving the disconnector pin 124. As noted above, the connector 1112 may be inactive when the trigger system 1100 is in the semi-automatic mode, and the connector 1112 may be active when the trigger system 1100 is in the fully-automatic mode. In other words, the connector 1112 may be configured to not engage the first sear 108 at all when the trigger system 1100 is in the semi-automatic mode, and the connector 1112 may be configured to selectively engage the first sear 108 when the trigger system 1100 is in the fully-automatic mode. As described below, when the trigger system 1100 is in the fully-automatic mode and the trigger 102 is actuated, the connector 1112 may move into engagement with the first sear 108 such that the notch 820 engages the ridge 508 of the first sear 108.

In some embodiments, as shown, the second sear 1114 may comprise a bore 902, an arm 904, a recess 906, a searing protrusion 908 having a hook 910, a stabilizing protrusion 912, a tail 914, a selector protrusion 916, and a bolt-carrier protrusion 918. The second sear 1114 may be connected to the housing 1104 by the second sear pin 1118 inserted through the bores 416 of the housing 1104 and through the bore 902 of the second sear 1114. The second sear 1114 may be disposed within the channel 418 of the housing 1104. The arm 904 may rest on top of the second sear plunger 1124 and the second sear spring 1122 which bias the second sear 1114 to rotate about the second sear pin 1118 such that the selector protrusion 916 of the tail 914 engages the selector 1116. As noted above, the second sear 1114 may be inactive when the trigger system 1100 is in the semi-automatic mode, and the second sear 1114 may be active when the trigger system 1100 is in the fully-automatic mode. In other words, the second sear 1114 may be configured to not engage the hammer 110 at all when the trigger system 1100 is in the semi-automatic mode, and the second sear 1114 may be configured to selectively engage the hammer 110 when the trigger system 1100 is in the fully-automatic mode. As described below, when the trigger system 1100 is in the fully-automatic mode, the searing protrusion 908 may selectively engage the engagement surface 620 of the hammer 110 as the hammer 110 moves back toward its cocked position, and the searing protrusion 908 may selectively engage the protrusion 616 of the hammer 110 when the hammer 110 is in its cocked position. In particular, the hook 910 of the searing protrusion 908 may engage the protrusion 616 and retain the hammer 110 in its cocked position until the bolt-carrier protrusion 918 is contacted by the bolt carrier of the firearm, causing the second sear 1114 to rotate, against the biasing force provided by the second sear plunger 1124 and the second sear spring 1122, to a position at which the searing protrusion 908 disengages the protrusion 616 of the hammer 110.

In some embodiments, as shown, the selector 1116 may comprise a first region 1120 configured for selectively engaging the second sear 1114, a second region 1130 configured for selectively engaging the connector 1112, and a third region 1140 configured for selectively engaging one or more mating components of the firearm. The selector 1116 may be configured to be adjusted relative to the housing 1104 to set the trigger system 1100 in each of a semi-automatic mode, a fully-automatic mode, and a safe mode. For example, the selector 1116 may be a rotary selector that is rotationally coupled to the lower receiver of the firearm and configured to rotate between respective rotational positions corresponding to the semi-automatic mode, the fully-automatic mode, and the safe mode. The first region 1120 may include a plurality of features configured for selectively engaging the selector protrusion 916 of the second sear 1114, which define respective positions of the second sear 1114 in each of the semi-automatic mode, the fully-automatic mode, and the safe mode when the second sear plunger 1124 and the second sear spring 1122 bias the second sear 1114 into engagement with the selector 1116. As shown, the first region 1120 may include a curved surface 1122 and a planar surface 1124. The curved surface 1122 may be configured to engage the selector protrusion 916 of the second sear 1114 when the trigger system 1100 is in the semi-automatic mode and when the trigger system 1100 is in the safe mode. As described below, when the curved surface 1122 engages the second sear 1114, the second sear 1114 may be in an inactive position. The planar surface 1124 may be configured to engage the selector protrusion 916 of the second sear 1114 when the trigger system 1100 is in the fully-automatic mode. As described below, when the planar surface 1124 engages the second sear 1114, the second sear 1114 may be in an active position.

The second region 1130 may include a plurality of features configured for selectively engaging the distal portion 810 of the connector 1112, which define respective positions of the connector 1112 in each of the semi-automatic mode, the fully-automatic mode, and the safe mode when the second plunger 1328 and the second spring 1326 bias the connector 1112 into engagement with the selector 1116. As shown, the second region 1130 may include a curved surface 1132, a pair of planar surfaces 1134, 1136, and a channel 1138. The channel 1138 may be configured to receive the distal portion 810 of the connector 1112 when the trigger system 1100 is in the semi-automatic mode. As described below, when the channel 1138 receives the connector 1112, the connector 1112 may be in an inactive position. The curved surface 1132 may be configured to engage the distal portion 810 of the connector 1112 when the trigger system 1100 is in the fully-automatic mode. As described below, when the curved surface 1132 engages the connector 1112, the connector 1112 may be in an active position. The planar surface 1136 may be configured to engage the distal portion 810 of the connector 1112 when the trigger system 1100 is in the safe mode. As described below, when the planar surface 1136 engages the connector 1112, the connector 1112 may be in an inactive position. Additionally, the curved surface 1132 may be configured to engage the tail 308 of the trigger 102 when the trigger system 1100 is in the safe mode, as described below, thereby blocking actuation of the trigger 102 in the safe mode. The third region 1140 may include a plurality of features configured for selectively engaging one or more mating components of the firearm, such as a spring-loaded plunger, for releasably retaining a rotational position of the selector 1116. As shown, the third region 1140 may include a circumferential slot 1142 having three spaced-apart recesses 1144 each corresponding to one of the semi-automatic mode, the fully-automatic mode, and the safe mode.

Figure 28A:
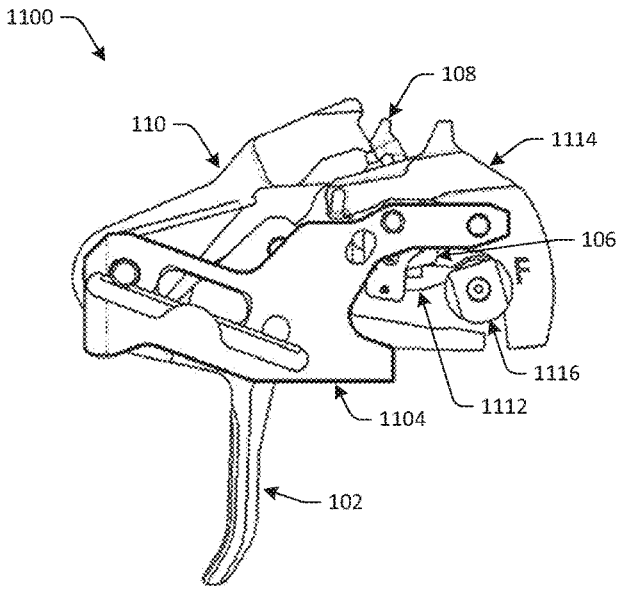
FIGS. 28A-28F are side views, including some cross-sectional side views, of the dynamically balanced trigger system of FIG. 23A in states of actuation in a semi-automatic mode of the trigger system according to one or more examples of the disclosure.
Figure 28B:
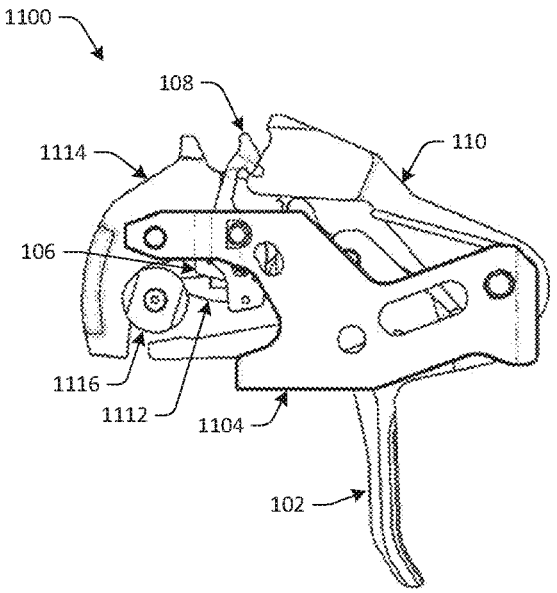
Figure 28D:
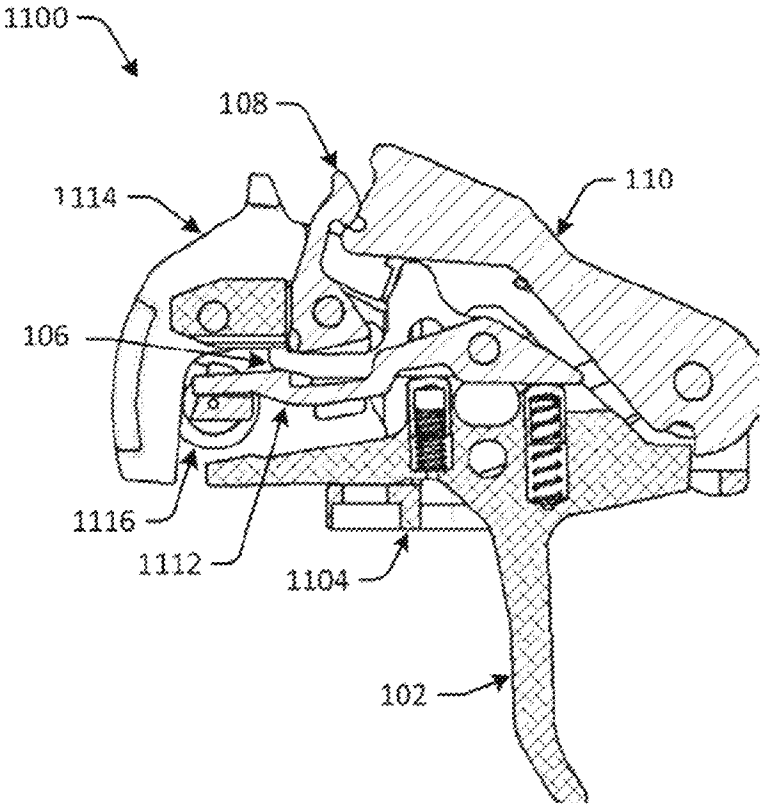
Figure 28C:
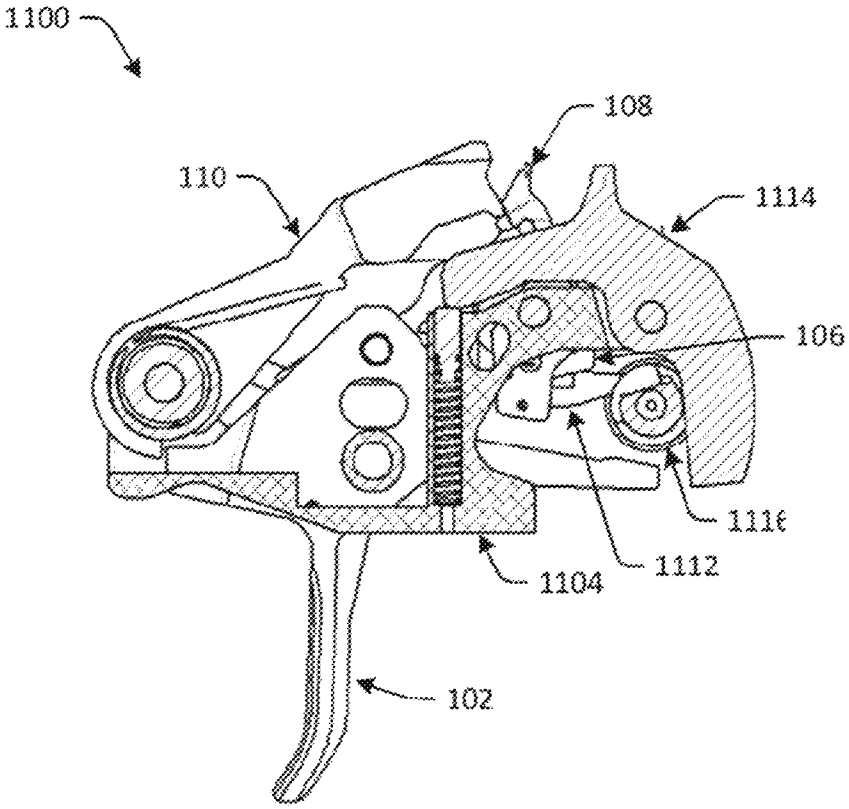
Figure 28F:
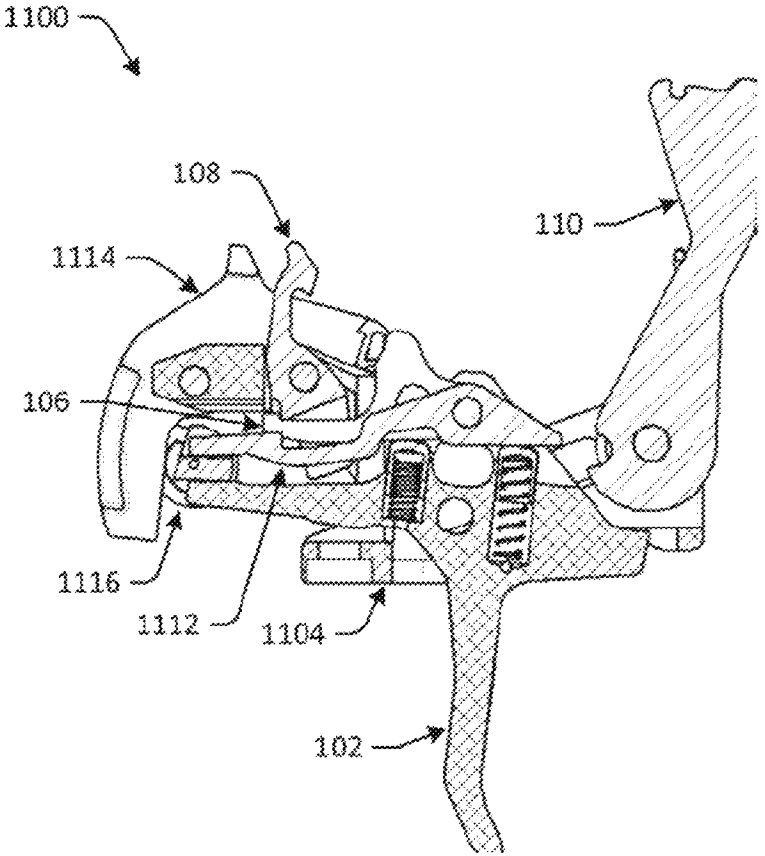

FIGS. 28A-28F illustrate operation of the trigger system 1100 and interaction between components thereof when the trigger system 1100 is in the semi-automatic mode, according to one or more examples of the disclosure. The selector 1116 may be in a semi-automatic rotational position, as shown, corresponding to the semi-automatic mode of the trigger system 1100. As discussed above, during semi-automatic operation of the trigger system 1100, the connector 1112 and the second sear 1114 may be inactive, while the disconnector 106 and the first sear 108 may be active. In particular, with the selector 1116 in its semi-automatic rotational position, the second spring 1326 and the second plunger 1328 may bias the arm 808 of the connector 1112 away from the first sear 108 and into engagement with the selector 1116, as shown in FIGS. 28D and 28F, such that the distal portion 810 of the connector 1112 is received within the channel 1138 of the second region 1130 of the selector 1116. In this manner, the arm 808 of the connector 1112 may be maintained in a position spaced apart from the first sear 108 such that the connector 1112 is in an inactive state and does not engage the first sear 108 during semi-automatic operation of the trigger system 1100. Additionally, with the selector 1116 in its semi-automatic rotational position, the second sear spring 1122 and the second sear plunger 1124 may bias the second sear 1114 into engagement with the selector 1116, as shown in FIG. 28C, such that the selector protrusion 916 of the second sear 1114 engages the curved surface 1122 of the first region 1120 of the selector 1116. In this manner, the arm 904 of the second sear 1114 may be maintained in a position spaced apart from the hammer 110, at least partially compressing the second sear spring 1122 and the second sear plunger 1124, such that the second sear 1114 is in an inactive state and does not engage the hammer 110 during semi-automatic operation of the trigger system 1100.

Figure 28E:
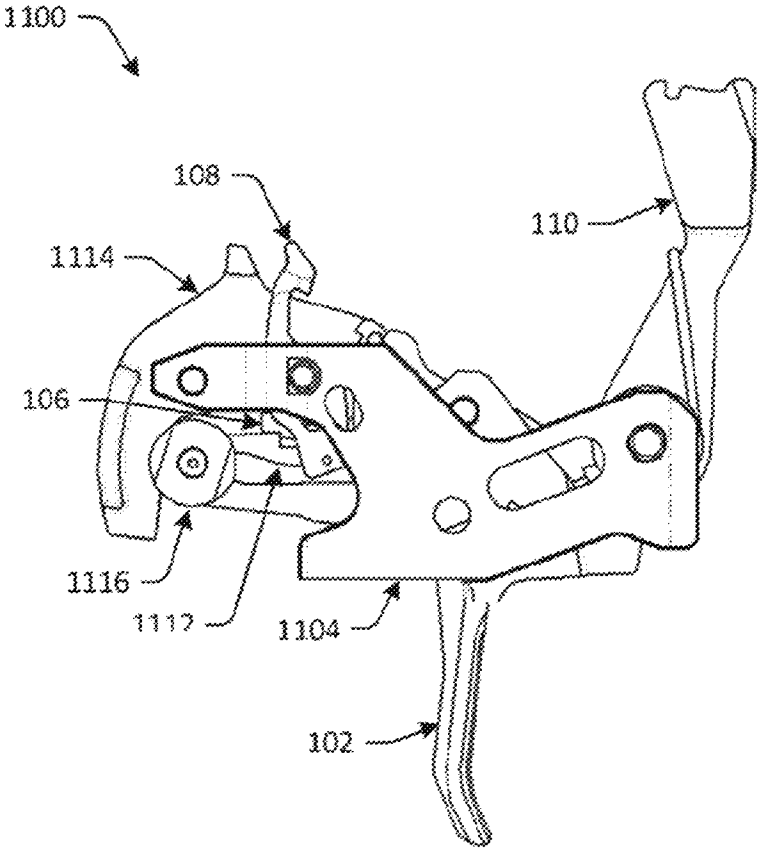

As discussed above, when the trigger system 1100 operates in the semi-automatic mode, the trigger 102, the disconnector 106, the sear 108, and the hammer 110 may operate in the same manner described above with respect to FIGS. 18-22 for the trigger system 100. After firing a firearm utilizing the trigger system 1100 in the semi-automatic mode, the hammer 110 may be driven in an initial motion back into engagement with the protrusion 710 of the disconnector 106, which motion may be limited by the hammer 110 contacting one or more of the wings 330A and/or 330B of the housing 1104. Additionally, the hammer 110 may engage the guide 502 of the first sear 108, which may guide the hammer 110 such that the sear face 510 of the first sear 108 engages the hammer face 612 of the hammer 110. As shown in FIGS. 28A-28D, the hammer 110, under the bias of the hammer spring 206, then may move into engagement with the first sear 108 such that the first searing surface of the platform 602 of the hammer 110 engages the engagement ridge 504 of the sear 108. Meanwhile, the disconnector 106, under the bias of the first spring 322 and the first plunger 324, may move upward such that the arm 708 of the disconnector 106 engages the first sear 108, although the notch 720 of the disconnector 106 is spaced apart from the ridge 509 of the first sear 108, and such that the protrusion 710 of the disconnector 106 engages the hammer 110, as shown. As the trigger 102 is pulled, the disconnector 106 moves such that the notch 720 of the disconnector 106 engages the ridge 509 of the first sear 108. At this point, often referred to as "the wall," the movement of the trigger 102 in an actuation direction comes under noticeably higher resistance as actuation of the trigger 102 now has to overcome the bias of the first sear spring 210 that resists movement of the first sear 108. With increasing the pressure on the trigger shoe 310, upon further movement of the trigger 102 in the actuation direction, the disconnector 106 may cause the first sear 108 to rotate away from the hammer 110 such that the engagement ridge 504 of the first sear 108 disengages the platform 602 of the hammer 110, releasing the hammer 110 under the bias of the hammer spring 206, as shown in FIGS. 28E and 28F. Upon release, the hammer 110, under the bias of the hammer spring 206, may strike the bolt of the firearm, causing a discharge of the firearm. The return of the hammer 110 back toward the disconnector 106 and the first sear 108 may be facilitated by the bolt carrier group of the firearm during the recoil motion of the bolt carrier group. The downward force of the hammer 110 striking the disconnector 106 may disengage the disconnector 106 from the first sear 108. The disconnector 106, the first sear 108, and the hammer 110 then may return to and be maintained in the arrangement shown in FIGS. 28A-28D until subsequent actuation of the trigger 102.

Figure 29B:
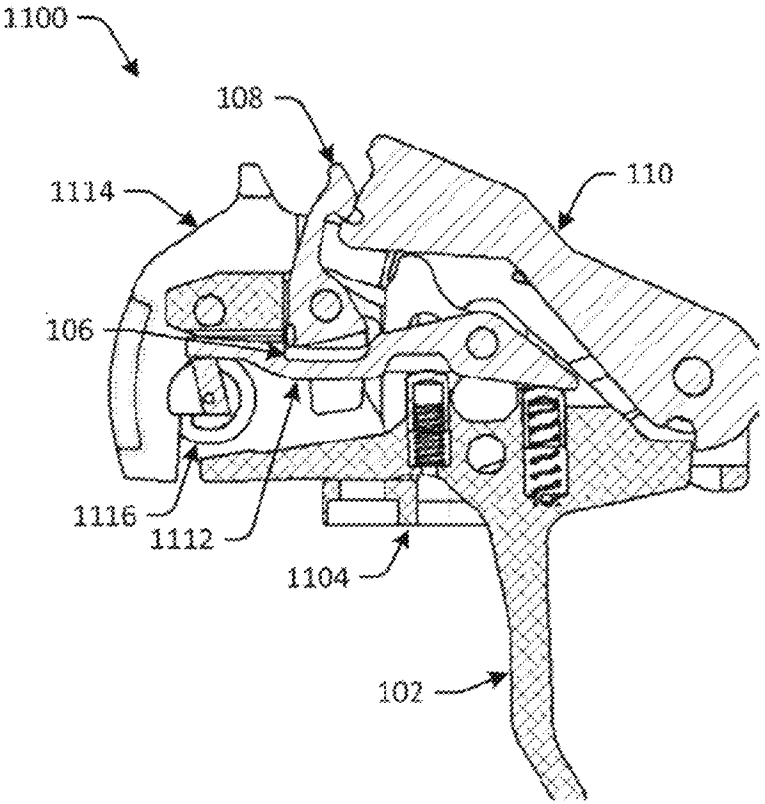
FIGS. 29A-29L are side views, including some cross-sectional side views, of the dynamically balanced trigger system of FIG. 23A in states of actuation in a fully-automatic mode of the trigger system according to one or more examples of the disclosure.
Figure 29A:
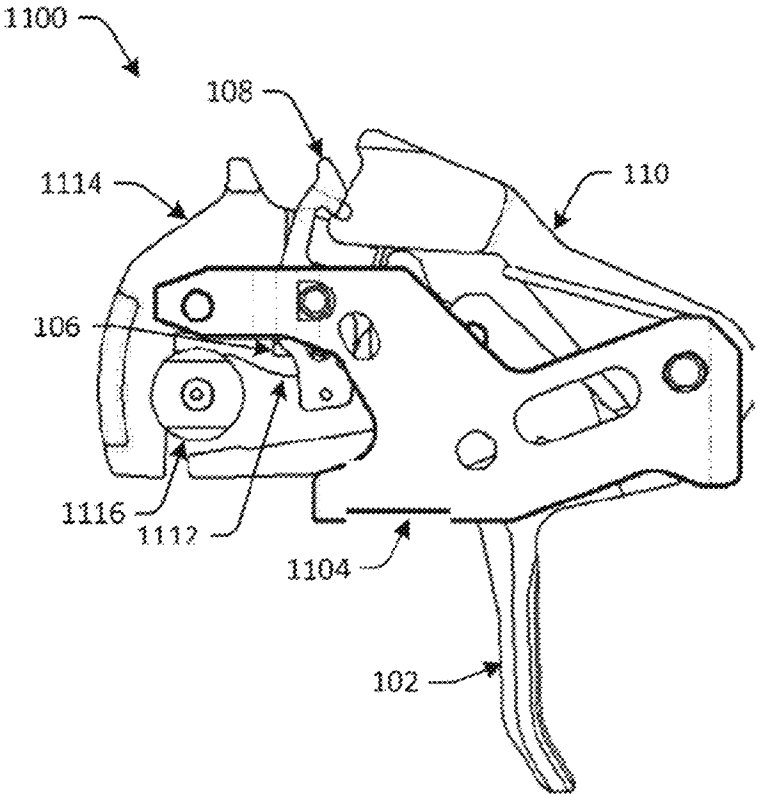
Figure 29D:
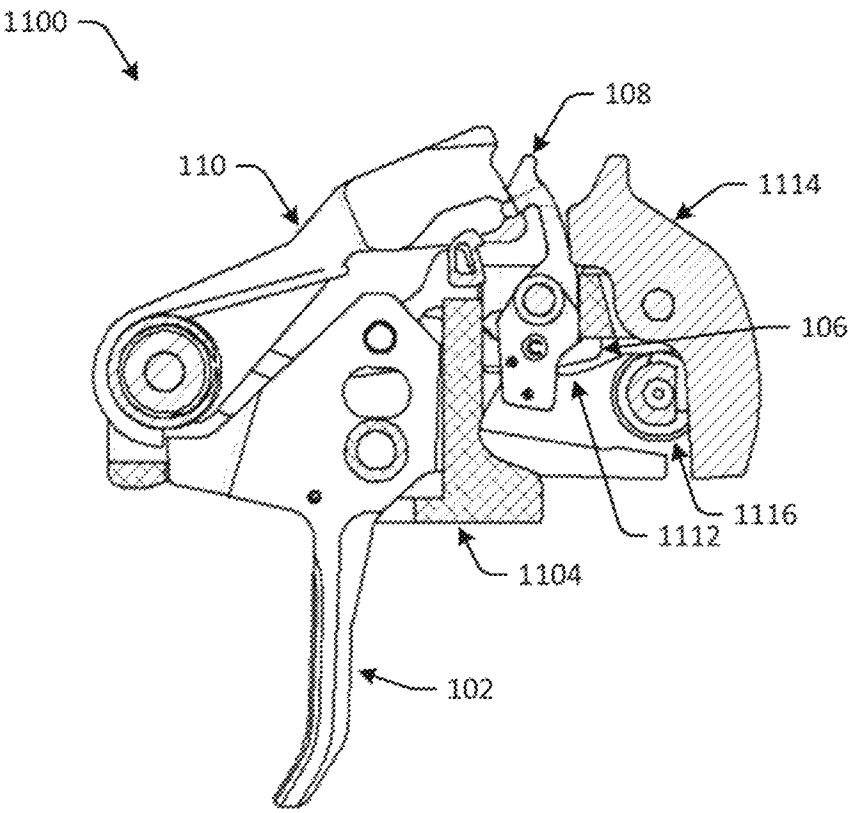
Figure 29C:
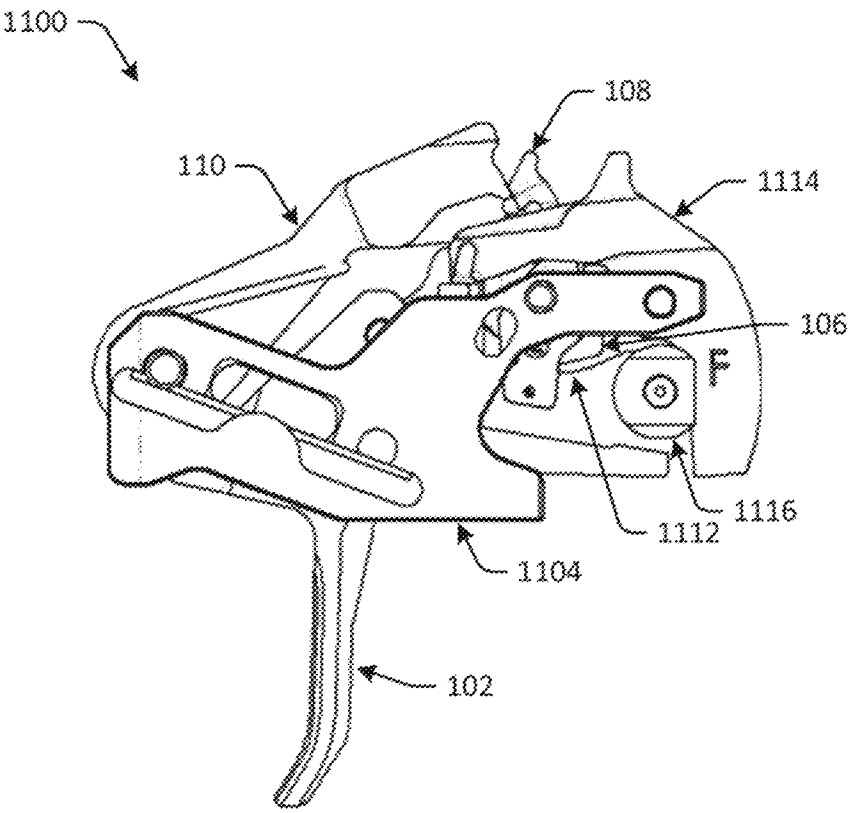
Figure 29F:
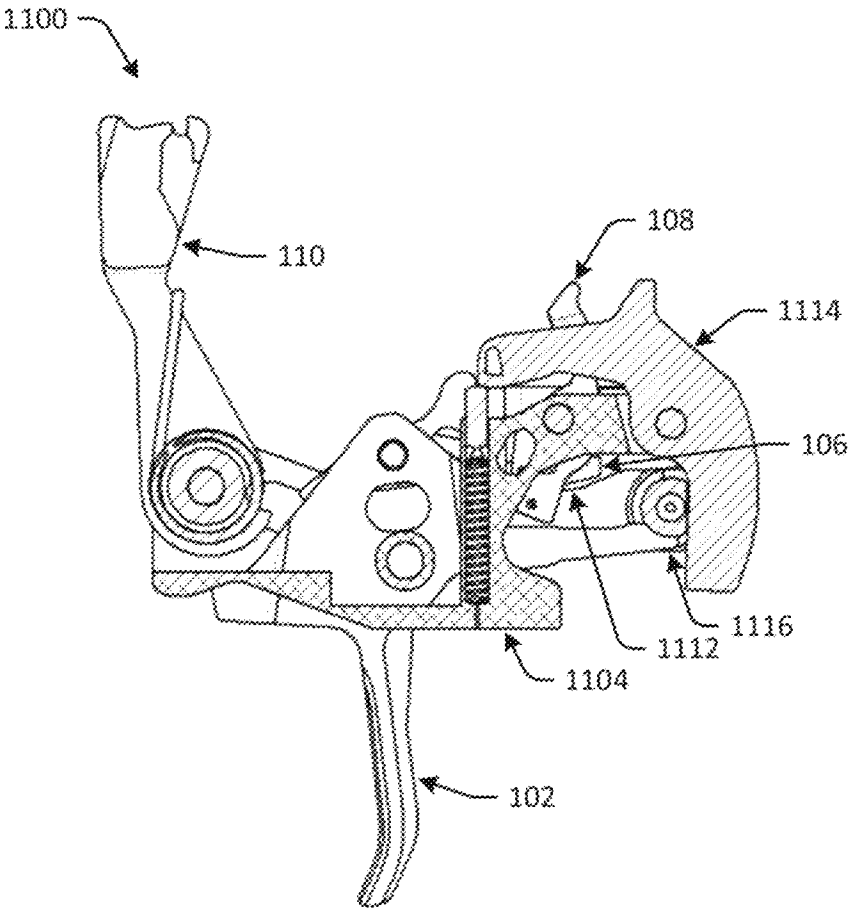
Figure 29E:
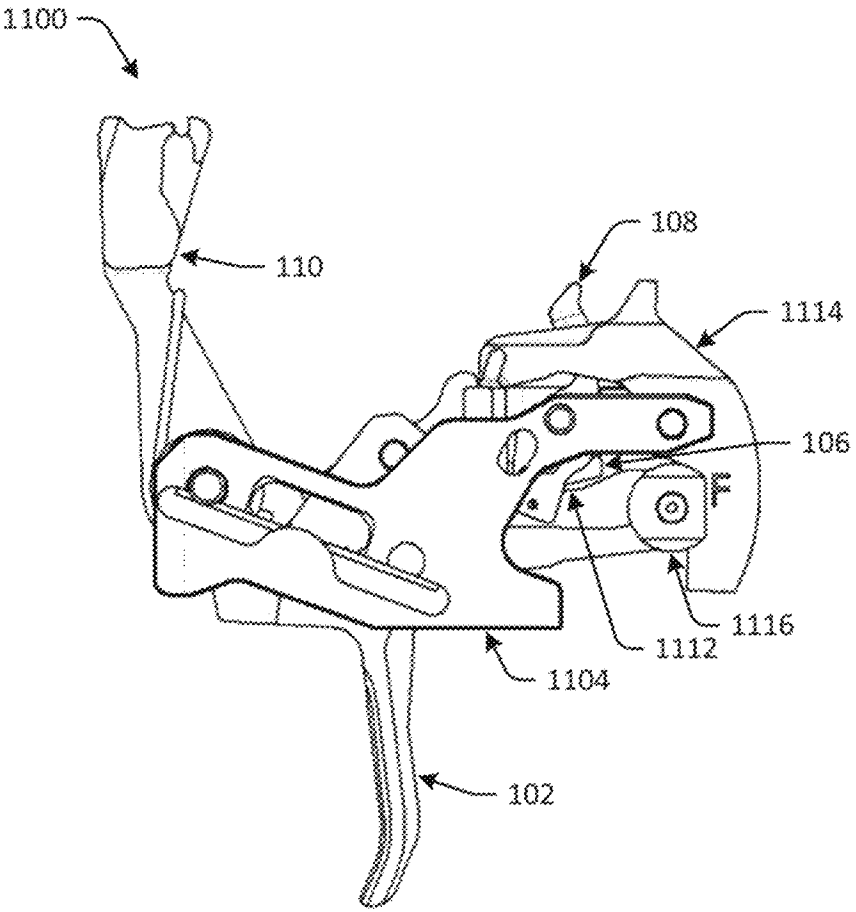
Figure 29G:
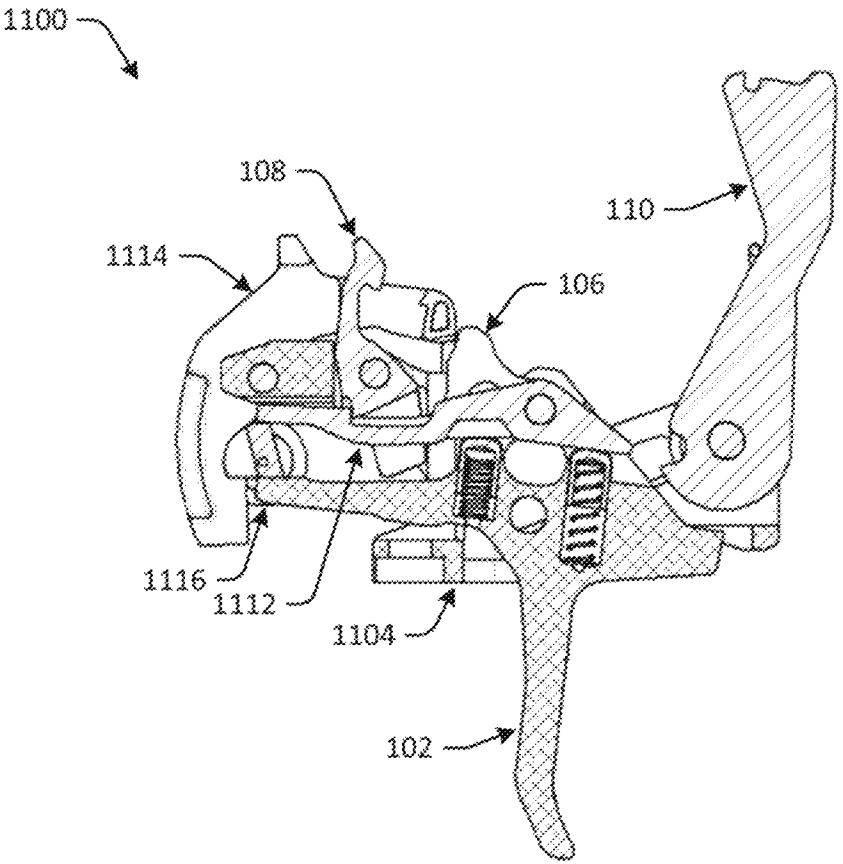

FIGS. 29A-29L illustrate operation of the trigger system 1100 and interaction between components thereof when the trigger system 1100 is in the fully-automatic mode, according to one or more examples of the disclosure. The selector 1116 may be in a fully-automatic rotational position, as shown, corresponding to the fully-automatic mode of the trigger system 1100. When the trigger system 1100 is in the fully-automatic mode, the connector 1112 and the second sear 1114 may be inactive at certain times and active at other times, and the disconnector 106 and the first sear 108 likewise may be active at certain times and inactive at other times. Specifically, when the trigger system 1100 is in the fully-automatic mode and the trigger 102 is not actuated, the connector 1112 and the second sear 1114 may be inactive, while the disconnector 106 and the first sear 108 may be active. In particular, when the trigger system 1100 is in the fully-automatic mode and the trigger 102 is not actuated, the second spring 1326 and the second plunger 1328 may bias the arm 808 of the connector 1112 into engagement with the selector 1116, as shown in FIG. 29B, such that the distal portion 810 of the connector 1112 engages the curved surface 1132 of the second region 1130 of the selector 1116 and is positioned near but slightly spaced apart from and not engaging the first sear 108, and thus the connector 1112 may be in an inactive state. Additionally, when the trigger system 1100 is in the fully-automatic mode and the trigger 102 is not actuated, the second sear spring 1122 and the second sear plunger 1124 may bias the arm 904 of the second sear 1114 to rotate upward, but the carrier of the bolt-carrier group may block such upward rotation of the second sear 1114 and hold the second sear 1114 down such that the second sear 1114 does not engage the hammer 110, as shown in FIGS. 29A-29B, and thus the second sear 1114 may be in an inactive state. Meanwhile, when the trigger system 1100 is in the fully-automatic mode and the trigger 102 is not actuated, as shown in FIGS. 29A-29B, the first sear 108 may engage and sear the hammer 110, and the disconnector 106 may engage the first sear 108, and thus the first sear 108 and the disconnector 106 may be in an active state. However, when the trigger system 1100 is in the fully-automatic mode and the trigger 102 is actuated, the connector 1112 and the second sear 1114 may be active, while the disconnector 106 and the first sear 108 may be inactive. In particular, when the trigger system 1100 is in the fully-automatic mode and the trigger 102 is actuated, the movement of the trigger 102 may cause the connector 1112 to move such that the notch 820 of the connector 1112 engages the ridge 509 of the first sear 108 such that the first sear 108 is rotated away from the hammer 110 to a position in which the disconnector 106 does not engage the first sear108, as shown in FIGS. 29E-29G, and thus the connector 1112 may be in an active state and the first sear 108 and the disconnector 106 may be in an inactive state. Additionally, when the trigger system 1100 is in the fully-automatic mode and the trigger 102 is actuated, the second sear spring 1122 and the second sear plunger 1124 may bias the arm 904 of the second sear 1114 to rotate upward to a position at which the searing protrusion 908 of the second sear 1114 is able to engage and sear the hammer 110 and the bolt-carrier protrusion of the second sear 1114 is able to be engaged by the carrier of the bolt-carrier group during fully-automatic cycling, as shown in FIGS. 29E-29L, and thus the second sear 1114 may be in an active state.

FIGS. 29A-29E show the trigger system 1100 and the components thereof after the selector 1116 has been rotated to its fully-automatic position corresponding to the fully-automatic mode of the trigger system 1100. Rotation of the selector 1116 to the fully-automatic position may allow the second sear 1114 to rotate upward, under bias of the second sear spring 1122 and the second sear plunger 1124, as the planar surface 1124 of the first region 1120 of the selector 1116 faces the selector protrusion 916 of the second sear 1114, as shown in FIG. 29D. However, as shown, the carrier of the bolt-carrier group may limit such upward rotation of the second sear 1114 and hold the second sear 1114 down such that the selector protrusion 916 of the second sear 1114 does not engage the planar surface 1124 of the selector 1116 and such that the second sear 1114 does not engage the hammer 110. Additionally, rotation of the selector 1116 to the fully-automatic position may cause the arm 808 of the connector 1112 to rotate upward as the distal portion 810 of the connector 1112 engages the curved surface 1132 of the second region 1130 of the selector 1116, as shown in FIG. 29B. As shown, the engagement between the distal portion 810 of the connector 1112 and the curved surface 1132 of the selector 1116 may cause the distal portion 810 of the connector 1112 to be positioned near but slightly spaced apart from and not engaging the first sear 108. Meanwhile, the first sear 108 may engage the hammer 110, and the disconnector 106 may engage the first sear 108, as shown in FIGS. 29A-29D.

Figure 29H:
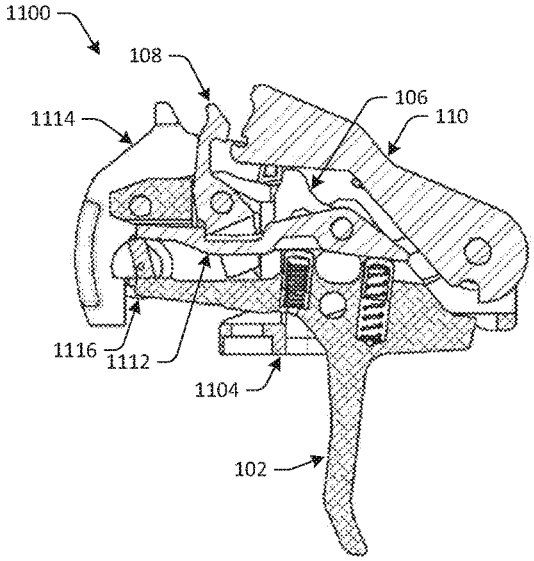
Figure 29I:
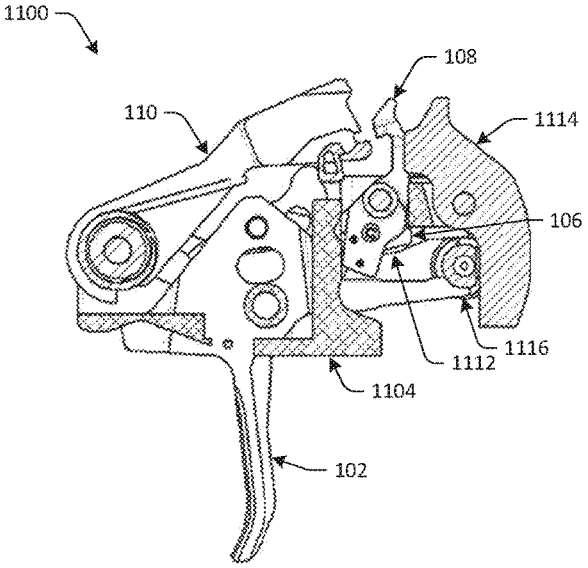
Figure 29J:
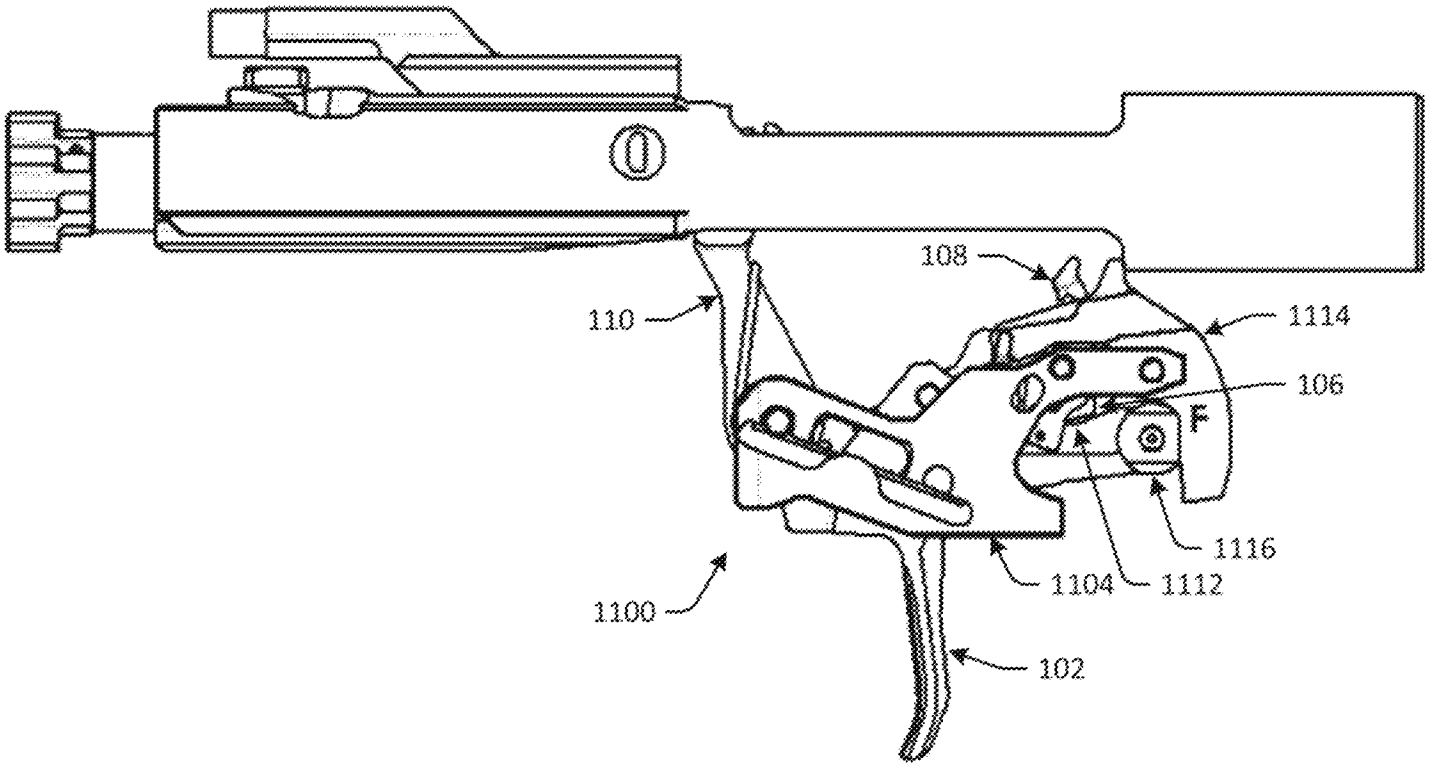
Figure 29K:
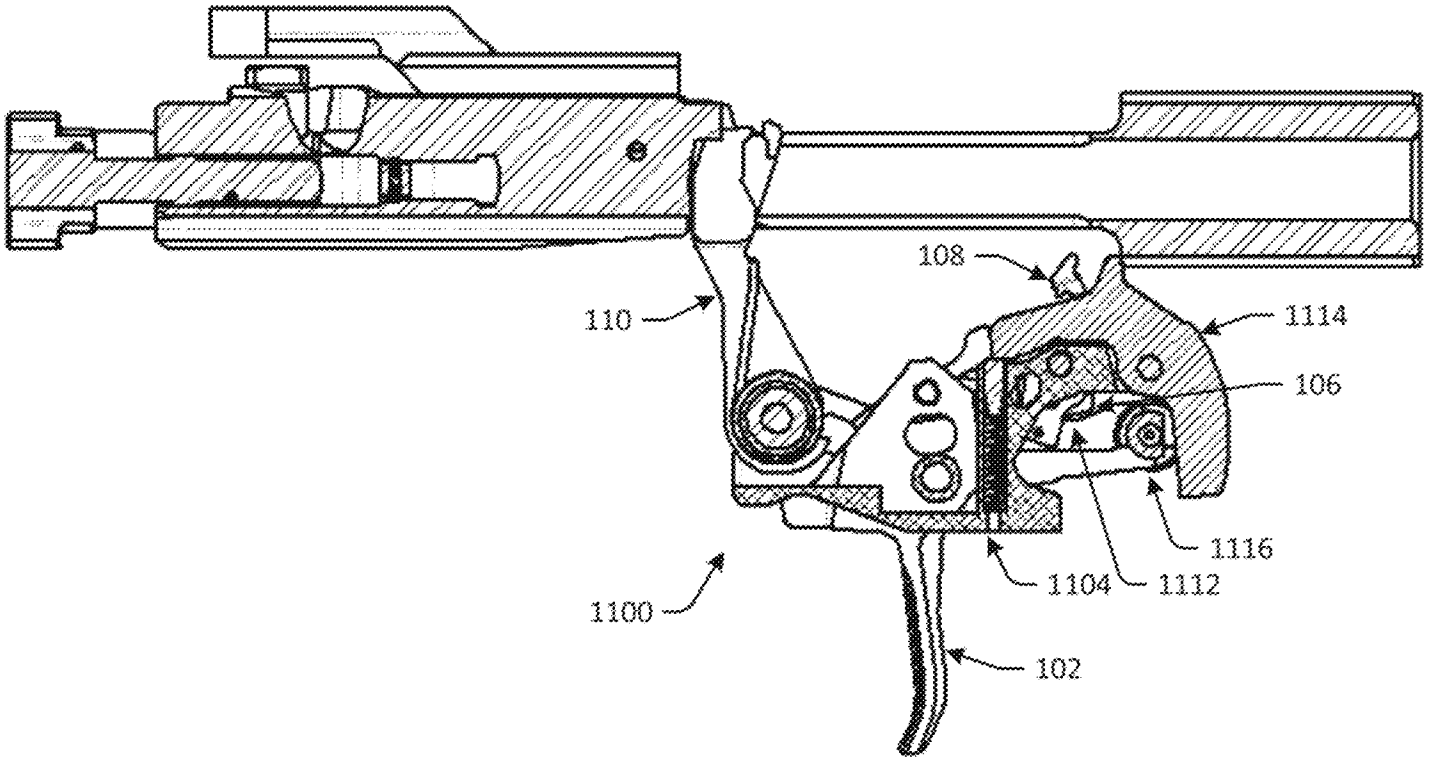
Figure 29L:
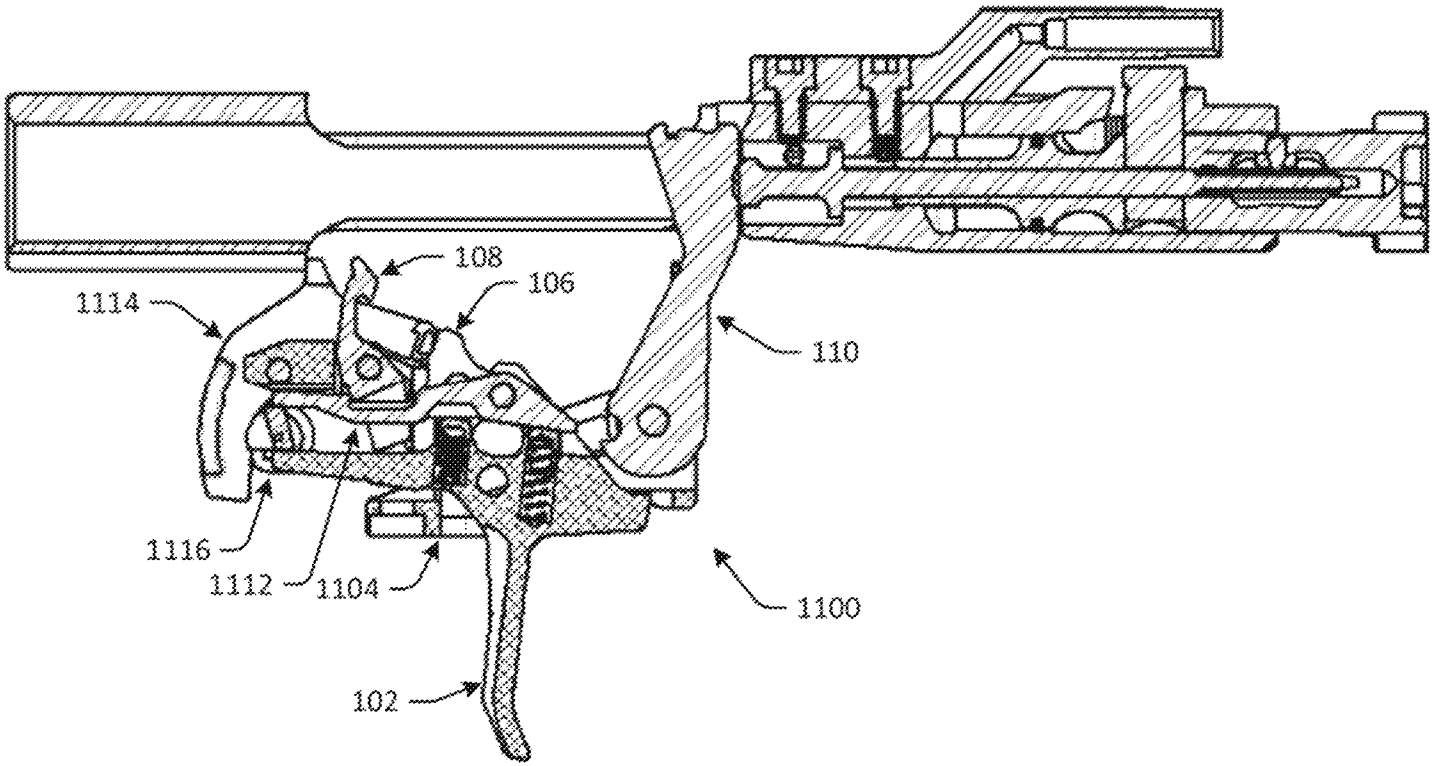

FIGS. 29E-29G show the trigger system 1100 and the components thereof once the trigger 102 has been pulled in its actuation direction. Upon pulling the trigger 102, the movement of the trigger 102 may cause the connector 1112 to move such that the notch 820 of the connector 1112 engages the ridge 509 of the first sear 108 and such that the first sear 108 rotates away from and disengages the hammer 110, allowing the hammer 110 to fall. In this manner, while the trigger 102 remains pulled in the actuation direction, the connector 1112 may take over for the disconnector 106 and maintains the first sear 108 in a position in which the first sear 108 cannot engage the hammer 110. After firing the firearm utilizing the trigger system 1100 in the fully-automatic mode, the hammer 110 may be driven back such that the protrusion 616 of the hammer 110 engages the searing protrusion 908 of the second sear 1114. Such engagement initially may cause the second sear 1114 to rotate downward and then, once the protrusion 616 has passed the searing protrusion 908, the second sear 1114 may rotate upward such that the searing protrusion 908 enters the recess 614 and engages the protrusion 616, as shown in FIGS. 29H and 291, thereby searing the hammer 110. At this point, fully-automatic cycling of the trigger system 1100 may be carried out by the second sear 1114, the hammer 110, and the carrier of the bolt-carrier group. FIGS. 29J-29L show the trigger system 1100 and the components thereof during a subsequent firing of the trigger system 1100 in the fully-automatic mode (i.e., while the trigger 102 remains pulled in the actuation direction). As shown, the bolt-carrier protrusion 918 of the second sear 1114 may be struck by the carrier as the bolt-carrier group returns forward such that the second sear 1114 rotates downward, thereby causing the searing protrusion 908 of the second sear 1114 to disengage the protrusion 616 of the hammer 110 and allowing the hammer to fall. Such operation of the trigger system 1100 in the fully-automatic mode may continue in this manner until the trigger 102 is released, at which point the trigger system 110 may return to the arrangement shown in FIGS. 29A-29D.

One drawback associated with certain existing trigger systems configured for use in both a semi-automatic mode and a fully-automatic mode is that the trigger pull weight may be significantly higher when the trigger system is in the fully-automatic mode as compared to when the trigger system is in the semi-automatic mode. This issue often occurs because, when the trigger system is operated in the semi-automatic mode, actuation of the trigger may need to overcome the resistance of one or more springs, and when the trigger is operated in the fully-automatic mode, actuation of the trigger may need to overcome that same resistance as well as the resistance of one or more additional springs that are active in the fully-automatic mode. As a result, the higher trigger pull weight in the fully-automatic mode may provide an undesirable user experience, which may adversely affect precision in shooting the firearm.

The trigger system 1100 advantageously may avoid this drawback in view of how the trigger system 1100 operates in the fully-automatic mode as compared to the semi-automatic mode. Notably, in view of the configuration of the trigger system 1100, the same springs providing resistance to actuation of the trigger 102 may be active whether the trigger system 1100 is in the semi-automatic mode or the fully-automatic mode. As a result, the trigger pull weight when the trigger system 1100 is in the fully-automatic mode may be the same as or nearly the same as the trigger pull weight when the trigger system 1100 is in the semi-automatic mode, thereby providing a user with a consistent or nearly consistent feel during actuation of the trigger 102. According to the illustrated example of the trigger system 1100, although the same springs are active in the semi-automatic mode and the fully-automatic mode, the trigger pull weight may be slightly lower in the fully-automatic mode. This may occur because, when the trigger system 1100 is switched from the semi-automatic mode to the fully-automatic mode by rotating the selector 1116, as described above, the engagement between the connector 1112 and the selector 1116 may cause the connector 1112 to rotate to a position in which the second spring 1326 and the second plunger 1328 are slightly more compressed in the direction of trigger actuation, thereby providing slightly less resistance to actuation of the trigger 102 in the fully-automatic mode. In this manner, the trigger system 1100 may have a first pull weight for trigger actuation in the semi-automatic mode and a second pull weight for trigger actuation in the fully automatic mode. In some examples, as described above, the second pull weight may be less than the first pull weight. In some examples, the second pull weight may be less than but within 50% of the first pull weight. In some examples, the second pull weight may be less than but within 35% of the first pull weight. In some examples, the second pull weight may be less than but within 25% of the first pull weight. In some examples, the second pull weight may be less than but within 15% of the first pull weight. In some examples, the second pull weight may be less than but within 10% of the first pull weight. In some examples, the second pull weight may be less than but within 5% of the first pull weight. In some examples, the second pull weight may be less than but within 2% of the first pull weight. In some examples, the second pull weight may be less than but within 1% of the first pull weight. According to another example of the trigger system 1100, although the same springs may be active in the semi-automatic mode and the fully-automatic mode, the trigger pull weight in the fully-automatic mode and the trigger pull weight in the semi-automatic mode may be equal, or nearly equal, to one another. This may occur, for example, when the second spring 1326 is eliminated and an alternative mechanism is used for moving the connector 1112 relative to the selector 1116, as described above, such that resistance to actuation of the trigger 102 is the same, or nearly the same, in the fully-automatic mode and the semi-automatic mode. In this manner, the trigger system 1100 may have a first pull weight for trigger actuation in the semi-automatic mode and a second pull weight for trigger actuation in the fully automatic mode, with the second pull weight being equal, or nearly equal, to the first pull weight. In some examples, the second pull weight may be equal to the first pull weight. In some examples, the second pull weight may be less than or greater than but within 50% of the first pull weight. In some examples, the second pull weight may be less than or greater than but within 35% of the first pull weight. In some examples, the second pull weight may be less than or greater than but within 25% of the first pull weight. In some examples, the second pull weight may be less than or greater than but within 15% of the first pull weight. In some examples, the second pull weight may be less than or greater than but within 10% of the first pull weight. In some examples, the second pull weight may be less than or greater than but within 5% of the first pull weight. In some examples, the second pull weight may be less than or greater than but within 2% of the first pull weight. In some examples, the second pull weight may be less than or greater than but within 1% of the first pull weight. It will be appreciated that the difference between the second pull weight and the first pull weight may be impacted by the design and characteristics of the springs that provide resistance to actuation of the trigger 102 and any differences in compression of such springs when the trigger system 1100 is in the fully-automatic mode as compared to the semi-automatic mode. Ultimately, such springs and the overall trigger system 1100 may be designed such that the second pull weight and the first pull weight are nearly the same, thereby providing a nearly consistent feel for the user in both the fully-automatic mode and the semi-automatic mode.

Figure 30B:
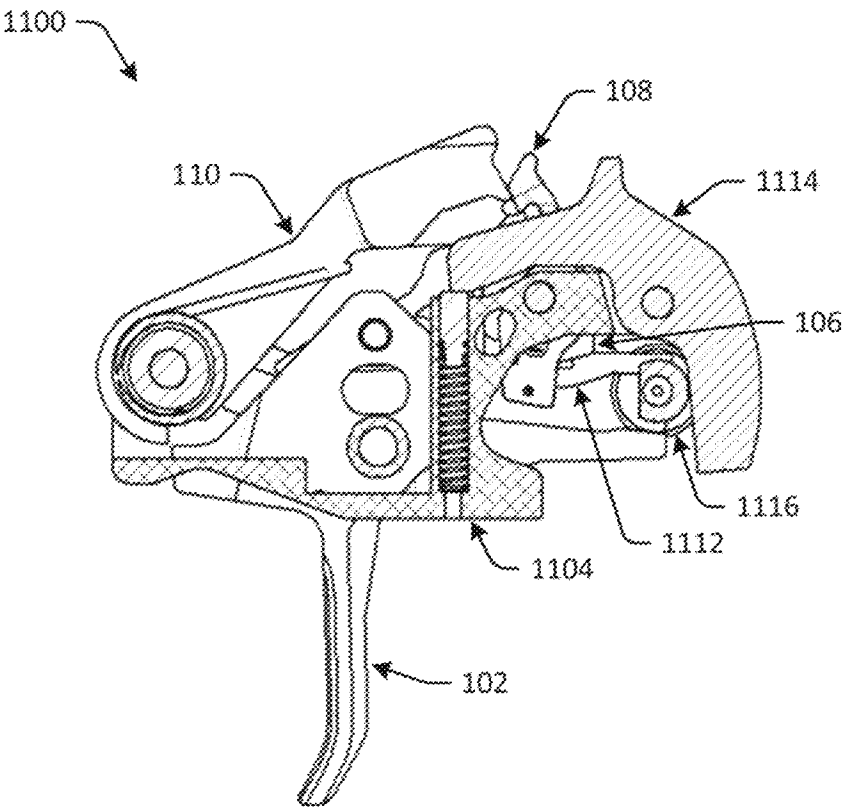
FIGS. 30A-30C are side views, including some cross-sectional side views, of the dynamically balanced trigger system of FIG. 23A in states of actuation in a safe mode of the trigger system according to one or more examples of the disclosure.
Figure 30A:
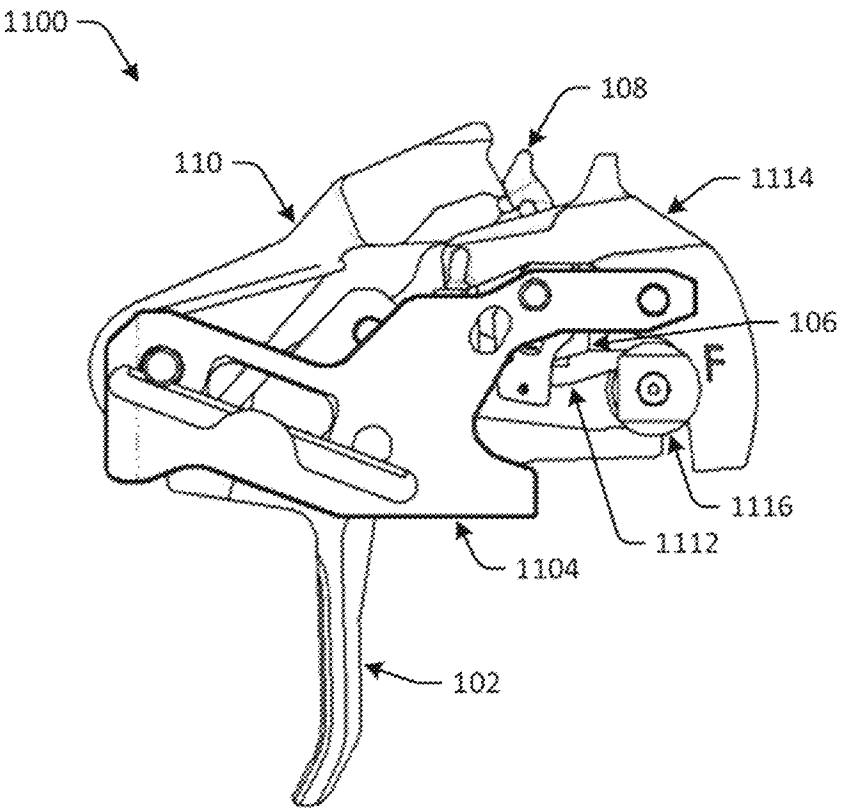
Figure 30C:
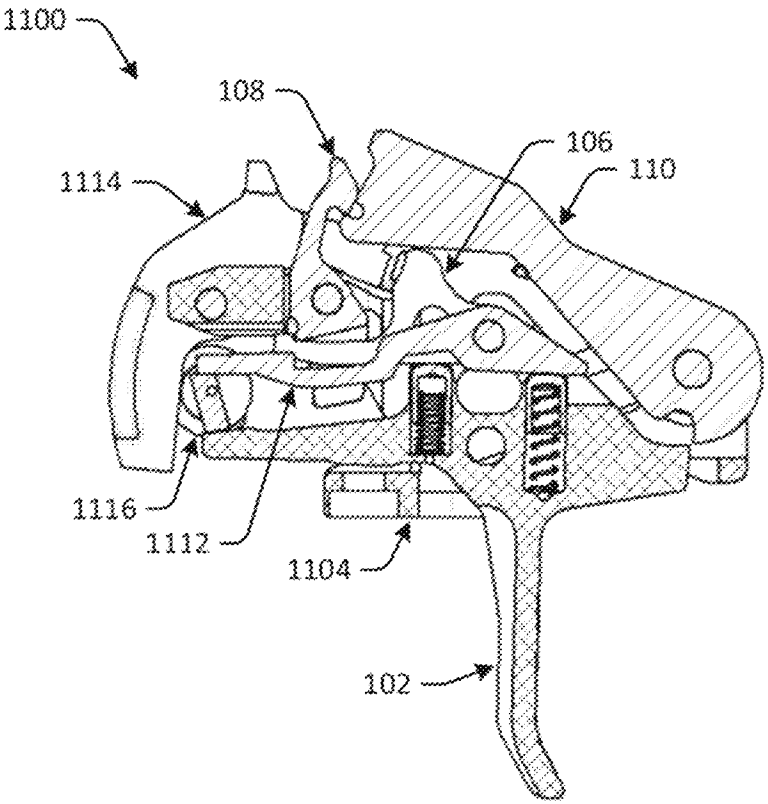
Figure 31A:
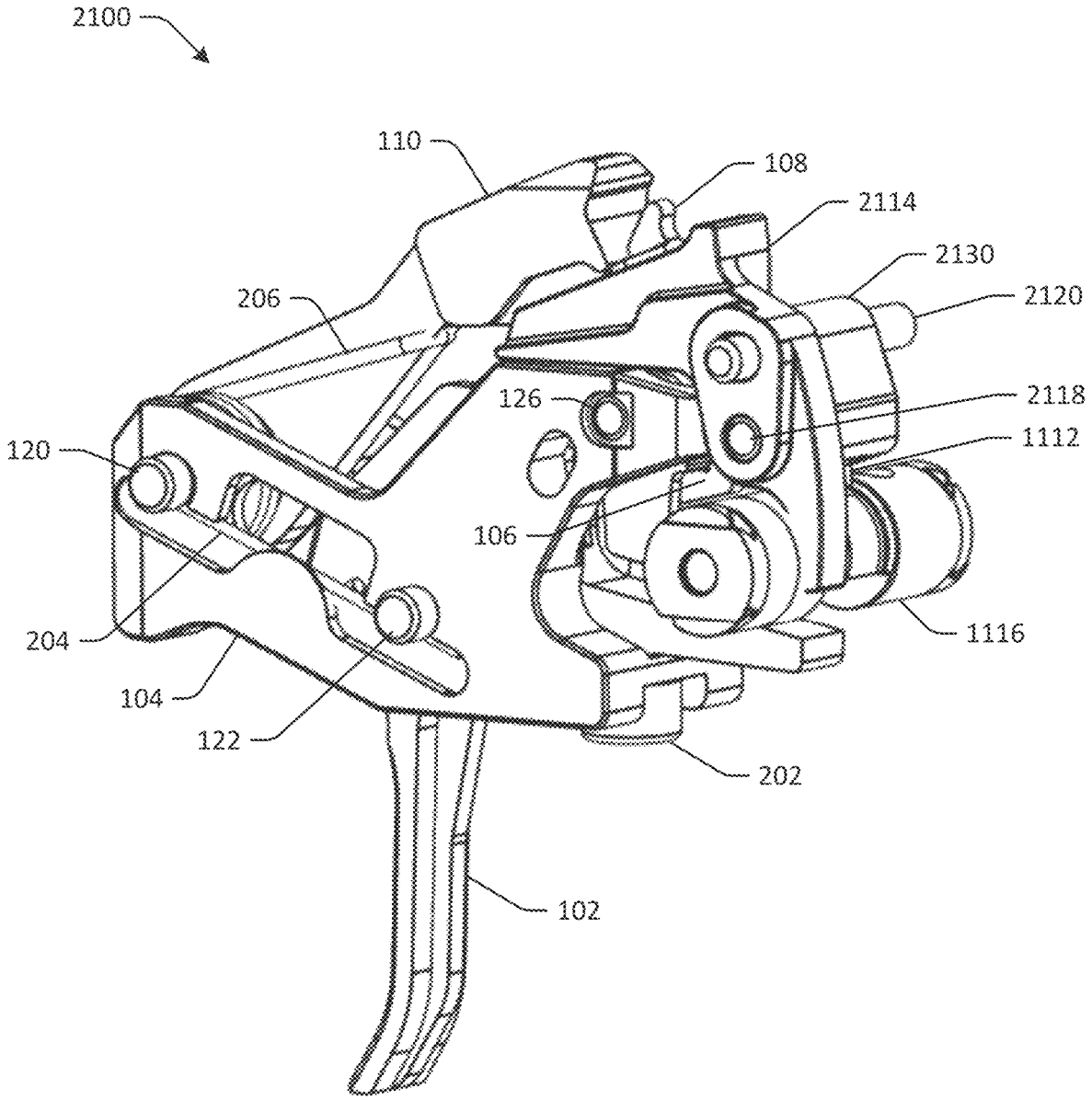
FIG. 31A is a perspective view of a dynamically balanced trigger system according to one or more examples of the disclosure.
Figure 31B:
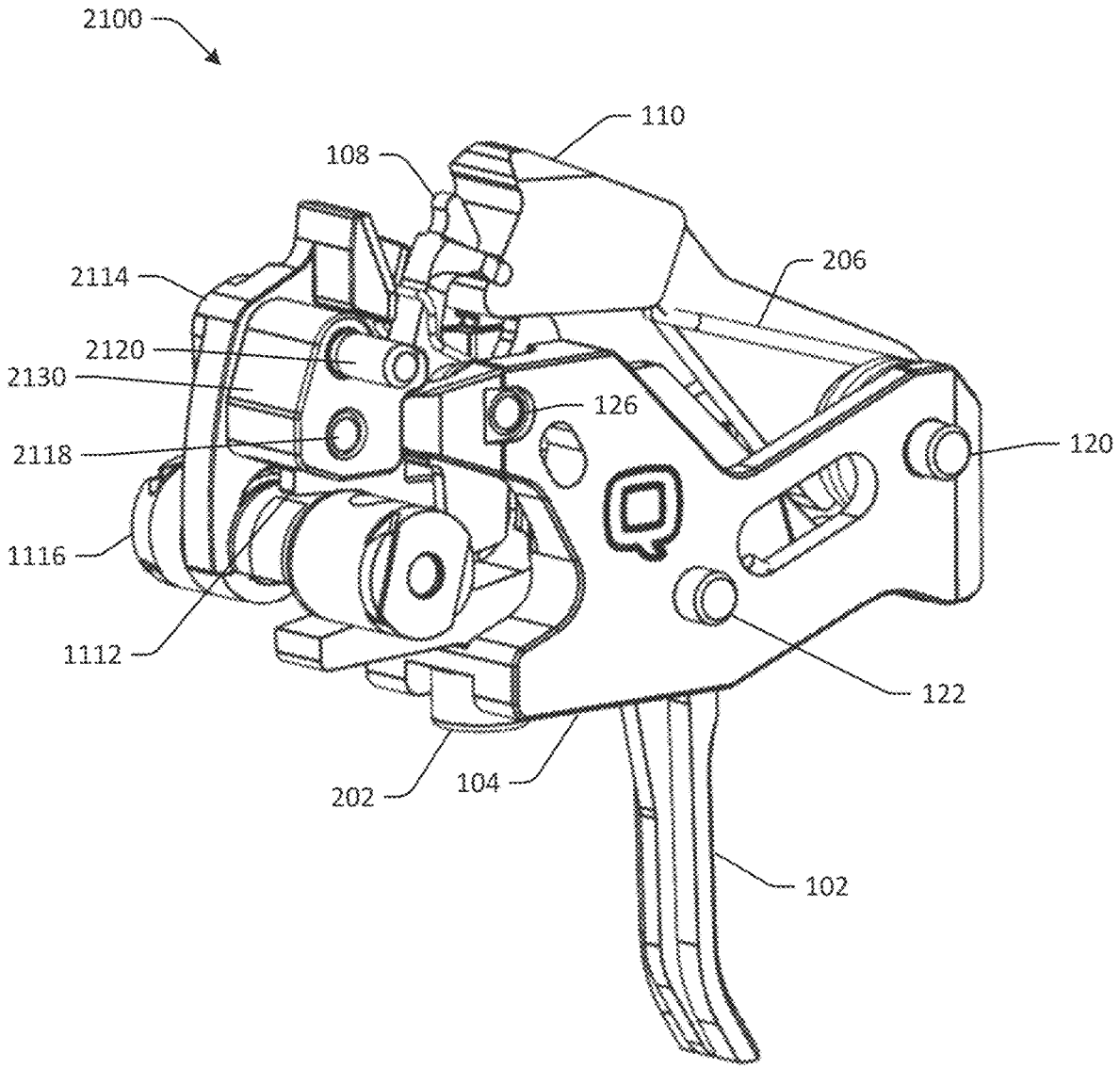
FIG. 31B is another perspective view of the dynamically balanced trigger system of FIG. 31A according to one or more examples of the disclosure.
Figure 31C:
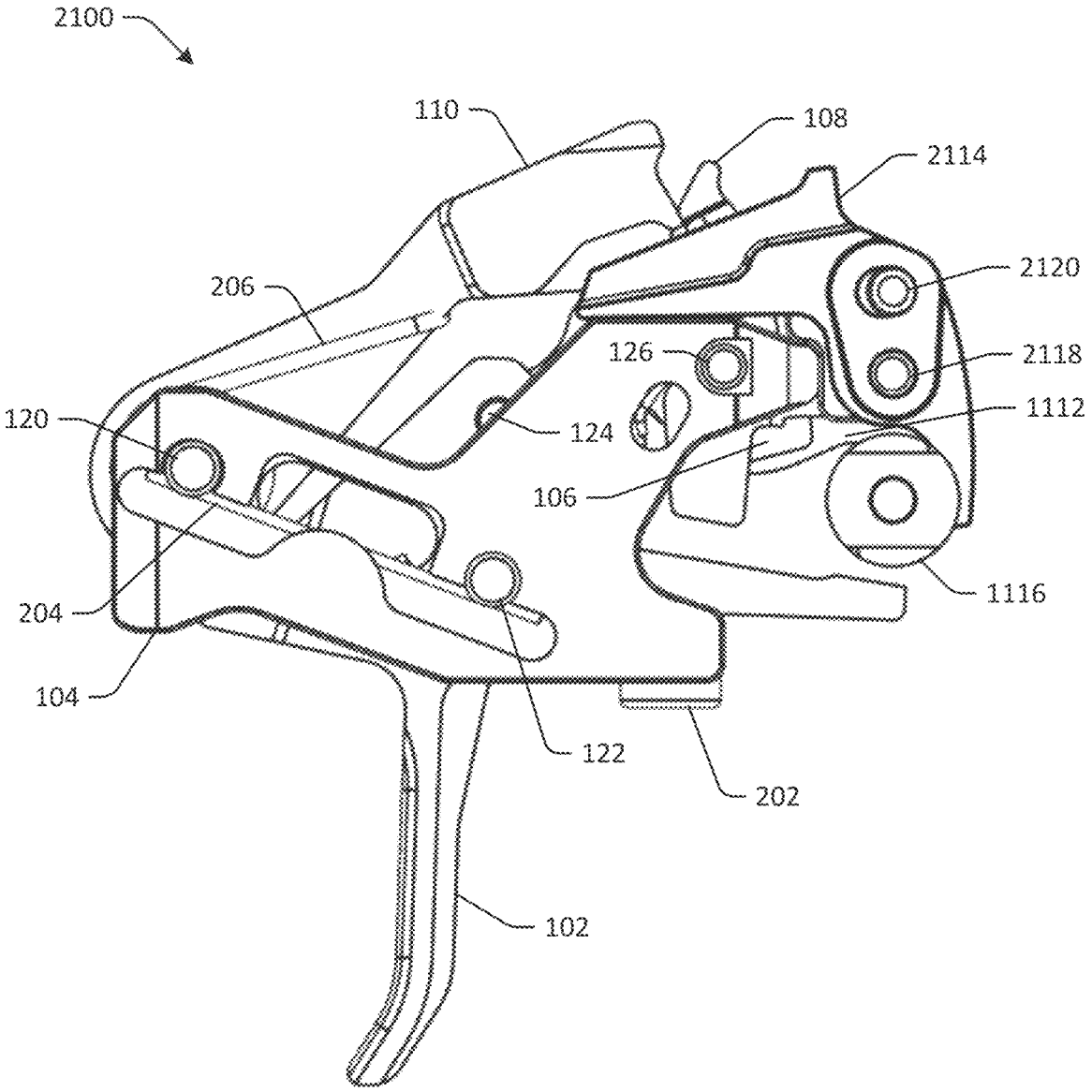
FIG. 31C is a side view of the dynamically balanced trigger system of FIG. 31A according to one or more examples of the disclosure.
Figure 31D:
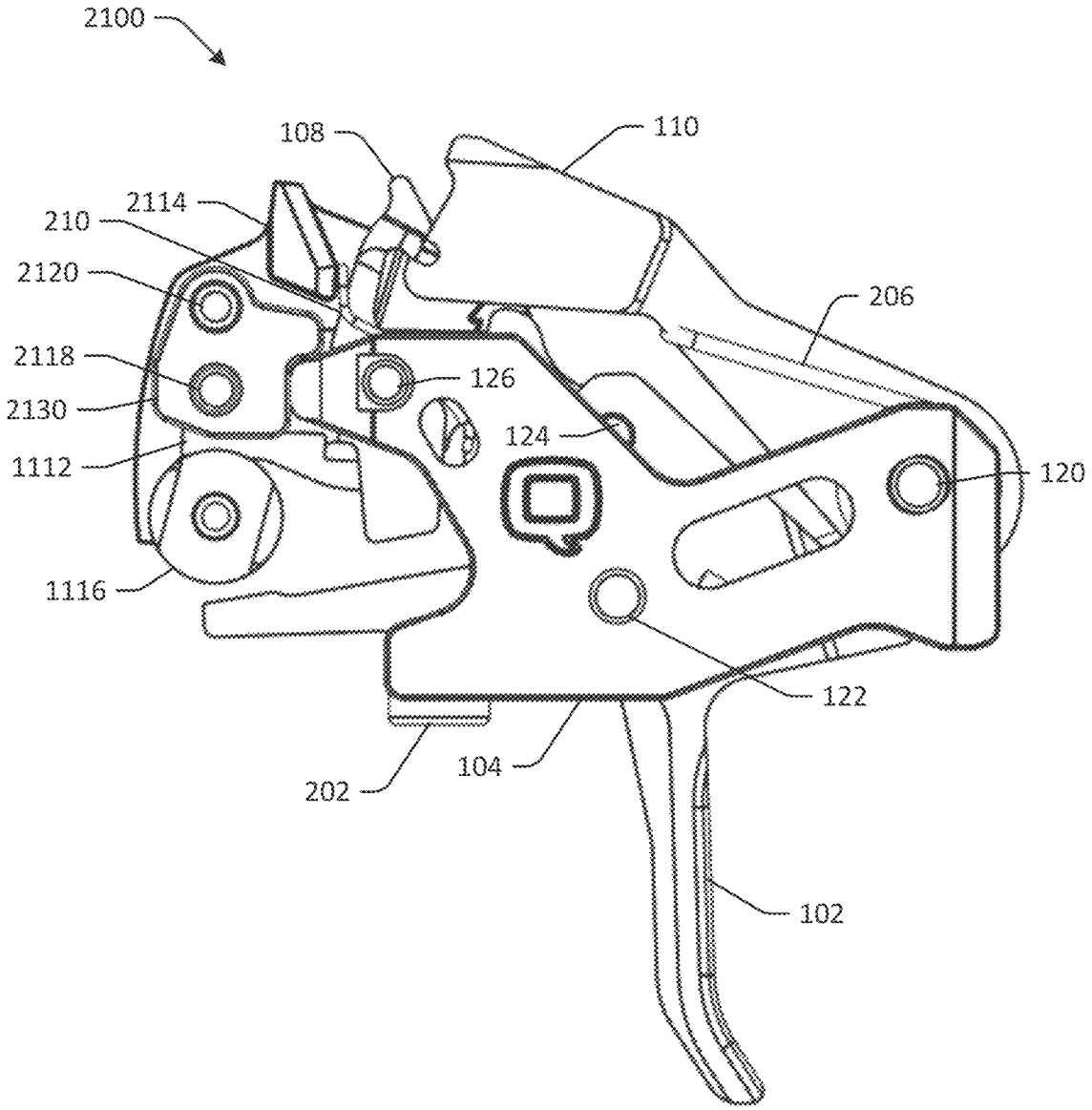
FIG. 31D is another side view of the dynamically balanced trigger system of FIG. 31A according to one or more examples of the disclosure.
Figure 31E:
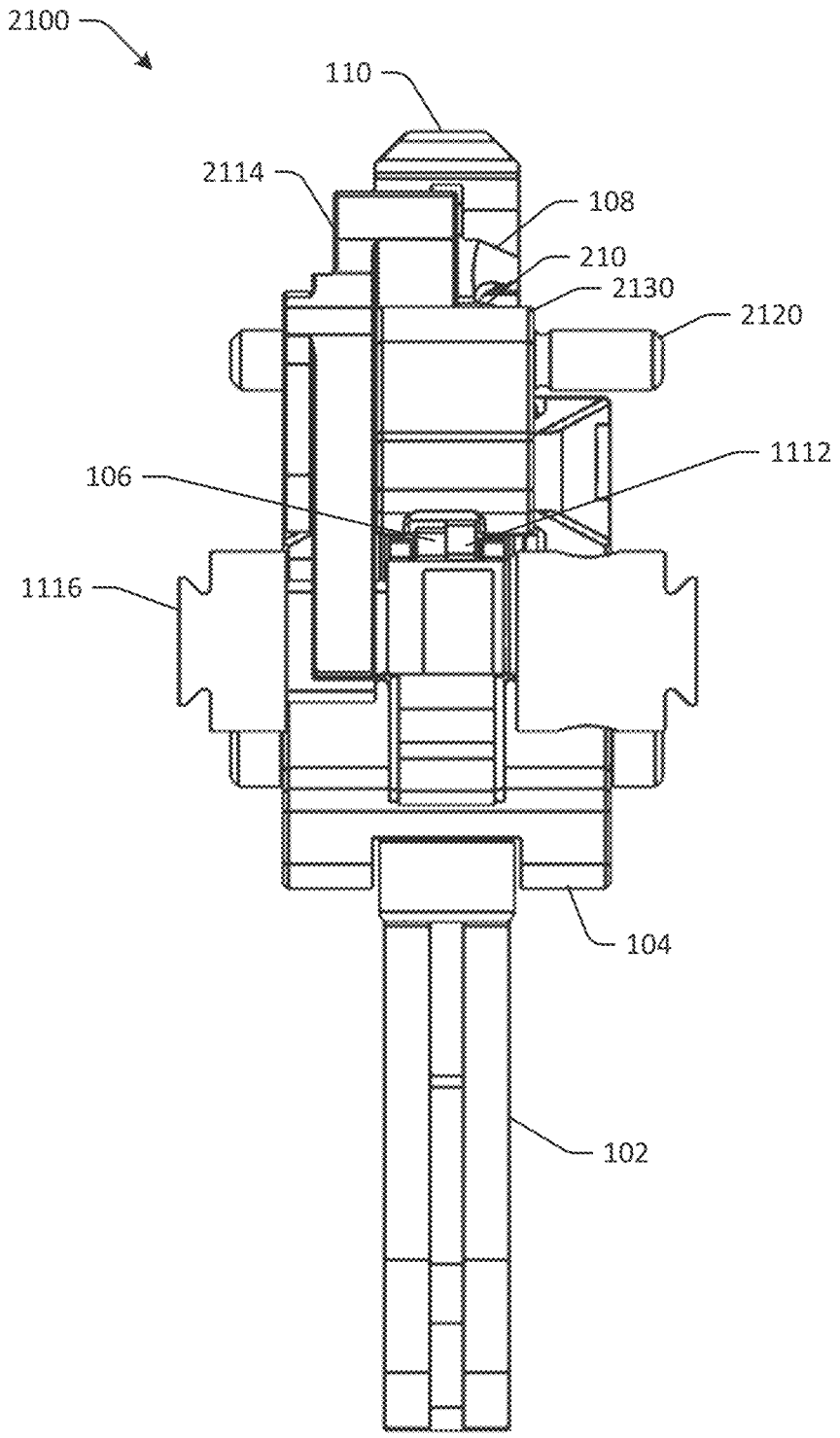
FIG. 31E is a rear view of the dynamically balanced trigger system of FIG. 31A according to one or more examples of the disclosure.
Figure 31F:
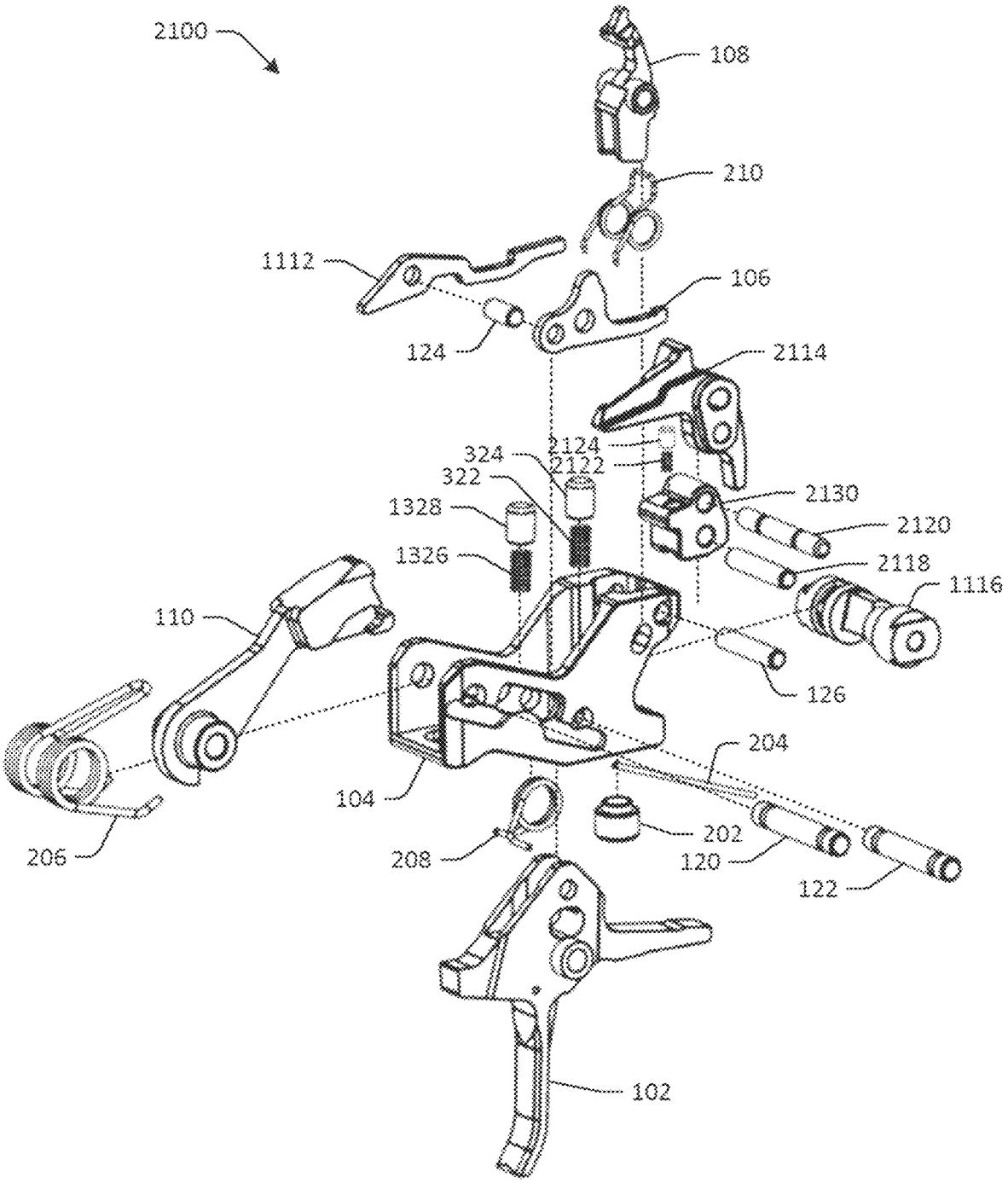
FIG. 31F is an exploded view of the dynamically balanced trigger system of FIG. 31A according to one or more examples of the disclosure.
Figure 32A:
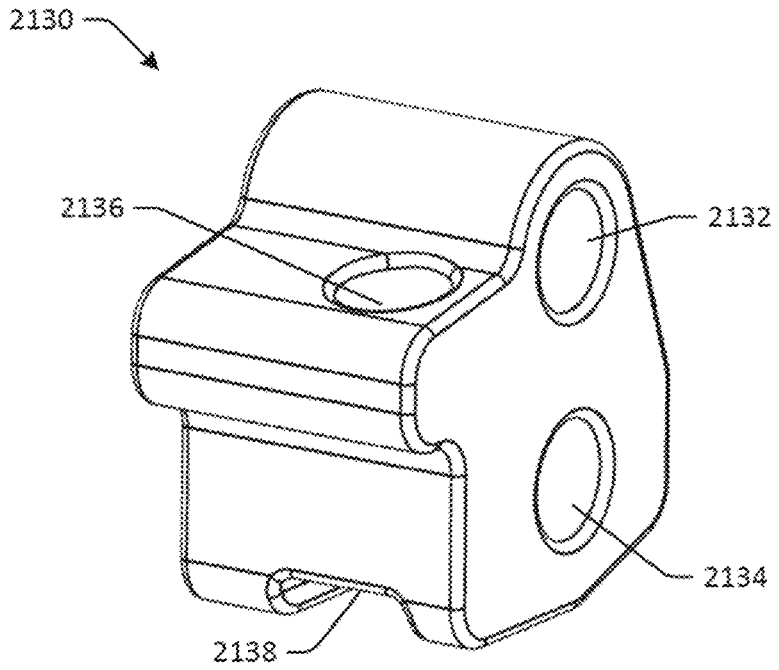
FIG. 32A is a perspective view of a second sear housing according to one or more examples of the disclosure.
Figure 32B:
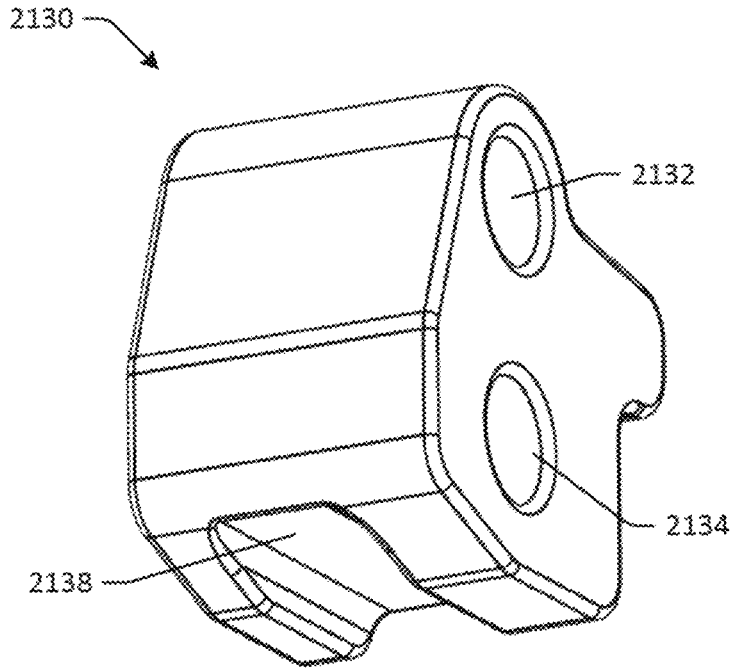
FIG. 32B is another perspective view of the second sear housing according to one or more examples of the disclosure.
Figure 33A:
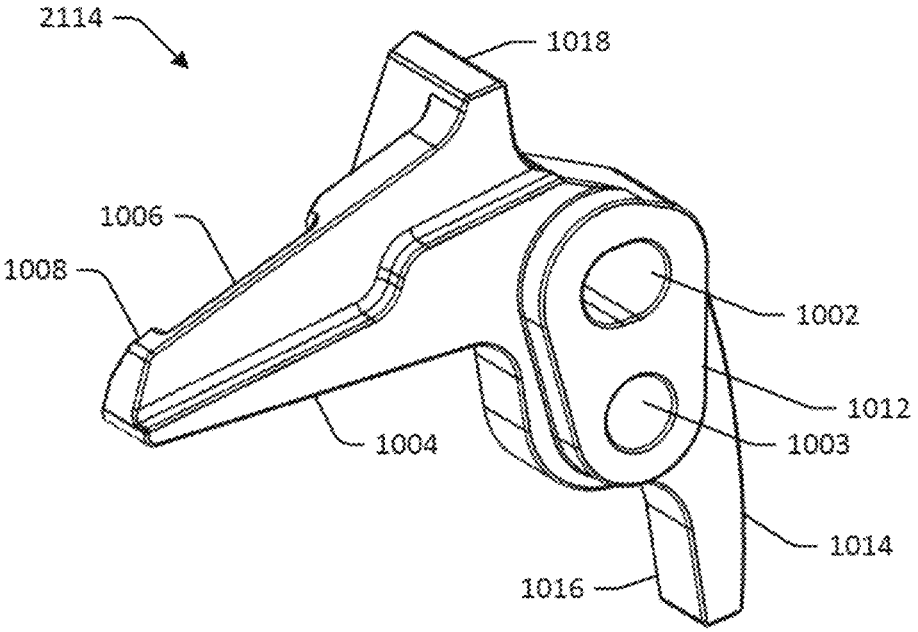
FIG. 33A is a perspective view of a second sear according to one or more examples of the disclosure.
Figure 33B:
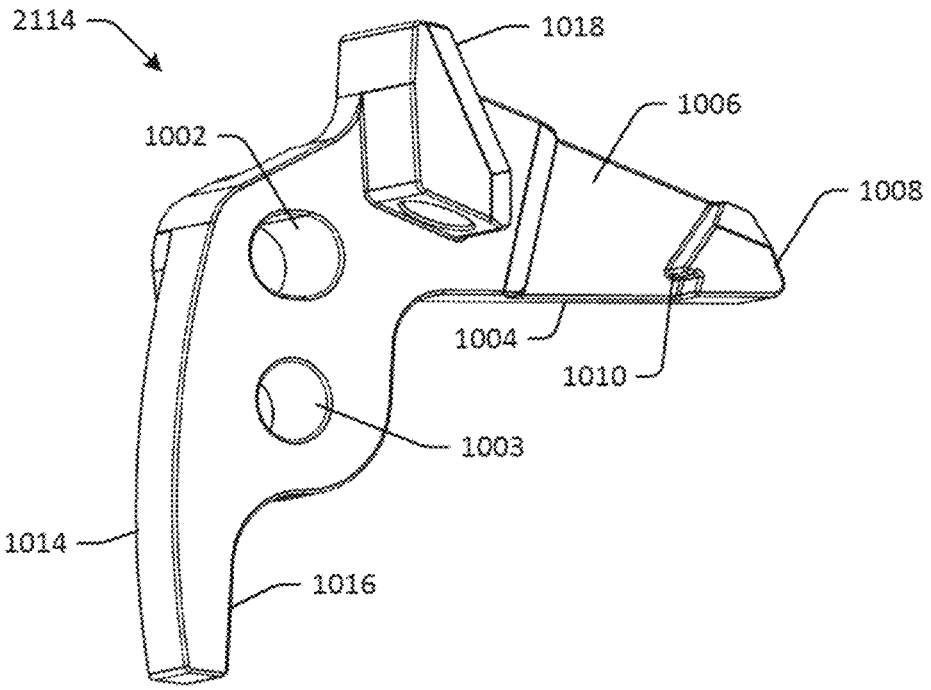
FIG. 33B is another perspective view of the second sear according to one or more examples of the disclosure.

FIGS. 30A-30C show the trigger system 1100 and the components thereof after the selector 1116 has been rotated to its safe position corresponding to the safe mode of the trigger system 1100. Rotation of the selector 1116 to the safe position may cause the second sear 1114 to rotate downward, as the selector protrusion 916 of the second sear 1114 engages the curved surface 1122 of the first region 1120 of the selector 1116, as shown in FIG. 30B, and thus the second sear 1114 may be in an inactive state. Additionally, rotation of the selector 1116 to the safe position may cause the arm 808 of the connector 1112 to rotate downward, under the bias of the second spring 1326 and the second plunger 1328, such that the distal portion 810 of the connector 1112 engages the planar surface 1136 of the second region 1130 of the selector 1116, as shown in FIG. 30C, and this the connector 1112 may be in an inactive state. Meanwhile, as shown, the first sear 108 may engage and sear the hammer 110, and the disconnector 106 may engage the first sear 108. Additionally, the selector 1116 may prevent actuation of the trigger 102, as the tail 308 of the hammer 102 engages the curved surface 1132 of the selector 1116, preventing rotation of the trigger 102 in the actuation direction.

As described, the components of the trigger system 1100 may be pre-assembled in the manner shown and then inserted within and coupled to the lower receiver of a firearm. In particular, the trigger system 1100 may be coupled to the lower receiver by the hammer pin 120 and the trigger pin 122 being inserted into mating holes in opposing walls of the lower receiver. A first wall of the lower receiver may have a first hole for receiving one end of the hammer pin 120 and a second hole for receiving one end of the trigger pin 122, while an opposite second wall of the lower receiver may have a first hole for receiving the other end of the hammer pin 120 and a second hole for receiving the other end of the trigger pin 122. In this manner, the lower receiver may be considered to have a "two-hole" configuration, one for the hammer pin 120 and one for the trigger pin 122, with the connections between the hammer pin 120, the trigger pin 122, and the respective holes of the lower receiver being sufficient for securely assembling the trigger system 1100 with respect to the lower receiver. In some instances, the lower receiver for certain firearms configured to operate in a semi-automatic mode and a fully-automatic mode may have a "three-hole" configuration intended to use three pins for securely assembling a trigger system with respect to the lower receiver.

With reference to FIGS. 31A-33B, the present disclosure further provides a dynamically balanced trigger system 2100 for a firearm, with the trigger system 2100 being configured for operating in a fully-automatic mode as well as a semi-automatic mode while also being configured for use with a lower receiver having a three-hole configuration. Certain similarities and differences between the trigger system 2100 and the trigger systems 100, 1100 described above will be appreciated by one skilled in the art based on comparison of the corresponding figures and the present description. In some embodiments, as shown, the trigger system 2100 may include certain components that are the same as, or similar to, corresponding components of the trigger systems 100, 1100 and thus may provide the same or similar advantages as those described above. As shown, the trigger system 2100 may include a trigger 102, a housing 104, a disconnector 106, a sear (which may be referred to as a "first sear") 108, a hammer 110, a hammer pin 120, a trigger pin 122, a disconnector pin 124, a sear pin (which may be referred to as a "first sear pin") 126, a bumper 202, a pin spring 204, a hammer spring 206, a trigger spring 208, and a sear spring (which may be referred to as a "first sear spring") 210, each of which may be configured in the same manner described above with respect to the trigger system 100. The trigger system 2100 also may include a connector 1112 and a selector 1116, each of which may be configured in the same manner described above with respect to the trigger system 1100. Further, the trigger system 1100 may include a second sear 2114, a second sear pin 2118 (which also may be referred to as a "second sear pivot pin"), a second sear limiting pin 2120, a second sear spring 2122, a second sear plunger 2124, and a second sear housing 2130, as shown.

As described above, the trigger system 100 may be configured for semi-automatic operation, with the trigger 102, the disconnector 106, the sear 108, the hammer 110, the hammer spring 206, the trigger spring 208, and the sear spring 210 thereof being configured to provide a desirable tactile feel during actuation of the trigger 102, thereby enhancing precision when the corresponding firearm is operated in semi-automatic mode. For the trigger system 2100, similar to the trigger system 1100, these same components—the trigger 102, the disconnector 106, the first sear 108, the hammer 110, the hammer spring 206, the trigger spring 208, and the first sear spring 210—may be used for semi-automatic operation, similarly providing a desirable tactile feel during actuation of the trigger 102. As described herein, during semi-automatic operation of the trigger system 2100, the connector 1112 and the second sear 2114 may be inactive so as not to affect movement of the other components. In contrast, during fully-automatic operation of the trigger system 2100, the connector 1112 and the second sear 2114 may be active, with the connector 1112 selectively engaging the first sear 108 and with the second sear 2114 selectively engaging the hammer 110, while the disconnector 106 and the first sear 108 may be inactive. In view of the disclosed configuration utilizing a disconnector, a connector, and two sears, the trigger system 2100 may be capable of fully-automatic operation while still providing a desirable tactile feel during actuation of the trigger 102 when the trigger system 2100 is operated in semi-automatic mode.

In some embodiments, as shown, the trigger 102 may be configured in the manner described above, with the trigger 102 comprising a main body 302, a bore 304, a nose 306, a tail 308, a shoe 310, a bore 312, a bore 314, a channel 316, a pair of walls 317, a first cavity 320, and a second cavity 318. As described above, the first cavity 320 may have a first spring 322 and a first plunger 324, together forming a first spring-loaded plunger, received therein, which biases an arm 708 of the disconnector 106 away from the trigger 102 and toward the first sear 108. As shown, for the trigger system 2100, the second cavity 318 may have a second spring 1326 and a second plunger 1328, together forming a second spring-loaded plunger, received therein, which biases an arm 808 of the connector 1112 away from the first sear 108 and toward the selector 1116. In some examples, the second plunger 1328 may be eliminated, such that the second spring 1326 directly engages and biases the connector 1112. Although the second spring 1326 is illustrated as a coiled compression spring, other types of springs may be used for the second spring 1326. In some examples, the second spring 1326 and the second plunger 1328 both may be eliminated, and an alternative mechanism, such as a cam mechanism, may be used for causing the connector 1112 to move relative to the selector 1116 to different positions for the different operating modes of the trigger system 1100.

In some embodiments, the housing 104 may be configured in the same manner as in the trigger system 100. As shown, the housing 104 may comprise a first slot 402, a recess 404, a recessed surface 405, a second slot 406, a protrusion 408, a lip 409, an aperture 410 for receiving the hammer pin 120, an aperture 412 for receiving the first sear pin 126, an aperture 414 for receiving the trigger pin 122, a hole 220 for receiving the bumper 202, and first and second wings 330A, 330B for selectively engaging the hammer 110.

In some embodiments, as shown, the disconnector 106 may be configured in the manner described above with respect to the trigger systems 100, 1100, with the disconnector 106 comprising a bore 702 for receiving the disconnector pin 124, a bore 704 for weight distribution, an arm 708 for selectively engaging the first sear 108, a protrusion 710 for selectively engaging the hammer 110, and a notch 720 for selectively engaging the ridge 509 of the first sear 108.

In some embodiments, as shown, the first sear 108 may be configured in the manner described above with respect to the trigger systems 100, 1100, with the first sear 108 comprising a guide 502 for guiding the hammer 110, an engagement ridge 504 for selectively engaging the ledge 604 of the hammer 110, a channel 506 defined between a pair of legs 507, a bore 508 for receiving the first sear pin 126, a ridge 509 for selectively engaging the notch 720 of the first disconnector 106, and a sear face 510 for selectively engaging the hammer face 612 of the hammer 110.

In some embodiments, as shown, the hammer 110 may be configured in the manner described above with respect to the trigger systems 100, 1100, with the hammer 110 comprising a platform 602, a ledge 604 for selectively engaging the engagement ridge 504 of the first sear 108, a notch 606 for selectively engaging the nose 306 of the trigger 102, a head 608, a bore 610 for receiving the hammer pin 120, and a hammer face 612 for selectively engaging the sear face 510 of the first sear 108. A recess 614 may be defined along a lateral side of the head 608, with a protrusion 616 disposed adjacent the recess 614 and extending from the ledge 604. As shown, the protrusion 616 may be configured for selectively engaging a searing protrusion 1008 of the second sear 2114. In this manner, as described further below, the ledge 604 may include a first searing surface that is utilized when the first sear 108 is active, and the protrusion 616 may include a second searing surface 618 that is utilized when the second sear 2114 is active. As shown, the hammer 110 also may comprise an engagement surface 620 disposed adjacent the recess 614 and configured for selectively engaging the searing protrusion 1008 of the second sear 2114, from above, when the hammer 110 rotates towards its cocked position.

In some embodiments, as shown, the connector 1112 may be configured in the manner described above with respect to the trigger system 1100, with the connector 1112 comprising a bore 802, a tail 804, a cutout 806, an arm 808 having a distal portion 810, and a notch 820. The connector 1112 may be connected to the trigger 102 by the disconnector pin 124 inserted through the bores 312 of the trigger 102 and through the bore 802 of the connector 1112. The connector 1112 may be disposed within the channel 316 of the trigger 102 and adjacent the disconnector 106. The tail 804 may rest on top of the second plunger 1328 and the second spring 1326 which bias the connector 1112 to rotate about the disconnector pin 124 such that the distal portion 810 of the arm 808 engages the selector 1116. The cutout 806 may be positioned such that the connector 1112 does not contact the first spring 322 or the first plunger 324. The connector 1112 has two planes of motion, that is, it both rotates about the disconnector pin 124 and moves forward to back due to the motion of the trigger 102 moving the disconnector pin 124. As noted above, the connector 1112 may be inactive when the trigger system 2100 is in the semi-automatic mode, and the connector 1112 may be active when the trigger system 2100 is in the fully-automatic mode. In other words, the connector 1112 may be configured to not engage the first sear 108 at all when the trigger system 2100 is in the semi-automatic mode, and the connector 1112 may be configured to selectively engage the first sear 108 when the trigger system 2100 is in the fully-automatic mode. As described below, when the trigger system 2100 is in the fully-automatic mode and the trigger 102 is actuated, the connector 1112 may move into engagement with the first sear 108 such that the notch 820 engages the ridge 508 of the first sear 108.

Certain similarities and differences between the second sear 2114 of the trigger system 2100 and the second sear 1114 of the trigger system 2100 will be appreciated from the following description and the corresponding drawings. In some embodiments, as shown, the second sear 2114 may comprise a bore 1002, a bore 1003, an arm 1004, a recess 1006, a searing protrusion 1008 having a hook 1010, a stabilizing protrusion 1012, a tail 1014, a selector protrusion 1016, and a bolt-carrier protrusion 1018. The second sear 2114 may be rotationally coupled to the second sear housing 2130 by the second sear pin 2118 inserted through the bore 2134 of the second sear housing 2130 and through the bore 1003 of the second sear 2114. The bore 1002 may be provided to couple the second sear 2114 to the second sear housing 2130 by the second sear limiting pin 2120. As shown, the bore 1002 of the second sear 2114 may be formed as an elongated slot, such that the bore 1002 may limit rotational travel of the second sear 2114 relative to the second sear housing 2130 via the second sear limiting pin 2120. The arm 1004 may rest on top of the second sear plunger 2124 and the second sear spring 2122 which bias the second sear 2114 to rotate about the second sear pin 2118 such that the selector protrusion 1016 of the tail 1014 engages the selector 1116. As noted above, the second sear 2114 may be inactive when the trigger system 2100 is in the semi-automatic mode, and the second sear 2114 may be active when the trigger system 2100 is in the fully-automatic mode. In other words, the second sear 2114 may be configured to not engage the hammer 110 at all when the trigger system 2100 is in the semi-automatic mode, and the second sear 2114 may be configured to selectively engage the hammer 110 when the trigger system 2100 is in the fully-automatic mode. As described below, when the trigger system 2100 is in the fully-automatic mode, the searing protrusion 1008 may selectively engage the engagement surface 620 of the hammer 110 as the hammer 110 moves back toward its cocked position, and the searing protrusion 1008 may selectively engage the protrusion 616 of the hammer 110 when the hammer 110 is in its cocked position. In particular, the hook 1010 of the searing protrusion 1008 may engage the protrusion 616 and retain the hammer 110 in its cocked position until the bolt-carrier protrusion 1018 is contacted by the bolt carrier of the firearm, causing the second sear 2114 to rotate, against the biasing force provided by the second sear plunger 2124 and the second sear spring 2122, to a position at which the searing protrusion 1008 disengages the protrusion 616 of the hammer 110.

The second sear housing 2130 may be configured to be rotationally coupled to the second sear 2114 via the second sear pin 2118 and also to be coupled to the lower receiver via the second sear limiting pin 2120. In this manner, the second sear housing 2130 may secure the second sear 2114 relative to the lower receiver and also relative to the housing 104. In some embodiments, as shown, the second sear housing 2130 may abut the housing 104, but the second sear housing 2130 may be separate from and not directly coupled to the housing 104. In some embodiments, as shown, a portion of the second sear housing 2130 abutting the housing 104 may be shaped to inhibit rotational movement of the second sear housing 2130 relative to the housing 104. As shown, the second sear housing 2130 may include a bore 2132, a bore 2134, a bore 2136, and a recess 2138. As noted above, the bore 2132 may be configured to receive the second sear limiting pin 2120 therethrough for coupling the second sear housing 2130 to the lower receiver, in particular the third holes in the walls of the lower receiver. The bore 2134 may be provided to rotationally couple the second sear 2114 to the second sear housing 2130 by the second sear pin 2118. As shown, the bore 2136 may be configured to receive the second sear spring 2122 and the second sear plunger 2124 therein. The second sear spring 2122 and the second sear plunger 2124, together forming a spring-loaded plunger, may bias the arm 1004 of the second sear 2114 away from the second sear housing 2130. The recess 2138 may be provide clearance for the disconnector 106 and/or the connector 1112 such that the second sear housing 2130 does not interfere with movement of the disconnector 106 and/or the connector 1112 during operation of the trigger assembly 2100.

In some embodiments, as shown, the selector 1116 may be configured in the manner described above with respect to the trigger system 1100, with the selector 1116 comprising a first region 1120 configured for selectively engaging the second sear 2114, a second region 2130 configured for selectively engaging the connector 1112, and a third region 1140 configured for selectively engaging one or more mating components of the firearm. The selector 1116 may be configured to be adjusted relative to the housing 1104 to set the trigger system 1100 in each of a semi-automatic mode, a fully-automatic mode, and a safe mode. For example, the selector 1116 may be a rotary selector that is rotationally coupled to the lower receiver of the firearm and configured to rotate between respective rotational positions corresponding to the semi-automatic mode, the fully-automatic mode, and the safe mode. The first region 1120 may include a plurality of features configured for selectively engaging the selector protrusion 1016 of the second sear 2114, which define respective positions of the second sear 2114 in each of the semi-automatic mode, the fully-automatic mode, and the safe mode when the second sear plunger 2124 and the second sear spring 2122 bias the second sear 2114 into engagement with the selector 2116. As shown, the first region 1120 may include a curved surface 1122 and a planar surface 1124. The curved surface 1122 may be configured to engage the selector protrusion 1016 of the second sear 2114 when the trigger system 2100 is in the semi-automatic mode and when the trigger system 2100 is in the safe mode. As described below, when the curved surface 1122 engages the second sear 2114, the second sear 2114 may be in an inactive position. The planar surface 1124 may be configured to engage the selector protrusion 1016 of the second sear 2114 when the trigger system 2100 is in the fully-automatic mode.

As described below, when the planar surface 1124 engages the second sear 2114, the second sear 2114 may be in an active position.

The second region 1130 may include a plurality of features configured for selectively engaging the distal portion 810 of the connector 1112, which define respective positions of the connector 1112 in each of the semi-automatic mode, the fully-automatic mode, and the safe mode when the second plunger 1328 and the second spring 1326 bias the connector 1112 into engagement with the selector 1116. As shown, the second region 1130 may include a curved surface 1132, a pair of planar surfaces 1134, 1136, and a channel 1138. The channel 1138 may be configured to receive the distal portion 810 of the connector 1112 when the trigger system 2100 is in the semi-automatic mode. As described below, when the channel 1138 receives the connector 1112, the connector 1112 may be in an inactive position. The curved surface 1132 may be configured to engage the distal portion 810 of the connector 1112 when the trigger system 2100 is in the fully-automatic mode. As described below, when the curved surface 1132 engages the connector 1112, the connector 1112 may be in an active position. The planar surface 1136 may be configured to engage the distal portion 810 of the connector 1112 when the trigger system 2100 is in the safe mode. As described below, when the planar surface 1136 engages the connector 1112, the connector 1112 may be in an inactive position. Additionally, the curved surface 1132 may be configured to engage the tail 308 of the trigger 102 when the trigger system 2100 is in the safe mode, as described below, thereby blocking actuation of the trigger 102 in the safe mode. The third region 1140 may include a plurality of features configured for selectively engaging one or more mating components of the firearm, such as a spring-loaded plunger, for releasably retaining a rotational position of the selector 1116. As shown, the third region 1140 may include a circumferential slot 1142 having three spaced-apart recesses 1144 each corresponding to one of the semi-automatic mode, the fully-automatic mode, and the safe mode.

When the trigger system 2100 is in the semi-automatic mode, the trigger system 2100 may operate and the components thereof may interact with one another in a manner similar to that described above for the trigger system 1100 with respect to FIGS. 28A-28F, according to one or more examples of the disclosure. The selector 1116 may be in a semi-automatic rotational position, corresponding to the semi-automatic mode of the trigger system 2100. As discussed above, during semi-automatic operation of the trigger system 2100, the connector 1112 and the second sear 2114 may be inactive, while the disconnector 106 and the first sear 108 may be active. In particular, with the selector 1116 in its semi-automatic rotational position, the second spring 1326 and the second plunger 1328 may bias the arm 808 of the connector 1112 away from the first sear 108 and into engagement with the selector 1116, such that the distal portion 810 of the connector 1112 is received within the channel 1138 of the second region 1130 of the selector 1116. In this manner, the arm 808 of the connector 1112 may be maintained in a position spaced apart from the first sear 108 such that the connector 1112 is in an inactive state and does not engage the first sear 108 during semi-automatic operation of the trigger system 1100. Additionally, with the selector 1116 in its semi-automatic rotational position, the second sear spring 2122 and the second sear plunger 2124 may bias the second sear 2114 into engagement with the selector 1116, such that the selector protrusion 1016 the second sear 2114 engages the curved surface 1122 of the first region 1120 of the selector 1116. In this manner, the arm 1004 of the second sear 2114 may be maintained in a position spaced apart from the hammer 110, at least partially compressing the second sear spring 2122 and the second sear plunger 2124, such that the second sear 2114 is in an inactive state and does not engage the hammer 110 during semi-automatic operation of the trigger system 2100.

As discussed above, when the trigger system 2100 operates in the semi-automatic mode, the trigger 102, the disconnector 106, the sear 108, and the hammer 110 may operate in the same manner described above with respect to FIGS. 18-22 for the trigger system 100. After firing a firearm utilizing the trigger system 2100 in the semi-automatic mode, the hammer 110 may be driven in an initial motion back into engagement with the protrusion 710 of the disconnector 106, which motion may be limited by the hammer 110 contacting one or more of the wings 330A and/or 330B of the housing 1104. Additionally, the hammer 110 may engage the guide 502 of the first sear 108, which may guide the hammer 110 such that the sear face 510 of the first sear 108 engages the hammer face 612 of the hammer 110. The hammer 110, under the bias of the hammer spring 206, then may move into engagement with the first sear 108 such that the first searing surface of the platform 602 of the hammer 110 engages the engagement ridge 504 of the sear 108. Meanwhile, the disconnector 106, under the bias of the first spring 322 and the first plunger 324, may move upward such that the arm 708 of the disconnector 106 engages the first sear 108, although the notch 720 of the disconnector 106 is spaced apart from the ridge 509 of the first sear 108, and such that the protrusion 710 of the disconnector 106 engages the hammer 110, as shown. As the trigger 102 is pulled, the disconnector 106 moves such that the notch 720 of the disconnector 106 engages the ridge 509 of the first sear 108. At this point, often referred to as "the wall," the movement of the trigger 102 in an actuation direction comes under noticeably higher resistance as actuation of the trigger 102 now has to overcome the bias of the first sear spring 210 that resists movement of the first sear 108. With increasing the pressure on the trigger shoe 310, upon further movement of the trigger 102 in the actuation direction, the disconnector 106 may cause the first sear 108 to rotate away from the hammer 110 such that the engagement ridge 504 of the first sear 108 disengages the platform 602 of the hammer 110, releasing the hammer 110 under the bias of the hammer spring 206. Upon release, the hammer 110, under the bias of the hammer spring 206, may strike the bolt of the firearm, causing a discharge of the firearm. The return of the hammer 110 back toward the disconnector 106 and the first sear 108 may be facilitated by the bolt carrier group of the firearm during the recoil motion of the bolt carrier group. The downward force of the hammer 110 striking the disconnector 106 may disengage the disconnector 106 from the first sear 108. The disconnector 106, the first sear 108, and the hammer 110 then may return to and be maintained in the initial arrangement until subsequent actuation of the trigger 102.

When the trigger system 2100 is in the fully-automatic mode, the trigger system 2100 may operate and the components thereof may interact with one another in a manner similar to that described above for the trigger system 1100 with respect to FIGS. 29A-29L, according to one or more examples of the disclosure. The selector 1116 may be in a fully-automatic rotational position, corresponding to the fully-automatic mode of the trigger system 2100. When the trigger system 2100 is in the fully-automatic mode, the connector 1112 and the second sear 2114 may be inactive at certain times and active at other times, and the disconnector 106 and the first sear 108 likewise may be active at certain times and inactive at other times. Specifically, when the trigger system 2100 is in the fully-automatic mode and the trigger 102 is not actuated, the connector 1112 and the second sear 2114 may be inactive, while the disconnector 106 and the first sear 108 may be active. In particular, when the trigger system 2100 is in the fully-automatic mode and the trigger 102 is not actuated, the second spring 1326 and the second plunger 1328 may bias the arm 808 of the connector 1112 into engagement with the selector 1116, such that the distal portion 810 of the connector 1112 engages the curved surface 1132 of the second region 1130 of the selector 1116 and is positioned near but slightly spaced apart from and not engaging the first sear 108, and thus the connector 1112 may be in an inactive state. Additionally, when the trigger system 2100 is in the fully-automatic mode and the trigger 102 is not actuated, the second sear spring 2122 and the second sear plunger 2124 may bias the arm 1004 of the second sear 2114 to rotate upward, but the carrier of the bolt-carrier group may block such upward rotation of the second sear 2114 and hold the second sear 2114 down such that the second sear 2114 does not engage the hammer 110, and thus the second sear 2114 may be in an inactive state. Meanwhile, when the trigger system 2100 is in the fully-automatic mode and the trigger 102 is not actuated, the first sear 108 may engage and sear the hammer 110, and the disconnector 106 may engage the first sear 108, and thus the first sear 108 and the disconnector 106 may be in an active state. However, when the trigger system 2100 is in the fully-automatic mode and the trigger 102 is actuated, the connector 1112 and the second sear 2114 may be active, while the disconnector 106 and the first sear 108 may be inactive. In particular, when the trigger system 2100 is in the fully-automatic mode and the trigger 102 is actuated, the movement of the trigger 102 may cause the connector 1112 to move such that the notch 820 of the connector 1112 engages the ridge 509 of the first sear 108 such that the first sear 108 is rotated away from the hammer 110 to a position in which the disconnector 106 does not engage the first sear 108, and thus the connector 1112 may be in an active state and the first sear 108 and the disconnector 106 may be in an inactive state. Additionally, when the trigger system 2100 is in the fully-automatic mode and the trigger 102 is actuated, the second sear spring 2122 and the second sear plunger 2124 may bias the arm 1004 of the second sear 2114 to rotate upward to a position at which the searing protrusion 1008 of the second sear 2114 is able to engage and sear the hammer 110 and the bolt-carrier protrusion 1018 of the second sear 2114 is able to be engaged by the carrier of the bolt-carrier group during fully-automatic cycling, and thus the second sear 1114 may be in an active state.

Rotation of the selector 1116 to the fully-automatic position may allow the second sear 2114 to rotate upward, under bias of the second sear spring 2122 and the second sear plunger 2124, as the planar surface 1124 of the first region 1120 of the selector 1116 faces the selector protrusion 1016 of the second sear 2114. However, the carrier of the bolt-carrier group may limit such upward rotation of the second sear 2114 and hold the second sear 2114 down such that the selector protrusion 1016 of the second sear 2114 does not engage the planar surface 1124 of the selector 1116 and such that the second sear 2114 does not engage the hammer 110. Additionally, rotation of the selector 1116 to the fully-automatic position may cause the arm 808 of the connector 1112 to rotate upward as the distal portion 810 of the connector 1112 engages the curved surface 1132 of the second region 1130 of the selector 1116. The engagement between the distal portion 810 of the connector 1112 and the curved surface 1132 of the selector 1116 may cause the distal portion 810 of the connector 1112 to be positioned near but slightly spaced apart from and not engaging the first sear 108. Meanwhile, the first sear 108 may engage and sear the hammer 110, and the disconnector 106 may engage the first sear 108.

Upon pulling the trigger 102 in its actuation direction, the movement of the trigger 102 may cause the connector 1112 to move such that the notch 820 of the connector 1112 engages the ridge 509 of the first sear 108 and such that the first sear 108 rotates away from and disengages the hammer 110, allowing the hammer 110 to fall. In this manner, while the trigger 102 remains pulled in the actuation direction, the connector 1112 may take over for the disconnector 106 and maintain the first sear 108 in a position in which the first sear 108 cannot engage the hammer 110. After firing the firearm utilizing the trigger system 2100 in the fully-automatic mode, the hammer 110 may be driven back such that the protrusion 616 of the hammer 110 engages the searing protrusion 1008 of the second sear 2114. Such engagement initially may cause the second sear 2114 to rotate downward and then, once the protrusion 616 has passed the searing protrusion 1008, the second sear 2114 may rotate upward such that the searing protrusion 1008 enters the recess 614 and engages the protrusion 616, thereby searing the hammer 110. At this point, fully-automatic cycling of the trigger system 2100 may be carried out by the second sear 2114, the hammer 110, and the carrier of the bolt-carrier group. The bolt-carrier protrusion 1018 of the second sear 2114 may be struck by the carrier as the bolt-carrier group returns forward such that the second sear 2114 rotates downward, thereby causing the searing protrusion 1008 of the second sear 2114 to disengage the protrusion 616 of the hammer 110 and allowing the hammer 110 to fall. Such operation of the trigger system 2100 in the fully-automatic mode may continue in this manner until the trigger 102 is released, at which point the trigger system 210 may return to its initial arrangement.

As discussed above, one drawback associated with certain existing trigger systems configured for use in both a semi-automatic mode and a fully-automatic mode is that the trigger pull weight may be significantly higher when the trigger system is in the fully-automatic mode as compared to when the trigger system is in the semi-automatic mode. The trigger system 2100 advantageously may avoid this drawback in view of how the trigger system 2100 operates in the fully-automatic mode as compared to the semi-automatic mode. Notably, in view of the configuration of the trigger system 2100, the same springs providing resistance to actuation of the trigger 102 may be active whether the trigger system 2100 is in the semi-automatic mode or the fully-automatic mode. As a result, the trigger pull weight when the trigger system 2100 is in the fully-automatic mode may be the same as or nearly the same as the trigger pull weight when the trigger system 2100 is in the semi-automatic mode, thereby providing a user with a consistent or nearly consistent feel during actuation of the trigger 102. According to the illustrated example of the trigger system 2100, although the same springs are active in the semi-automatic mode and the fully-automatic mode, the trigger pull weight may be slightly lower in the fully-automatic mode. This may occur because, when the trigger system 2100 is switched from the semi-automatic mode to the fully-automatic mode by rotating the selector 1116, as described above, the engagement between the connector 1112 and the selector 1116 may cause the connector 1112 to rotate to a position in which the second spring 1326 and the second plunger 1328 are slightly more compressed in the direction of trigger actuation, thereby providing slightly less resistance to actuation of the trigger 102 in the fully-automatic mode. In this manner, the trigger system 2100 may have a first pull weight for trigger actuation in the semi-automatic mode and a second pull weight for trigger actuation in the fully automatic mode. In some examples, as described above, the second pull weight may be less than the first pull weight. In some examples, the second pull weight may be less than but within 50% of the first pull weight. In some examples, the second pull weight may be less than but within 35% of the first pull weight. In some examples, the second pull weight may be less than but within 25% of the first pull weight. In some examples, the second pull weight may be less than but within 15% of the first pull weight. In some examples, the second pull weight may be less than but within 10% of the first pull weight. In some examples, the second pull weight may be less than but within 5% of the first pull weight. In some examples, the second pull weight may be less than but within 2% of the first pull weight. In some examples, the second pull weight may be less than but within 1% of the first pull weight. According to another example of the trigger system 1100, although the same springs may be active in the semi-automatic mode and the fully-automatic mode, the trigger pull weight in the fully-automatic mode and the trigger pull weight in the semi-automatic mode may be equal, or nearly equal, to one another. This may occur, for example, when the second spring 1326 is eliminated and an alternative mechanism is used for moving the connector 1112 relative to the selector 1116, as described above, such that resistance to actuation of the trigger 102 is the same, or nearly the same, in the fully-automatic mode and the semi-automatic mode. In this manner, the trigger system 1100 may have a first pull weight for trigger actuation in the semi-automatic mode and a second pull weight for trigger actuation in the fully automatic mode, with the second pull weight being equal, or nearly equal, to the first pull weight. In some examples, the second pull weight may be equal to the first pull weight. In some examples, the second pull weight may be less than or greater than but within 50% of the first pull weight. In some examples, the second pull weight may be less than or greater than but within 35% of the first pull weight. In some examples, the second pull weight may be less than or greater than but within 25% of the first pull weight. In some examples, the second pull weight may be less than or greater than but within 15% of the first pull weight. In some examples, the second pull weight may be less than or greater than but within 10% of the first pull weight. In some examples, the second pull weight may be less than or greater than but within 5% of the first pull weight. In some examples, the second pull weight may be less than or greater than but within 2% of the first pull weight. In some examples, the second pull weight may be less than or greater than but within 1% of the first pull weight. It will be appreciated that the difference between the second pull weight and the first pull weight may be impacted by the design and characteristics of the springs that provide resistance to actuation of the trigger 102 and any differences in compression of such springs when the trigger system 2100 is in the fully-automatic mode as compared to the semi-automatic mode. Ultimately, such springs and the overall trigger system 2100 may be designed such that the second pull weight and the first pull weight are nearly the same, thereby providing a nearly consistent feel for the user in both the fully-automatic mode and the semi-automatic mode.

When the trigger system 2100 is in the safe mode, the components of the trigger system 2100 may interact with one another in a manner similar to that described above for the trigger system 1100 with respect to FIGS. 20A-30C, according to one or more examples of the disclosure. Rotation of the selector 1116 to the safe position may cause the second sear 2114 to rotate downward, as the selector protrusion 1016 of the second sear 2114 engages the curved surface 1122 of the first region 1120 of the selector 1116, and thus the second sear 2114 may be in an inactive state. Additionally, rotation of the selector 1116 to the safe position may cause the arm 808 of the connector 1112 to rotate downward, under the bias of the second spring 1326 and the second plunger 1328, such that the distal portion 810 of the connector 1112 engages the planar surface 1136 of the second region 1130 of the selector 1116, and thus the connector 1112 may be in an inactive state. Meanwhile, the first sear 108 may engage and sear the hammer 110, and the disconnector 106 may engage the first sear 108. Additionally, the selector 1116 may prevent actuation of the trigger 102, as the tail 308 of the hammer 102 engages the curved surface 1132 of the selector 1116, preventing rotation of the trigger 102 in the actuation direction.

As described, the components of the trigger system 2100 may be pre-assembled in the manner shown and then inserted within and coupled to the lower receiver of a firearm. In particular, the trigger system 2100 may be coupled to the lower receiver by the hammer pin 120, the trigger pin 122, and the second sear pin 2118 being inserted into mating holes in opposing walls of the lower receiver. A first wall of the lower receiver may have a first hole for receiving one end of the hammer pin 120, a second hole for receiving one end of the trigger pin 122, and a third hole for receiving one end of the second sear pin 2118, while an opposite second wall of the lower receiver may have a first hole for receiving the other end of the hammer pin 120, a second hole for receiving the other end of the trigger pin 122, and a third hole for receiving the other end of the second sear pin 2118. In this manner, the lower receiver may be considered to have a "three-hole" configuration, one for the hammer pin 120, one for the trigger pin 122, and one for the second sear pin 2118, with the connections between the hammer pin 120, the trigger pin 122, the second sear pin 2118, and the respective holes of the lower receiver being sufficient for securely assembling the trigger system 2100 with respect to the lower receiver.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

Embodiments of the disclosure can be described in view of one or more of the following:

Embodiment 1 may include a trigger system comprising: a housing; a trigger rotationally coupled to the housing about a first bore of the trigger; a disconnector coupled to the trigger at a second bore of the trigger: a hammer rotationally coupled to the housing at a first end; and a sear operably engaging the disconnector and the hammer, and rotationally coupled to the housing; wherein the trigger is substantially balanced about the first bore.

Embodiment 2 may include Embodiment 1, wherein the trigger includes a cavity that receives a spring-loaded plunger that biases the disconnector into engagement with the sear.

Embodiment 3 may include Embodiment 1 or Embodiment 2, wherein disconnector includes a bore or recess configured to reduce the weight of the disconnected.

Embodiment 4 may include any one of Embodiments 1 to 3, wherein the trigger includes a trigger shoe that extends away from the first bore, and a tail member and a head member extending from the first bore in substantially opposite directions.

Embodiment 5 may include any one of Embodiments 1 to 4, wherein the housing includes a wing structure that engages the hammer to limit rotation of the hammer in a direction toward the disconnector.

Embodiment 6 may include any of Embodiments 1 to 5, wherein the trigger is coupled to the housing by a trigger pin and the hammer is coupled to the housing by a hammer pin, and wherein the housing defines a recess configured to receive a spring that retains the hammer pin and the trigger pin.

Embodiment 7 may include any of Embodiments 1 to 6, wherein the recess includes a protrusion that biases the spring against the hammer pin and the trigger pin.

Embodiment 8 may include any of Embodiments 1 to 7, wherein the protrusion includes a lip that retains the spring in the recess.

Embodiment 9 may include any of Embodiments 1 to 8, wherein the housing includes a compressible bumper that is configured to prevent movement of the dynamically balanced trigger system when installed.

Embodiment 10 may include any of Embodiments 1 to 9, wherein the housing includes a bore configured to receive a hammer pin that couples the hammer to the housing, wherein the bore is non-circular.

Embodiment 11 may include any of Embodiments 1 to 10, wherein the sear is coupled to the housing by a sear pin that is received by a bore in the sear, wherein the sear is substantially balanced about the bore in the sear.

Embodiment 12 may include a firearm, comprising: an upper; a barrel connected to the upper; a receiver; and a trigger system disposed within the receiver, the trigger system comprising, a housing; a trigger rotationally coupled to the housing about a first bore of the trigger; a disconnector coupled to the trigger at a second bore of the trigger: a hammer rotationally coupled to the housing at a first end; and a sear operably engaging the disconnector and the hammer, and rotationally coupled to the housing; wherein the trigger is dynamically balanced about the first bore.

Embodiment 13 may include Embodiment 12, wherein the trigger includes a cavity that receives a spring-loaded plunger that biases the disconnector into engagement with the sear.

Embodiment 14 may include Embodiment 12 or Embodiment 13, wherein the trigger includes a trigger shoe that extends away from the first bore, and a tail member and a head member extending from the first bore in substantially opposite directions.

Embodiment 15 may include any one of Embodiments 12 to 14, wherein the trigger is coupled to the housing by a trigger pin and the hammer is coupled to the housing by a hammer pin, and wherein the housing defines a recess configured to receive a spring that retains the hammer pin and the trigger pin, wherein the recess includes a protrusion that biases the spring against the hammer pin and the trigger pin, and wherein the protrusion includes a lip that retains the spring in the recess.

Embodiment 16 may include any one of Embodiments 12 to 15, wherein the trigger is coupled to the housing by a trigger pin and the hammer is coupled to the housing by a hammer pin, and wherein the housing defines a recess configured to receive a spring that retains the hammer pin and the trigger pin.

Embodiment 17 may include any one of Embodiments 12 to 16, wherein the recess includes a protrusion that biases the spring against the hammer pin and the trigger pin.

Embodiment 18 may include any one of Embodiments 12 to 17, wherein the protrusion includes a lip that retains the spring in the recess.

Embodiment 19 may include any one of Embodiments 12 to 18, wherein the housing includes a compressible bumper that is configured to prevent movement of the dynamically balanced trigger system when installed.

Embodiment 20 may include any one of Embodiments 12-19, wherein the housing includes a bore configured to receive a hammer pin that couples the hammer to the housing, wherein the bore is non-circular.

Embodiment 21 may include a trigger system for a firearm, the trigger system comprising: a housing; a selector configured to be adjusted relative to the housing to set the trigger system in each of a semi-automatic mode, a fully-automatic mode, and a safe mode; a trigger rotationally coupled to the housing; a hammer rotationally coupled to the housing; a first sear rotationally coupled to the housing and configured to selectively engage the hammer when the trigger system is in the semi-automatic mode; a second sear rotationally coupled to the housing and configured to selectively engage the hammer when the trigger system is in the fully-automatic mode; a disconnector rotationally coupled to the trigger and configured to selectively engage the first sear when the trigger system is in the semi-automatic mode; and a connector rotationally coupled to the trigger and configured to selectively engage the first sear when the trigger system is in the fully-automatic mode.

Embodiment 22 may include Embodiment 21, wherein: the hammer comprises a first searing surface and a second searing surface separate from the first searing surface; the first sear is configured to selectively engage the first searing surface when the trigger system is in the semi-automatic mode; and the second sear is configured to selectively engage the second searing surface when the trigger system is in the fully-automatic mode.

Embodiment 23 may include Embodiment 22, wherein: the first searing surface is disposed along an end of a head of the hammer; and the second searing surface is disposed along a lateral side of the head of the hammer.

Embodiment 24 may include Embodiment 23, wherein the second scar comprises: a searing protrusion disposed along a lateral side of the second sear and configured to selectively engage the second searing surface when the trigger system is in the fully-automatic mode; a bolt-carrier protrusion disposed along a top side of the second sear and configured to be selectively engaged by a bolt carrier of the firearm when the trigger system is in the fully-automatic mode, thereby causing the second sear to rotate such that the searing protrusion disengages the second searing surface; and a selector protrusion disposed along a bottom side of the second sear and configured to be selectively engaged by the selector such that the searing protrusion is able to engage the second searing surface when the trigger system is in the fully-automatic mode and such that the searing protrusion is unable to engage the second searing surface when the trigger system is in the semi-automatic mode or the safe mode.

Embodiment 25 may include any one of Embodiments 21 to 25, wherein the selector comprises: a first region configured to selectively engage the second sear to limit rotation of the second sear at a first rotational position when the trigger system is in the fully-automatic mode and at a second rotational position different from the first rotational position when the trigger system is in the semi-automatic mode or the safe mode; and a second region configured to selectively engage the connector to limit rotation of the connector at a third rotational position when the trigger system is in the fully-automatic mode and at a fourth rotational position different from the third rotational position when the trigger system is in the semi-automatic mode or the safe mode.

Embodiment 26 may include Embodiment 25, further comprising: a first spring configured to bias the second sear to the first rotational position when the trigger system is in the fully-automatic mode and to the second rotational position when the trigger system is in the semi-automatic mode or the safe mode; and a second spring configured to bias the connector to the third rotational position when the trigger system is in the fully-automatic mode and to the fourth rotational position when the trigger system is in the semi-automatic mode or the safe mode.

Embodiment 27 may include any one of Embodiments 21 to 26, wherein: the disconnector is configured to selectively engage the first sear such that the first sear disengages the hammer when the trigger system is in the semi-automatic mode; and the connector is configured to selectively engage the first sear such that the first sear disengages the hammer when the trigger system is in the fully-automatic mode.

Embodiment 28 may include any one of Embodiments 21 to 27, wherein: the disconnector is rotationally coupled to the trigger at a first bore of the trigger by a disconnector pin; and the connector is rotationally coupled to the trigger at the first bore of the trigger by the disconnector pin.

Embodiment 29 may include any one of Embodiments 21 to 28, wherein: the disconnector is disposed at least partially within a channel of the trigger; and the connector is disposed adjacent to the disconnector and at least partially within the channel of the trigger.

Embodiment 30 may include any one of Embodiments 21 to 29, further comprising: a first spring configured to bias the disconnector to rotate toward the first sear; and a second spring configured to bias the connector to rotate away from the first sear.

Embodiment 31 may include a firearm comprising: an upper receiver; a barrel coupled to the upper receiver; a lower receiver coupled to the upper receiver; and a trigger system disposed at least partially within the lower receiver, the trigger system comprising: a housing; a selector configured to be adjusted relative to the housing to set the trigger system in each of a semi-automatic mode, a fully-automatic mode, and a safe mode; a trigger rotationally coupled to the housing; a hammer rotationally coupled to the housing; a first sear rotationally coupled to the housing and configured to selectively engage the hammer when the trigger system is in the semi-automatic mode; a second sear rotationally coupled to the housing and configured to selectively engage the hammer when the trigger system is in the fully-automatic mode; a disconnector rotationally coupled to the trigger and configured to selectively engage the first sear when the trigger system is in the semi-automatic mode; and a connector rotationally coupled to the trigger and configured to selectively engage the first sear when the trigger system is in the fully-automatic mode.

Embodiment 32 may include Embodiment 31, wherein: the hammer comprises: a first searing surface disposed along an end of a head of the hammer; and a second searing surface disposed along a lateral side of the head of the hammer; the first sear is configured to selectively engage the first searing surface when the trigger system is in the semi-automatic mode; and the second sear is configured to selectively engage the second searing surface when the trigger system is in the fully-automatic mode.

Embodiment 33 may include Embodiment 32, wherein the second sear comprises: a searing protrusion disposed along a lateral side of the second sear and configured to selectively engage the second searing surface when the trigger system is in the fully-automatic mode; a bolt-carrier protrusion disposed along a top side of the second sear and configured to be selectively engaged by a bolt carrier of the firearm when the trigger system is in the fully-automatic mode, thereby causing the second sear to rotate such that the searing protrusion disengages the second searing surface; and a selector protrusion disposed along a bottom side of the second sear and configured to be selectively engaged by the selector such that the searing protrusion is able to engage the second searing surface when the trigger system is in the fully-automatic mode and such that the searing protrusion is unable to engage the second searing surface when the trigger system is in the semi-automatic mode or the safe mode.

Embodiment 34 may include any one of Embodiments 31 to 33, wherein: the selector comprises: a first region configured to selectively engage the second sear to limit rotation of the second sear at a first rotational position when the trigger system is in the fully-automatic mode and at a second rotational position different from the first rotational position when the trigger system is in the semi-automatic mode or the safe mode; and a second region configured to selectively engage the disconnector to limit rotation of the disconnector at a third rotational position when the trigger system is in the fully-automatic mode and at a fourth rotational position different from the third rotational position when the trigger system is in the semi-automatic mode or the safe mode; and the trigger system further comprises: a first spring configured to bias the second sear to the first rotational position when the trigger system is in the fully-automatic mode and to the second rotational position when the trigger system is in the semi-automatic mode or the safe mode; and a second spring configured to bias the connector to the third rotational position when the trigger system is in the fully-automatic mode and to the fourth rotational position when the trigger system is in the semi-automatic mode or the safe mode.

Embodiment 35 may include any one of Embodiments 31 to 34, wherein: the disconnector is configured to selectively engage the first sear such that the first sear disengages the hammer when the trigger system is in the semi-automatic mode; the connector is configured to selectively engage the first sear such that the first sear disengages the hammer when the trigger system is in the fully-automatic mode; the disconnector is rotationally coupled to the trigger at a first bore of the trigger by a disconnector pin; the connector is rotationally coupled to the trigger at the first bore of the trigger by the disconnector pin; the disconnector is disposed at least partially within a channel of the trigger; the connector is disposed adjacent to the disconnector and at least partially within the channel of the trigger; and the trigger system further comprises: a first spring configured to bias the disconnector to rotate toward the first sear; and a second spring configured to bias the connector to rotate away from the first sear.

Embodiment 36 may include a trigger system for a firearm, the trigger system comprising: a housing; a selector configured to be adjusted relative to the housing to set the trigger system in each of a semi-automatic mode, a fully-automatic mode, and a safe mode; a trigger rotationally coupled to the housing; a hammer rotationally coupled to the housing, the hammer comprising: a first searing surface disposed along an end of a head of the hammer; and a second searing surface disposed along a lateral side of the head of the hammer; a first sear rotationally coupled to the housing and configured to selectively engage the hammer when the trigger system is in the semi-automatic mode; and a second sear rotationally coupled to the housing and configured to selectively engage the hammer when the trigger system is in the fully-automatic mode.

Embodiment 37 may include Embodiment 36, wherein the second sear comprises: a searing protrusion disposed along a lateral side of the second sear and configured to selectively engage the second searing surface when the trigger system is in the fully-automatic mode; a bolt-carrier protrusion disposed along a top side of the second sear and configured to be selectively engaged by a bolt carrier of the firearm when the trigger system is in the fully-automatic mode, thereby causing the second sear to rotate such that the searing protrusion disengages the second searing surface; and a selector protrusion disposed along a bottom side of the second sear and configured to be selectively engaged by the selector such that the searing protrusion is able to engage the second searing surface when the trigger system is in the fully-automatic mode and such that the searing protrusion is unable to engage the second searing surface when the trigger system is in the semi-automatic mode or the safe mode.

Embodiment 38 may include Embodiment 36 or Embodiment 37, further comprising: a disconnector rotationally coupled to the trigger and configured to selectively engage the first sear when the trigger system is in the semi-automatic mode; and a connector rotationally coupled to the trigger and configured to selectively engage the first sear when the trigger system is in the fully-automatic mode.

Embodiment 39 may include Embodiment 38, wherein: the selector comprises: a first region configured to selectively engage the second sear to limit rotation of the second sear at a first rotational position when the trigger system is in the fully-automatic mode and at a second rotational position different from the first rotational position when the trigger system is in the semi-automatic mode or the safe mode; and a second region configured to selectively engage the connector to limit rotation of the connector at a third rotational position when the trigger system is in the fully-automatic mode and at a fourth rotational position different from the third rotational position when the trigger system is in the semi-automatic mode or the safe mode; and the trigger system further comprises: a first spring configured to bias the second sear to the first rotational position when the trigger system is in the fully-automatic mode and to the second rotational position when the trigger system is in the semi-automatic mode or the safe mode; and a second spring configured to bias the connector to the third rotational position when the trigger system is in the fully-automatic mode and to the fourth rotational position when the trigger system is in the semi-automatic mode or the safe mode.

Embodiment 40 may include Embodiment 38 or Embodiment 39, wherein: the disconnector is configured to selectively engage the first sear such that the first sear disengages the hammer when the trigger system is in the semi-automatic mode; the connector is configured to selectively engage the first sear such that the first sear disengages the hammer when the trigger system is in the fully-automatic mode; the disconnector is rotationally coupled to the trigger at a first bore of the trigger by a disconnector pin; the connector is rotationally coupled to the trigger at the first bore of the trigger by the disconnector pin; the disconnector is disposed at least partially within a channel of the trigger; the connector is disposed adjacent to the disconnector and at least partially within the channel of the trigger; and the trigger system further comprises: a first spring configured to bias the disconnector to rotate toward the first sear; and a second spring configured to bias the connector to rotate away from the first sear.

We claim:

1. A trigger system for a firearm, the trigger system comprising:

a housing;

a selector configured to be adjusted relative to the housing to set the trigger system in each of a semi-automatic mode, a fully-automatic mode, and a safe mode;

a trigger rotationally coupled to the housing;

a hammer rotationally coupled to the housing;

a first sear rotationally coupled to the housing and configured to selectively engage the hammer when the trigger system is in the semi-automatic mode;

a second sear rotationally coupled to the housing and configured to selectively engage the hammer when the trigger system is in the fully-automatic mode;

a disconnector rotationally coupled to the trigger and configured to selectively engage the first sear when the trigger system is in the semi-automatic mode; and a connector rotationally coupled to the trigger and configured to selectively engage the first sear when the trigger system is in the fully-automatic mode.

2. The trigger system of claim 1, wherein:

the hammer comprises a first searing surface and a second searing surface separate from the first searing surface;

the first sear is configured to selectively engage the first searing surface when the trigger system is in the semi-automatic mode; and the second sear is configured to selectively engage the second searing surface when the trigger system is in the fully-automatic mode.

3. The trigger system of claim 2, wherein:

the first searing surface is disposed along an end of a head of the hammer; and the second searing surface is disposed along a lateral side of the head of the hammer.

4. The trigger system of claim 3, wherein the second sear comprises:

a searing protrusion disposed along a lateral side of the second sear and configured to selectively engage the second searing surface when the trigger system is in the fully-automatic mode;

a bolt-carrier protrusion disposed along a top side of the second sear and configured to be selectively engaged by a bolt carrier of the firearm when the trigger system is in the fully-automatic mode, thereby causing the second sear to rotate such that the searing protrusion disengages the second searing surface; and a selector protrusion disposed along a bottom side of the second sear and configured to be selectively engaged by the selector such that the searing protrusion is able to engage the second searing surface when the trigger system is in the fully-automatic mode and such that the searing protrusion is unable to engage the second searing surface when the trigger system is in the semi-automatic mode or the safe mode.

5. The trigger system of claim 1, wherein the selector comprises:

a first region configured to selectively engage the second sear to limit rotation of the second sear at a first rotational position when the trigger system is in the fully-automatic mode and at a second rotational position different from the first rotational position when the trigger system is in the semi-automatic mode or the safe mode; and a second region configured to selectively engage the connector to limit rotation of the connector at a third rotational position when the trigger system is in the fully-automatic mode and at a fourth rotational position different from the third rotational position when the trigger system is in the semi-automatic mode or the safe mode.

6. The trigger system of claim 5, further comprising:

a first spring configured to bias the second sear to the first rotational position when the trigger system is in the fully-automatic mode and to the second rotational position when the trigger system is in the semi-automatic mode or the safe mode; and a second spring configured to bias the connector to the third rotational position when the trigger system is in the fully-automatic mode and to the fourth rotational position when the trigger system is in the semi-automatic mode or the safe mode.

7. The trigger system of claim 1, wherein:

the disconnector is configured to selectively engage the first sear such that the first sear disengages the hammer when the trigger system is in the semi-automatic mode; and the connector is configured to selectively engage the first sear such that the first sear disengages the hammer when the trigger system is in the fully-automatic mode.

8. The trigger system of claim 1, wherein:

the disconnector is rotationally coupled to the trigger at a first bore of the trigger by a disconnector pin; and the connector is rotationally coupled to the trigger at the first bore of the trigger by the disconnector pin.

9. The trigger system of claim 1, wherein:

the disconnector is disposed at least partially within a channel of the trigger; and the connector is disposed adjacent to the disconnector and at least partially within the channel of the trigger.

10. The trigger system of claim 1, further comprising:

a first spring configured to bias the disconnector to rotate toward the first sear; and a second spring configured to bias the connector to rotate away from the first sear.

11. A firearm comprising:

an upper receiver;

a barrel coupled to the upper receiver;

a lower receiver coupled to the upper receiver; and a trigger system disposed at least partially within the lower receiver, the trigger system comprising:

a housing;

a selector configured to be adjusted relative to the housing to set the trigger system in each of a semi-automatic mode, a fully-automatic mode, and a safe mode;

a trigger rotationally coupled to the housing;

a hammer rotationally coupled to the housing;

a first sear rotationally coupled to the housing and configured to selectively engage the hammer when the trigger system is in the semi-automatic mode;

a second sear rotationally coupled to the housing and configured to selectively engage the hammer when the trigger system is in the fully-automatic mode;

a disconnector rotationally coupled to the trigger and configured to selectively engage the first sear when the trigger system is in the semi-automatic mode; and a connector rotationally coupled to the trigger and configured to selectively engage the first sear when the trigger system is in the fully-automatic mode.

12. The firearm of claim 11, wherein:

the hammer comprises:

a first searing surface disposed along an end of a head of the hammer; and a second searing surface disposed along a lateral side of the head of the hammer;

the first sear is configured to selectively engage the first searing surface when the trigger system is in the semi-automatic mode; and the second sear is configured to selectively engage the second searing surface when the trigger system is in the fully-automatic mode.

13. The firearm of claim 12, wherein the second sear comprises:

a searing protrusion disposed along a lateral side of the second sear and configured to selectively engage the second searing surface when the trigger system is in the fully-automatic mode;

a bolt-carrier protrusion disposed along a top side of the second sear and configured to be selectively engaged by a bolt carrier of the firearm when the trigger system is in the fully-automatic mode, thereby causing the second sear to rotate such that the searing protrusion disengages the second searing surface; and a selector protrusion disposed along a bottom side of the second sear and configured to be selectively engaged by the selector such that the searing protrusion is able to engage the second searing surface when the trigger system is in the fully-automatic mode and such that the searing protrusion is unable to engage the second searing surface when the trigger system is in the semi-automatic mode or the safe mode.

14. The firearm of claim 11, wherein:

the selector comprises:

a first region configured to selectively engage the second sear to limit rotation of the second sear at a first rotational position when the trigger system is in the fully-automatic mode and at a second rotational position different from the first rotational position when the trigger system is in the semi-automatic mode or the safe mode; and a second region configured to selectively engage the connector to limit rotation of the connector at a third rotational position when the trigger system is in the fully-automatic mode and at a fourth rotational position different from the third rotational position when the trigger system is in the semi-automatic mode or the safe mode; and the trigger system further comprises:

a first spring configured to bias the second sear to the first rotational position when the trigger system is in the fully-automatic mode and to the second rotational position when the trigger system is in the semi-automatic mode or the safe mode; and a second spring configured to bias the connector to the third rotational position when the trigger system is in the fully-automatic mode and to the fourth rotational position when the trigger system is in the semi-automatic mode or the safe mode.

15. The firearm of claim 11, wherein:

the disconnector is configured to selectively engage the first sear such that the first sear disengages the hammer when the trigger system is in the semi-automatic mode;

the connector is configured to selectively engage the first sear such that the first sear disengages the hammer when the trigger system is in the fully-automatic mode;

the disconnector is rotationally coupled to the trigger at a first bore of the trigger by a disconnector pin;

the connector is rotationally coupled to the trigger at the first bore of the trigger by the disconnector pin;

the disconnector is disposed at least partially within a channel of the trigger;

the connector is disposed adjacent to the disconnector and at least partially within the channel of the trigger; and the trigger system further comprises:

a first spring configured to bias the disconnector to rotate toward the first sear; and a second spring configured to bias the connector to rotate away from the first sear.

16. A trigger system for a firearm, the trigger system comprising:

a housing;

a selector configured to be adjusted relative to the housing to set the trigger system in each of a semi-automatic mode, a fully-automatic mode, and a safe mode;

a trigger rotationally coupled to the housing;

a hammer rotationally coupled to the housing, the hammer comprising:

a first searing surface disposed along an end of a head of the hammer; and a second searing surface disposed along a lateral side of the head of the hammer;

a first sear rotationally coupled to the housing and configured to selectively engage the hammer when the trigger system is in the semi-automatic mode; and a second sear rotationally coupled to the housing and configured to selectively engage the hammer when the trigger system is in the fully-automatic mode.

17. The trigger system of claim 16, wherein the second sear comprises:

a searing protrusion disposed along a lateral side of the second sear and configured to selectively engage the second searing surface when the trigger system is in the fully-automatic mode;

a bolt-carrier protrusion disposed along a top side of the second sear and configured to be selectively engaged by a bolt carrier of the firearm when the trigger system is in the fully-automatic mode, thereby causing the second sear to rotate such that the searing protrusion disengages the second searing surface; and a selector protrusion disposed along a bottom side of the second sear and configured to be selectively engaged by the selector such that the searing protrusion is able to engage the second searing surface when the trigger system is in the fully-automatic mode and such that the searing protrusion is unable to engage the second searing surface when the trigger system is in the semi-automatic mode or the safe mode.

18. The trigger system of claim 16, further comprising:

a disconnector rotationally coupled to the trigger and configured to selectively engage the first sear when the trigger system is in the semi-automatic mode; and a connector rotationally coupled to the trigger and configured to selectively engage the first sear when the trigger system is in the fully-automatic mode.

19. The trigger system of claim 18, wherein:

the selector comprises:

a first region configured to selectively engage the second sear to limit rotation of the second sear at a first rotational position when the trigger system is in the fully-automatic mode and at a second rotational position different from the first rotational position when the trigger system is in the semi-automatic mode or the safe mode; and a second region configured to selectively engage the connector to limit rotation of the connector at a third rotational position when the trigger system is in the fully-automatic mode and at a fourth rotational position different from the third rotational position when the trigger system is in the semi-automatic mode or the safe mode; and the trigger system further comprises:

a first spring configured to bias the second sear to the first rotational position when the trigger system is in the fully-automatic mode and to the second rotational position when the trigger system is in the semi-automatic mode or the safe mode; and a second spring configured to bias the connector to the third rotational position when the trigger system is in the fully-automatic mode and to the fourth rotational position when the trigger system is in the semi-automatic mode or the safe mode.

20. The trigger system of claim 18, wherein:

the disconnector is configured to selectively engage the first sear such that the first sear disengages the hammer when the trigger system is in the semi-automatic mode;

the connector is configured to selectively engage the first sear such that the first sear disengages the hammer when the trigger system is in the fully-automatic mode;

the disconnector is rotationally coupled to the trigger at a first bore of the trigger by a disconnector pin;

the connector is rotationally coupled to the trigger at the first bore of the trigger by the disconnector pin;

the disconnector is disposed at least partially within a channel of the trigger;

the connector is disposed adjacent to the disconnector and at least partially within the channel of the trigger; and the trigger system further comprises:

a first spring configured to bias the disconnector to rotate toward the first sear; and a second spring configured to bias the connector to rotate away from the first sear.

* * * * *